US008220181B2

(12) United States Patent
Killion

(10) Patent No.: US 8,220,181 B2
(45) **Date of Patent: *Jul. 17, 2012**

(54) FULL SUSPENSION FOOTWEAR

(76) Inventor: David L. Killion, Clarkston, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/842,460

(22) Filed: Jul. 23, 2010

(65) Prior Publication Data

US 2010/0281710 A1 Nov. 11, 2010

Related U.S. Application Data

(62) Division of application No. 11/148,744, filed on Jun. 7, 2005, now Pat. No. 7,788,823.

(60) Provisional application No. 60/655,925, filed on Feb. 24, 2005, provisional application No. 60/577,632, filed on Jun. 7, 2004.

(51) Int. Cl.
*A43B 3/10* (2006.01)
*A63B 25/00* (2006.01)

(52) U.S. Cl. ..... 36/7.8; 36/1; 482/75

(58) Field of Classification Search ..... 36/7.8, 36/1, 25 R; 482/75–77
See application file for complete search history.

(56) References Cited

U.S. PATENT DOCUMENTS 1,613,538 A * 1/1927 Schad ..... 36/7.8
3,058,120 A * 10/1962 Smith et al. ..... 623/28
3,102,272 A * 9/1963 Emmert ..... 623/28
4,822,038 A 4/1989 Maag
5,701,685 A 12/1997 Pezza
6,648,803 B1 11/2003 Jay
6,684,531 B2 2/2004 Rennex
6,709,369 B1 3/2004 Jacobs
6,840,893 B2 * 1/2005 Yoon ..... 482/77
7,290,354 B2 11/2007 Perenich
7,788,823 B2 * 9/2010 Killion et al. ..... 36/7.8
2002/0193210 A1 12/2002 Turner
2003/0092538 A1 5/2003 Kuo
2005/0137065 A1 6/2005 Zoller et al.
2005/0202940 A1 * 9/2005 Simmons ..... 482/75
2005/0239611 A1 10/2005 Commisso
2005/0262725 A1 12/2005 Rennex et al.
2006/0021262 A1 2/2006 Killion et al.

* cited by examiner

*Primary Examiner* — Ted Kavanaugh
(74) *Attorney, Agent, or Firm* — Cantor Colburn LLP

(57) ABSTRACT

A method and apparatus for enhancing the ability of a human to run and jump with comfort comparable to running barefoot on a trampoline and with control comparable to that of the unaided human form, yet with freedom from ankle-turning roll moments associated with substantial ground contact member (GCM) extension downwardly away from the sole of the foot including, a resiliently urged GCM constrained to two degrees of freedom: translation away from the sole of the user's foot and rotation about a longitudinal axis at ground level. The apparatus relates flexure of a GCM toe pressure member to comparable flexure of user's toes at the metatarsal joints. The apparatus also incorporates lower leg to ankle pivot bracing, and extends the GCM in downward direction parallel to the lower leg while mimicking user ankle articulation with parallelism-maintaining rotation about a downwardly resiliently urged transverse pivot axis similar to the user's own ankle joint for extended travel.

16 Claims, 56 Drawing Sheets

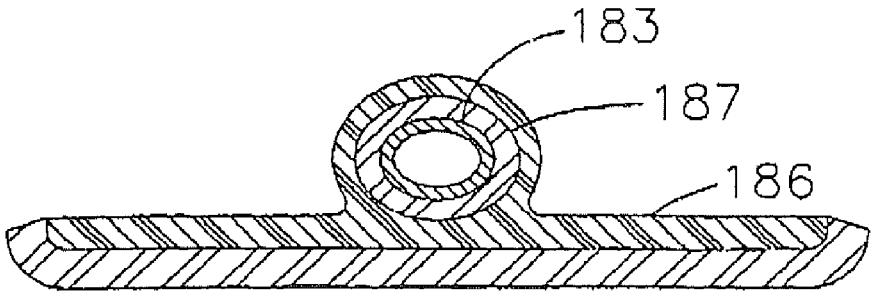
Fig.13A
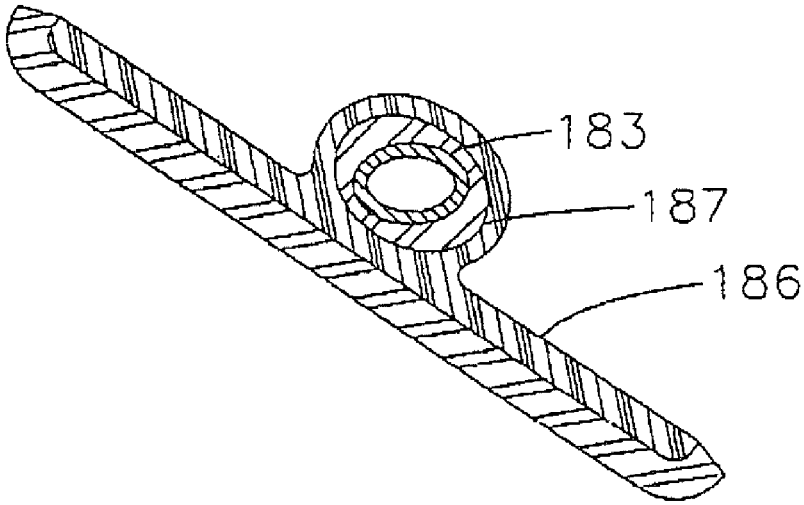
Fig.13A.1

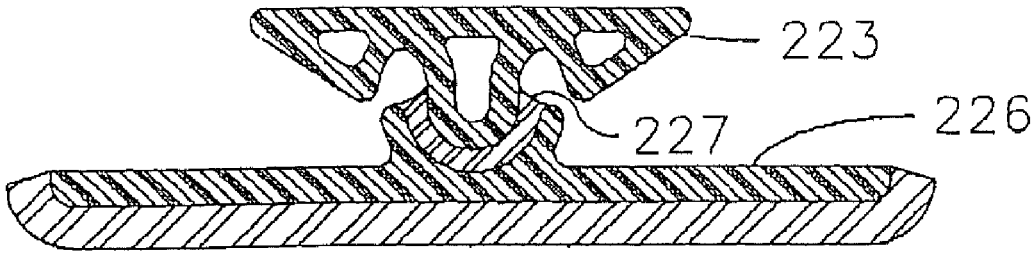
Fig. 15B.3
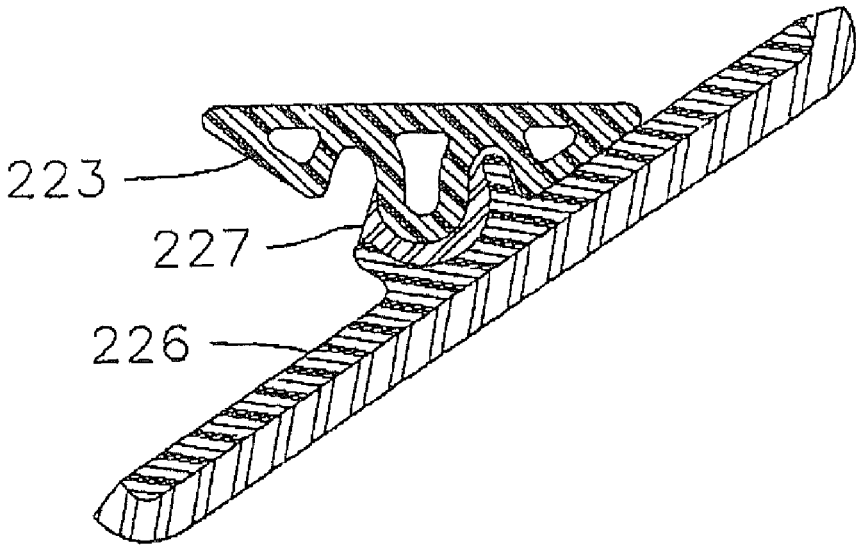
Fig. 15B.4

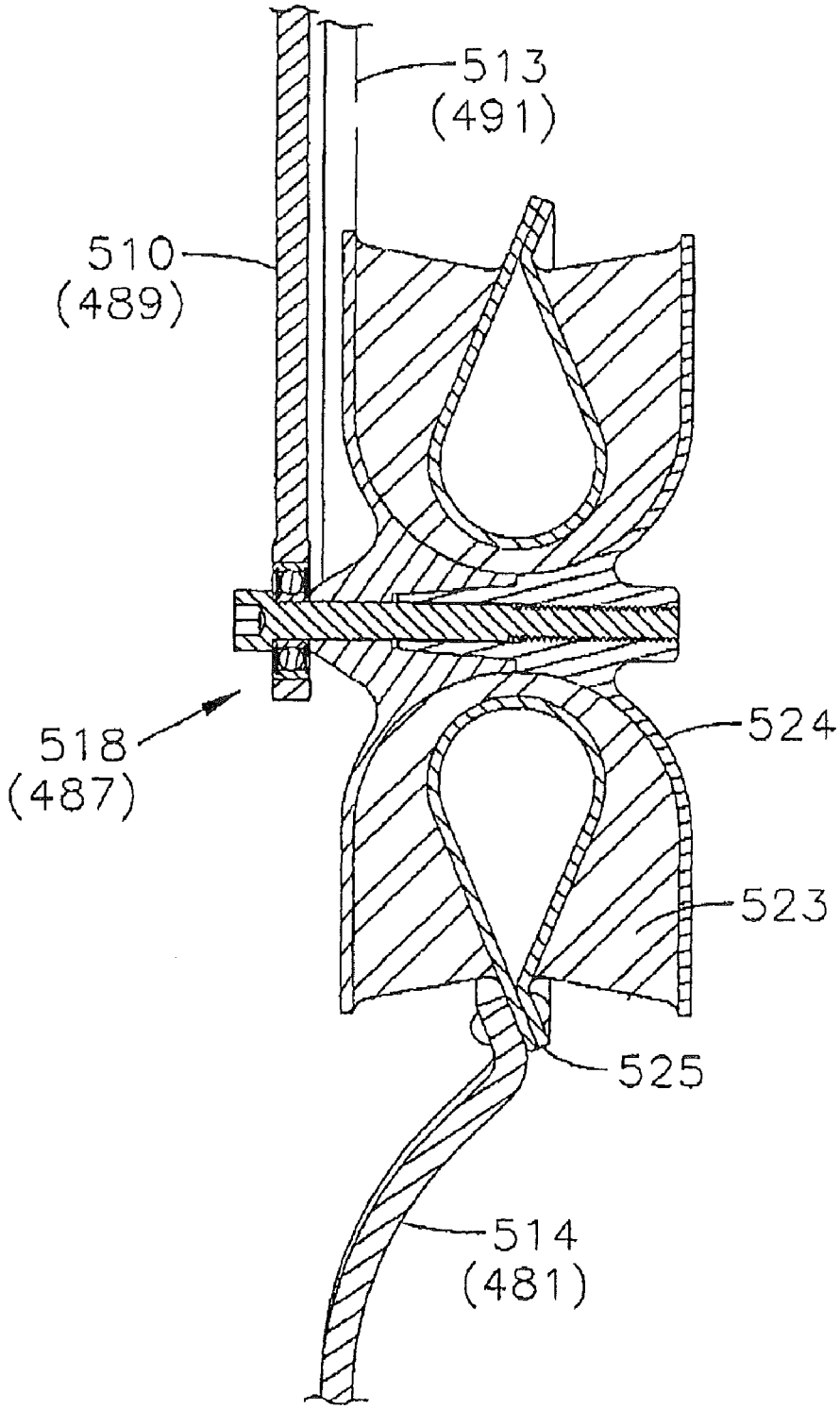
Fig.31B (30)

FULL SUSPENSION FOOTWEAR

CROSS REFERENCE TO RELATED APPLICATIONS

This application is a divisional application of U.S. patent application Ser. No. 11/148,744, filed on Jun. 7, 2005 entitled "Full Suspension Footwear" which claims priority from U.S. Provisional Patent Application Ser. No. 60/577,632, filed Jun. 7, 2004, and entitled "Springy Sport Shoes" and U.S. Provisional Patent Application Ser. No. 60/655,925, filed Feb. 24, 2005, and also entitled "Springy Sport Shoes".

TECHNICAL FIELD

The present invention relates to the fields of sporting goods for athletic use, health and fitness equipment, physical rehabilitation, running, jogging, shock absorbing footwear, and the extension of ambulatory exercise benefits to persons with skeletal and/or joint infirmities that currently inhibit such activities because of the impact loadings therein comprised.

BACKGROUND OF THE INVENTION

The health benefits of running, jogging and walking are widely known and have been well documented. An entire industry of sporting footwear, running apparel, and related periodical publications dedicated to enhancing these forms of exercise, has arisen in recent years, with the result of highly comfortable, shock absorbing footwear being available globally. These products share a common benefit over traditional footwear, namely increased cushioning or resilience without undue loss of lateral stability. The means by which this resilience is accomplished is almost universally the employment of elastomeric foam (air entrained in various elastomeric materials), or air bags, or both, for cushioning, typically in conjunction with somewhat oversized (principally overly wide) sole areas to offset the decreased lateral stability that the introduction of the cushioning material involves. Limitations of these traditional approaches in providing for increasing cushioning with operational safety include 1.) the rising spring rate inherent to elastomer-based compression springs, and 2.) the limited travel magnitude that can be employed before incurring excess loss of lateral stability. Numerous inventive proposals to increase shock absorption and resilience, over those of the so-called miming shoe, have been patented, some of which include efforts to deal with the loss of lateral stability inherent to the various cushioning mechanisms. None, however, provide practical (quiet, lightweight, and robust vs. wear) mechanisms for storing and releasing the kinetic energy of a runner's stride while dealing with the increased ankle-turning roll moment due to increased foot elevation, above the ground at impact, that increased cushioning travel entails, and while also providing for direction-of-travel motion control similar to that inherent to the human body's design architecture. Accordingly, there exists a need to overcome these current art limitations in order to improve both safety and enjoyability of these very beneficial forms of physical exercise, with the concurrent benefit of reduced impact loading magnitudes.

1 Lateral is defined herein as sideways, or in the transverse direction, where "Longitudinal" is defined as the fore-aft direction as typified by the long axis of the foot, and the direction of normal forward travel. For purposes of this text, "Pitch" or Pitching" is defined in common with aircraft terminology, as rotation about a transverse or lateral axis, i.e. in a forward rolling mode; "Roll" or "Rolling" is defined as tilt in the lateral direction, or rotation about a longitudinal axis, while "Yaw" will be understood to be rotation about a substantially vertical axis.

SUMMARY OF THE INVENTION

It is an advantage of this invention to simulate, to the greatest degree possible, the act of running on a hypothetical "endless" (or unbounded) trampoline, wherein vertical acceleration (of the runner's center of gravity) due to gravity is opposed by quiet, precisely controlled, long travel resilience of lightweight shoes over sufficient time duration as to maximize running efficiency and comfort.

It is a further advantage of this invention to enable lateral acceleration, with minimal torque on the runner's ankle due to the additional height required by the above long travel resiliency advantage, simulating the cornering capability of a hockey skate while yet providing normal ground contact area for the "flotation" needed for disadvantage-free operation on loose or compressible ground surfaces.

It is a still further advantage of this invention to enable normal-feeling and acting toe articulation action and feedback for normal forward motion control efficiency and balance under all operating conditions, including the climbing of steep slopes in directions that include bias with respect to the fall lines of said slopes.

It is yet another advantage of this invention to operate with freedom from resonance or flapping of components.

It is still another advantage of this invention to provide for cooling of the sole area of the wearer's foot, to enhance comfort and reduce buildup of potentially deleterious moisture during use.

It is further still an advantage of this invention to provide for comfort and running efficiency by minimization of shoe mass and inertia.

It is a benefit of this invention to avoid inward protuberance of hardware that would reduce normal miming clearance between shoes.

It is a further benefit of this invention to provide an optional mechanism for stabilization of a normally-articulating ankle against roll mode torques on the ankle joint that might occasion severe lateral accelerations, and to integrate the stabilization into extended travel variants of the invention.

It is finally an objective of this invention to provide freedom from wear and deterioration of mobile interfaces and clearances over time.

The storage and transfer of the bulk of the energy of landing of a runner's stride to the point of usefulness during toe-off requires an appropriate combination of both resilient spring rate and travel capability. If this combination does not correspond sufficiently to the runner's weight as to produce the appropriate vibratory sub-period, or time interval during which the spring is compressed, then either bottom-out, due to insufficient travel for the spring rate, or else premature release in the case of too-stiff a rate, will occur. Additionally, as has been recognized by Rennex, U.S. Pat. No. 6,684,531, the resilient compression effected by heel strike must also result in compressed metatarsal-region structure, in order to be available for resilient release during toe-off The maintenance of pitching mode attitude of ground contact member (hereafter "GCM") to being substantially parallel to the plane[2] of the shoe sole member (hereafter "SSM") is thus dictated in conjunction with resiliently-urged downward motion of the GCM. This substantially parallel-to-SSM GCM functionality essentially replicates the action of a trampoline, wherein an effectively "single degree of freedom" spring member is equally useful to both heel and toe. Devices which lack this substantial parallelism, such as e.g. Schnell, U.S. Pat. No. 4,534,124, are able to provide some compressive resilience and rebound assistance for running, but are disadvantaged by their lack of pitching mode stiffness, wherein the toe-off spring rate is too low for push off effectiveness, as well as for direction-of-motion balance and control. Devices having distributed, or multiple independent local compliances may enhance comfort, but lacking the unitized motion control by which compression of the heel region also compresses the metatarsal region, i.e. enforced pitching mode parallelism between the resiliently urged GCM and the plane of the SSM, such devices are simply unable to store heel strike energy for release during the toe-off phase for increase of running efficiency.

2 The plane of SSM is herein defined as having the same relationship to the user's foot as has a uniformly padded or cushioned horizontal surface upon which a barefooted user has achieved static balance while standing on the foot with which the SSM is associated.

The shortcomings of prior art in comparison to this substantially parallel-to-SSM GCM motion control have been adequately summarized by Rennex and are herein incorporated by reference. The Rennex configuration, however, while an intended efficiency improvement, includes substantial risk of ankle injury due to side loading, in that the GCM's "non-tilt" parallelism to the SSM applies not only to the pitching mode (as seen, for example, in a side view), but also to the roll mode (as seen in a rear or front view), wherein it acts to generate ankle-turning[3] roll mode moment loading as the GCM attempts to "square up to," or attain full contact with, a sloped or uneven treading surface.

3 The terminology "ankle turning" is herein used in the sense of common usage, i.e. a "turned ankle" being one that has been accidentally injured by overextension in the roll mode, usually a result of encountering a situation that loads the ankle with the shoe sole becoming excessively out of square, laterally, with the lower leg.

Additionally, the Rennex apparatus lacks energy efficiency in the critical toe-off phase foot orientation because, while allowing for natural metatarsal joint flexure, it does so with the GCM remaining flat on the ground. In this orientation, whatever resilient urging may remain of the GCM compression of heel strike can only be released in a vertical (or normal to treading surface) direction. At toe-off the user's foot and lower leg are rotated forward. To be maximally useful for running efficiency, GCM resilient urging should be "soft" enough to remain active throughout the stride cycle's ground contact phase, i.e. with some residual compression and resilient urging remaining for the final toe-off phase when the foot and lower leg are rotated forward, and the residual urging should be directed normal to the plane of the SSM or parallel to the shin such that its rearward resultant helps propel the user forward, countering the anti-propulsive energy absorbed at heel strike when the lower leg is rotated backwards. The "vertical" lifting to which the Rennex GCM is limited is of minimal propulsion benefit to a forward-leaning limb, and the abrupt "catch-up" acceleration of a flat-laying resilient urging mechanism from horizontal, to the parallelism-to-SSM needed in time for the next heel strike, represents a distracting if not dangerous "flapping motion" which introduces a whole new range of problems.

Ankle-turning moment loading is a naturally-occurring event which, in the case of conventional shoes, results from sideways slanting of the shin with respect to the local ground, or treading surface area under the GCM. To the extent that the shin (herein and hereafter used as descriptive substitute for a line between the knee and ankle joints and thus the laterally nominal direction of force transfer) is not laterally normal (perpendicular) to the local slope or attitude of the treading surface, the (nominally normal to shin, roll mode-wise) shoe sole encounters edge loading as weight or force is applied. The lateral offset of the first-contacting sole edge from the ankle joint's lateral or roll mode center of rotation, as measured normal to the loading direction, i.e. the shin, constitutes a moment arm length which, in conjunction with applied weight or force, endeavors to torque the shoe sole towards parallelism with the treading surface. This lateral torque, or roll moment, is, in the usual case of conventional shoes on suitably navigable terrain, subsequently limited in its ability to "turn" the ankle in roll mode pivoting by the shoe sole's attaining parallelism with the treading surface, wherein the initial edge loading becomes counterbalanced by other areas of the shoe sole acting to centralize the load to having resultant location with smaller offset from the ankle joint's roll center.

In the case of an extended or displaced (with respect to SSM in its free state) "non-tilting" GCM such as Rennex, the roll moment relief associated with GCM lower surface attainment of parallelism to treading surface comes only after the roll mode moment arm (as defined by the distance between loaded edge of GCM and loading line or "shin"), which works to turn the ankle, has been increased by virtue of the increased free state distance from GCM lower surface to the ankle joint.

At high values of lateral acceleration or treading surface slope, i.e. high lateral tilt angles of shin with respect to treading surface attitude, the non-tilting GCM lower surface extension height beyond that of a normal shoe represents increased risk of ankle turning injury. The roll moment initiated by sole edge offset from the shin must increase in magnitude, as the sole begins to "square up" with (or become parallel to) the treading surface, because the added height of the ankle, above the free-state extended GCM lower surface, causes the ankle to travel further laterally (away from the loading direction between knee and sole edge) as the GCM and foot pivot about the first-contacting edge of the GCM towards parallelism with the treading surface.

The present inventive introduction of a ground-level longitudinal pivot axis relieves the magnitude of the roll moment required to "square up" the GCM lower surface to the treading surface, by substituting, for the above-described increased ankle turning moment, a substantially lighter moment from the predetermined spring rate resilient urging of the GCM's roll attitude, toward parallel with plane of SSM, about its inventive ground level longitudinal pivot axis, the pivot allowing the ankle to experience a situation much closer to the nominally roll-neutral characteristics of in-line roller skates or ice skates. The predetermined roll mode spring rate of the GCM's pivot axis is preferably high enough to provide some support to counteract the "wobbly ankles" instability typical to the beginning stages of learning to ice skate, while remaining low enough to avoid the substantial risk of ankle turning roll moments posed by non-roll-pivoting prior art GCMs.

Further ankle joint protection for so-called "extreme" activities is provided as an optional construction for moderate travel embodiments of Full Suspension Footwear, but is fully integrated into extended travel embodiments for user safety. This inventive protection provides, in both cases, a substantially single degree of freedom transverse ankle pivot axis (hereafter "TAPA") adjacent, and substantially coincident with, the user's ankle joint's pitching mode pivot center, the TAPA being defined by bearing members fixedly associated with both the SSM and a shin brace member (hereafter "SBM") which, by connective association with the user's lower leg preferably just below the knee, resists or carries roll moment loadings due to ground contact. The TAPA bearing member's fixed relationship to the SSM assures, in conjunction with the SBM, the "laterality" of the TAPA, preventing its rotation or migration away from adjacency to, and axial coincidence with, the user's ankle joint. These ankle joint protecting embodiments assure that GCM extension travel remains laterally in line with the shin and so free from the increases in ankle-turning roll moment that extended GCM free-state displacements from SSM inevitably cause in non-tilt apparatus lacking such ankle stabilization.

In the context of such ankle stabilization where GCM lateral alignment with shin is assured, even absent roll mode pivoting of the GCM, the roll moment arm influencing the TAPA bearing members due to GCM edge loading remains essentially constant regardless of GCM extension magnitude with respect to SSM, being simply the GCM lower surface's edge offset distance from the shin axis. At high values of free-state GCM extension, this fixed moment arm value represents a diminishing portion of the moment loadings at the knee and hip joints associated with lateral motion control efforts: in this light the extended travel embodiments, with their integrated ankle protection, are safely provided without, as well as with, roll pivoting of GCM. Slight rounding of the GCM's lower surface in the non-pivoting case can provide load centralization laterally sufficient for even extreme use situations since the TAPA protects the ankle joint, and since the roll moment arm is not greater than that of the conventional shoe, even with a flat GCM lower surface of similar width.

In the above discourse, the Rennex (U.S. Pat. No. 6,684,531) configuration has been accorded functionality per apparent inventor intent, but in reality the so-called "P-diamond" therein disclosed lacks stability in the longitudinal direction and so is unsuitable for safe pedestrian use.

Accordingly, the inventive Full Suspension Footwear herein disclosed achieves advantages over, and avoids the limitations of, prior art mechanisms by providing:

A GCM whose motion or degree of freedom with respect to its associated SSM maintains substantial pitching mode parallelism for agility and control, with extension motion prescribed and precisely controlled to being substantially linear translation away from either the SSM, in direction normal to same, in the case of moderate travel embodiments[4], or the user's knee, in direction parallel to the shin, in the case of extended travel embodiments, with extension motion furthermore being urged resiliently to a free state location that provides for substantial compressive and rebound travel with respect to the user's ankle joint.

4 Having, for instance, GCM displacement travel capability on the order of ¼ the length of the user's foot.

The GCM is preferably capable of pivoting, or rolling, with respect to the SSM and with appropriate restoring torque, about a longitudinal axis located at or near its lower, ground-contacting surface[5], until it has reached the state of being oriented parallel to and in tractive contact with the ground.

5 And preferably laterally centralized with respect to said GCM's width or area.

The GCM preferably also has an articulating toe pressure member (hereafter "ATPM") at its front end to replicate the action of human toes pivoting about their metatarsal joints at the ball of the foot. The GCM ATPM preferably also is in substantially friction-free connectivity with an angularly mobile toe support member (hereafter "AMTSM") comprising a forward portion of the SSM such that substantial "parallelism" of angular attitude and motion is maintained between the ATPM and AMTSM for the transference of force and motion, i.e. so that an upward deflection of the GCM's ATPM pushes the SSM's AMTSM upward, and a downward toe force by the wearer is reflected as a similar downward force at the ATPM region of the GCM's sole.

An optional (in case of moderate travel embodiments) lateral, or roll mode, torque-resisting SBM having a TAPA bearing adjacent the wearer's ankle joint to allow for normal articulation of the ankle joint while bracing the SSM laterally with respect to the lower leg is provided. This lateral (or roll) torque-resisting SBM becomes increasingly important for operational safety in case of either aggressive sideways (or lateral) acceleration or longer-travel configurations or both.

In extended-travel embodiments, this torque-resisting SBM is utilized as an integral element of a travel apparatus which replaces motion substantially normal to the SSM's sole with motion substantially parallel to, and in the longitudinal direction of, the user's shin, for improved operational control. The shin-direction GCM motion becomes necessary for the configurations with extended travels because the normal-to-sole motion most practical for moderate travel capability embodiments would incur stability and control problems, in case of the large GCM offsets from the user's ankle joint that are necessarily associated with these extended travels, due to the necessarily large ankle articulation-based longitudinal displacements of the GCM with respect to the shin. Such a combination of large GCM extension with travel normal to the plane of the SSM would subject the ankle joint to abnormally high pitching mode moments, as the overly-large GCM displacement from ankle joint would represent a large moment arm about the ankle joint.

These and other features and advantages of the present invention will become apparent from the following description of the invention, when viewed in accordance with the accompanying drawings and appended claims.

BRIEF DESCRIPTION OF THE DRAWINGS

FIG. 13A is a cross-sectional view of an alternative shape ground contact member pivot apparatus of the FIG. 13 type embodiment of the present invention;

FIG. 13A.1 is a cross-sectional view of the ground contact member of FIG. 13A in a rotated orientation;

FIG. 15B.1 is a cross sectional detail of the FIG. 15B ground contact member and its elastomeric pivot bearing;

FIG. 15B.2 shows the FIG. 15B.1 ground contact member rotated 35 degrees on its elastomeric pivot bearing;

FIG. 15B.3 is a cross sectional detail of an alternative FIG. 15 elastomeric pivot bearing configuration;

FIG. 15B.4 shows the FIG. 15B.3 ground contact member rotated 35 degrees on its elastomeric pivot bearing;

FIG. 31 is a schematic side view illustration of an extended travel embodiment of the present invention having conjoined dual four-bar linkage parallelism control between shoe sole member and ground contact member in accordance with a preferred embodiment of the present invention;

FIG. 31B is a schematic cross-sectional illustration of a conjoined four-bar linkage pivot axis incorporating an elastomeric torsion spring for resilient urging of the ground contact member of the FIG. 31 apparatus;

BRIEF DESCRIPTION OF THE PREFERRED EMBODIMENTS

Figure 1:
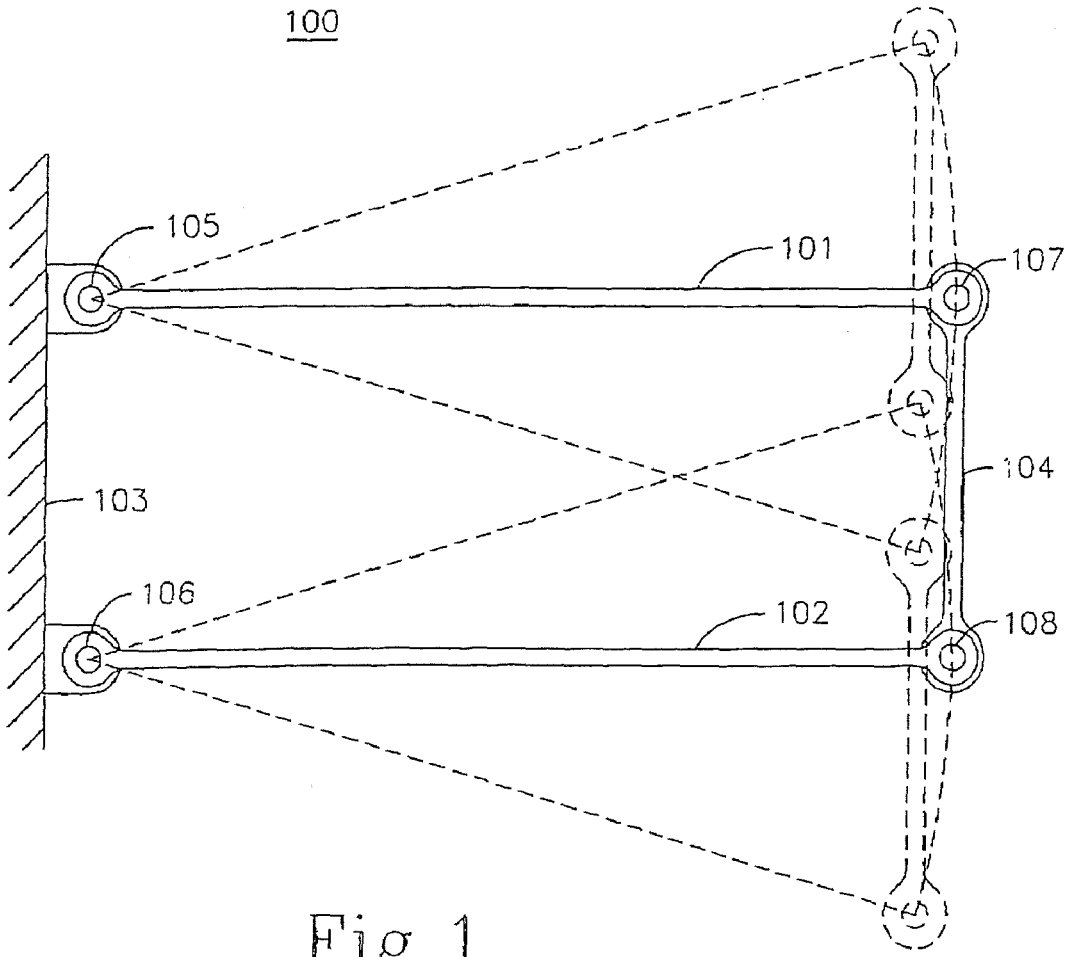
FIG. 1 is a schematic illustration of a single-plane parallelogram-type four-bar linkage motion control mechanism.

Various mechanisms may be employed to produce the inventive functionality of moderate travel Full Suspension Footwear, including miniaturization of apparatus preferred for extended travel functionality. In the interest of brevity, and given that the simplest means of achieving a given end is often the best, descriptions of apparatus for moderate travel functionality will be limited to two preferred-for-simplicity embodiments.

Four-bar linkages are well known in the art for maintaining precise control of a wide range of prescribed motions. The simplest four-bar linkage configuration, substantially a parallelogram configuration, is hereby disclosed in conjunction with shoe structures as perhaps the most practical mechanism for the extension-away-from-SSM motion, with parallelism to plane of SSM, needed for a moderate travel resiliently urged GCM to be effective in storing the energy of landing in such a way as to be useful for takeoff during forward travel. This substantial parallelism-to-sole is in the longitudinal sense, i.e. in the pitching mode, such that heel compression travel generally equals toe rebound travel. By the employment of differing length pivot links, however, the four-bar mechanism can prescribe a combination of translation and rotation that can, for example, give the toe end of the GCM somewhat greater vertical travel than that of the heel end, effectively changing their respective spring rates. In this given example, the heel strike phase of motion, with compressive force being applied at the heel end, would exhibit a stiffer spring rate than the toe end, whose rebound would exhibit a softer rate over its longer travel, at probable benefit to running efficiency.

At least two adjacent pivots of a four-bar linkage system must maintain axis alignment (parallelism) in order for the mechanism to constrain motion to a single plane, while ideally for stress distribution all four pivots would maintain axis alignment. In the present usage of a four-bar linkage (hereafter alternatively "FBL") to control the motion of a mobile GCM or assembly, it is required, for yaw control of the GCM, that the at least two adjacent pivots which maintain axis alignment share a common link between the SSM and the GCM. For the remainder of this document, all references to FBLs will be interpreted as meaning in-plane type FBLs, and all references to pivots will be considered to mean substantially rigid in terms of axis alignment control, and associated resistance to out-of-plane bending or twisting.

A preferred embodiment of the application of FBL technology to moderate extension travel Full Suspension Footwear is to have at least two pivots of a common link comprise elastomeric torsion bushings of high aspect ratio (i.e. large ratio of length to elastomer section thickness) which, besides eliminating the clearances, noise, and wear opportunities of conventional pivot bearings, can provide (on a distributed basis, again for ideal stress distribution) the restoring torques required for resilient travel action without need for additional spring mechanisms, while also providing some of the hysteretic motion damping required for substantial freedom from resonant vibrations of the structures being controlled. The function of the high aspect ratio feature of the elastomeric torsion bushings is to provide high stiffness to bending loads, and thus precise motion control, by resisting lateral (roll and yaw mode) deflections, or in other words, to act like rigid pivot bearings having axis alignment control capability.

The resultant pivot bearing functionality is superior, for the limited rotational travel requirements of this application, to conventional type pivot bearings in the composite of noise and vibration, wear resistance, and total mass, while lending itself to working with the tapered pivot pin configuration that mass-optimized pivot links dictate for improved uniformity of bending stress distribution. Round section torsion bushings are preferred for their nearly linear torsional spring rate (because torsional stresses are purely in shear), but alternative non-round sections (e.g. elliptical, wherein compressive stresses are introduced under torsion), may be employed to provide for rising rate functionality as may be desired for a specific application.

A preferred configuration FBL for moderate travel Full Suspension Footwear has transverse SSM pivots in a substantially vertical array in the metatarsal joint region, with the lower pivot just under, or imbedded in, the SSM and the upper pivot elevated above the metatarsal region, the two pivots being stiffly constrained in substantially fixed relationship to a foot-capturing shoe portion and to each other. Substantially horizontal pivot links extend longitudinally rearward to mobile frame member transverse pivots also in substantially vertical array and with fixed relationship to each other by virtue of being fixedly housed in the mobile frame member.

The mobile frame member extends downward from its transverse pivots to below the SSM's sole when the pivots are at their maximum upward limit of travel, to become, or be joined to, the GCM, extending forward in substantial parallelism to the SSM's sole. In this preferred configuration, however, the mobile frame member's horizontal portion is a forward extension, which serves as the structural support member of the pivot bearing for the roll mode degree of freedom that the GCM preferably provides. This longitudinal roll mode pivot is also preferably a high aspect ratio elastomeric torsion spring for quietness, wear freedom, motion control, and integration of torsional spring rate. This longitudinal pivot spring preferably comprises a cylindrical element cross-sectional shape for linearity of torsional spring rate, but may also employ non-cylindrical elastomeric sections for rising torsional rate at the discretion of the designer.

A non-rotating GCM relationship to the SSM is herein also disclosed, in conjunction with motion control apparatus differing from prior art, but this embodiment is not preferred because of the increased roll moment loading on the ankles that an increased-travel shoe device entails. Preferred for freedom from roll mode torque on the ankles is the application of force in line with the shin bones, as is the case with ice skates and roller blade (or in-line roller) skates. Accordingly, a near ground level longitudinal pivot axis is disclosed, to enable the GCM to "square up" with the ground surface without requiring the exaggerated lateral deflecting of the ankle (to being outside the line of loading), as is the problem with current art. This inventive advantage becomes increasingly important as lateral acceleration levels (from cornering loads or lateral movement) increase, or as ground surface slopes are encountered, or as extension travel is increased. Current art designs providing high degrees of resilient cushioning travel are not practical for most sports, which typically include the need for lateral agility. A light restoring torque on the disclosed roll mode pivoting GCM is desirable to maintain in-flight parallelism to the SSM's sole, and is again preferably provided by an elastomeric torsion spring (hereafter alternatively "ETS") for the previously cited advantages of light weight, quiet operation, freedom from wear, and optimum hysteretic motion damping.

The roll mode pivot axis is not required for GCMs which by nature pivot at the ground contact interface. Ice skate blades and "roller blades" or in-line roller skate wheels exemplify this special class of inherently ankle-protecting GCMs. It will be understood that the articulating toe pressure member or ATPM of a roller blade type GCM will comprise at least one forwardly-located roller that is vertically mobile with respect to the at least two rearward GCM rollers, while maintaining substantial axis alignment with them.

The two substantially horizontal longitudinal FBL pivot links can be configured to be two-sided, or closed-loop, structures to maximize stiffness for given pivot diameter and material properties, but this configuration violates the previously-stated design benefit of avoiding any inward protuberance. Consequently, a single-side link configuration is preferred, using tubular pivot links of sufficient bending stiffness as to assure appropriate pivot axis alignment. The pivot pins of these links are preferably tapered, for improved uniformity of the bending moment stresses they carry, from larger diameter, at their transition from transverse to longitudinal, to smaller diameter at their free (inner) ends, in order to provide the requisite high torsional and bending stiffnesses at minimum mass. This tapering can also aid the manufacturing assembly process of minimum mass embodiments, where the bonding of elastomeric bushing material directly to mobile frame member pivot housings and pivot link pivot pins can avoid the squeegee effect that would otherwise try to strip bonding cement from the preferably compressed section of a purely cylindrical bushing as it traveled to its final position, and it further avoids the residual assembly shear stresses within the elastomer, which would otherwise require overtravelling at assembly to only partially overcome. Cartridge type bushings, preferably mold bonded to thin wall sleeves prior to press-fit assembly to pivot housings and pivot link pins, would allow for interchangeable bushings in order to vary spring rate, at a modest penalty of increased mass. The thin wall sleeves preferably comprise fine-pitch splines to maximize the ratio of torque capacity (with respect to their mating components) to axial installation and retention forces. The cartridge type bushings may be retained securely seated to their (preferably) respective tapers by threaded fasteners for added joint integrity. The fasteners are preferably applied to the pivot pin's small end inside diameter and the pivot housing's large end outside diameter.

An optional FBL configuration, with the SSM's fixed pivot axes located in the heel area and the mobile frame member's pivot array located forward of the heel area is clearly also possible as means of providing the prescribed substantially vertical motion control and so is herein disclosed, but without preference, as this configuration tends to produce heel end spring rates softer than toe end by virtue of the elastic compliances of member components, a condition exacerbated by the slight radial deformations of the preferred high aspect ratio elastomeric pivot bushings themselves, where used.

Many alternative combinations of pivot bearings and restoring springs will be understood to be included in the FBL motion control mechanism herein disclosed in conjunction with a moderate travel SSM. As an example, a single torsion spring could be located at the above-metatarsal pivot, while the three other pivots could be simple axis alignment maintaining bushings, leaf spring type pivots or anti-friction bearings. In this case, the torsion spring can be an easily interchangeable cartridge-type unit that allows the spring rate to be changed for differing severity of use, or even for different users. The torsion spring is preferably elastomeric, for known energy storage advantages over other (e.g. steel hairpin) spring configurations, this advantage being true in comparison by individual characteristics such as mass, packaging space, and design efficiency of torque transmittal means, so certainly true in the composite sense, but alternative spring configurations, whether linear or torsional, will be understood to be included in the disclosed resiliently urged four-bar linkage concept.

Elastomeric torsion springs of many configurations are known, with mold bonded springs, especially, offering great design flexibility as required to accommodate packaging constraints. The most generally useful types are of axi-symmetric (i.e. with purely shear loading, absent compression loading, when under purely torsional displacement) configuration, wherein the elastomeric spring element is bounded by, and typically bonded to, high stiffness circular section torque transfer members which distribute the shearing loads to the elastomer section. The most common forms, cylindrical bushings, uniform numerical shear stress bushings, and disc types, have straightforward mathematical relationships between torsional shear strain, torsional shear stress, and torsional stiffness or spring rate.

Hybrid configuration elastomeric torsion springs, such as the generally L-shaped cross-sectional combination of disc-type and cylindrical bushing type sections are also commonly used, for example in mold-bonded torsional vibration dampers (or "TVDs") that are used on certain automotive and industrial internal combustion engine crankshafts to prevent fatigue failure. The disc sections of these hybrid springs are typically of the preferred "common vertex" construction that is well-known to have the durability advantage, especially in the special case of axial symmetry about a plane normal to the torsion axis, of substantially uniform torsional shear stress and strain throughout the elastomeric section. The cylindrical cross-section portion of these hybrid springs both adds to the spring's radial stiffness, and facilitates the molding process. The radiused "elbow" transition region between the common vertex disc spring section boundaries and the cylindrical section's axially oriented section boundaries is not so mathematically straightforward, engineering wise, but does represent an important-to-packageability class of the prior art which modern modeling techniques such as finite element analysis (or "FEA") can readily optimize.

In this present TVD example, the preferred, most straightforward, and most typical design practice is for the boundaries of the transition region to be formed by radii having tangency to the cylindrical section's boundaries at a common axial location, and then tangency to each, respectively, of the diverging disc face section boundaries. In so doing, these radii form gradual transition of elastomer section width and shape from parallel-sided in the cylindrical region, to tapered at the common vertex disc spring's divergence angle in the disc region, a configuration which, by avoiding stress concentrations due to excessive convexity of too-small a radius at the "inside" radius tangent to the outer boundary of the cylindrical section, can result in favorably uniform distribution of torsional shear stresses throughout the transition region, the convexity acting to increase the stresses adjacent the normally lowest-stress outer boundary of the cylindrical section, and the opposite boundary's concavity acting to decrease the stresses adjacent the normally highest-stress inner boundary of the cylindrical section, as is known by those of skill in the art.

Such cross-sectional transition regions of current art springs, or portions thereof, may be used with various proportionalities to the packaging advantage of reduced pivot link length, and thus reduced torsional spring rate requirements, by facilitating the "necking down" of spring diameter in order to provide operating clearance in the heel bulge and instep crown regions of Full Suspension Footwear FBL pivot locations, while retaining the spring rate advantage inherent to larger diameter regions. In cases where only portions of such transition regions are utilized, i.e. less than a full 90 degree turn, it is preferable to approximate, by choice of elastomer section free end configuration, the uniform numerical stress configurations known in the art wherein the free end configuration of elastomer section assumes the appropriate orientation that, depending on extent of portion utilized, changes from substantially axial at and beyond the "vertical"[6] disc tangency portion of the corner, to substantially that of the "uniform numerical stress" contour known to be ideal for purely cylindrical sections, and preferably also inclusive of the large bond line stress reduction fillets which are known in the art to be beneficial to flex life.

6 In the case of horizontal orientation of torsion axis.

The back-to-back union, at the cylindrical bushing ends of similar but mirrored transition corners to form outwardly concave, or "U-shaped" spring sections will be recognized to be obvious utilization of these known prior art configurations, whether or not inclusive of substantial length of purely cylindrical section, and whether contiguous or separated axially at the mirroring plane.

The second preferred-for-simplicity moderate travel embodiment is apparatus using at least one linear bearing (or plunger) structure having substantially normal-to-plane-of-SSM travel orientation, preferably located in the metatarsal region for freedom from packaging space interference with ankle mobility, which by design is able to constrain motion to a single degree of freedom, i.e. substantially without pitch (unless by design for heel vs. toe rate differential as discussed above), yaw or roll rotation with respect to the normal-to-plane-of-SSM direction of linear motion. Two plungers of cylindrical type (which individually would permit yaw rotation) suffice this motion control, and are packageable in array either beside the metatarsals on the outside of the foot or on both sides of the foot; in order to fulfill the "no inward protuberances" benefit in the latter case of both sides of foot packaging, the innermost plunger would preferably be located in the region just above the "big toe" metatarsal joint. As a preferred alternative to the twin plungers for yaw control, a single yaw rotation-prohibiting plunger may be employed, in this case preferably located in the outer metatarsal region having outboard (i.e. around the little toe metatarsal region of the SSM) connectivity to the GCM, or roll pivoting GCM assembly, below the SSM. Such rotation-prohibiting linear bearing mechanisms are known, e.g., the so-called Head Shok front suspension of the popular Cannondale mountain bike line, in which a single unitized front fork translates on anti-friction needle roller bearings within, and without rotation with respect to, a handlebar-controlled portion of the steerer tube. An apparatus for controlling motion to substantially linear translation, with substantial freedom from yaw, pitch or roll rotation, will herein and hereafter be referred to as a linear bearing member assembly, or "LBMA", and will be understood to be capable of being employed singly alone, with as-defined functional property of the ability to maintain substantial freedom from yaw rotation of extension member.

The LBMA in the present instance of moderate travel Full Suspension Footwear would have travel direction preferably leaned very slightly forward (from normal to plane of SSM) to effectively stiffen the compressive spring rate experienced by heel strike while softening that of toe-off slightly, for probable kinematic advantage to a runner. A preferable means of resilience for such LBMA architecture is the use of so-called wave springs, which offer packaging density and mass penalty advantages over coil springs, but hairpin springs can also serve at reduced mass penalty. Gas springs may be chosen in case the broader usage applicability of rising rate springs were to be prioritized over the generally gentler linear rate case, and elastomeric tension springs deserve consideration for their composite of design characteristics as well. Elastomeric tension springs including externally-accessible rubber bands or surgical tubing segments are useful to facilitate ease of spring rate adjustment, but suffer increased vulnerability to environmental hazards including ozone cracking.

In any case of GCM motion control mechanism it is desirable to "preload" the resilient urging, by means of a travel limiting mechanism such as at minimum a flexible tensile member and/or an elastomeric bumper stop, so that working extension travel is minimally wasted on the need to reach static equilibrium with gravity. Travel limitation including "shock absorption", such as is known, combining viscous rebound motion damping in conjunction with resilient urging back towards free-state location, is preferably employed to enable the otherwise abrupt deceleration[7] at the end of toe-off to be less noticeable by virtue of more effective travel limitation cushioning. The entire "airborne" foot travel time between toe-off and heel strike is available for the process of slowing and returning, after overtravel, the GCM to a predetermined free-state extension magnitude: the more of this time period that is used for GCM free-state location stabilization, the less abrupt and distractive the toe-off acceleration[8] of GCM to following the departing SSM will be. Preferred, therefore, for controlling GCM mass at toe-off is a travel limiting apparatus with soft enough spring rate to allow transient overtravel of GCM to extension values beyond its free-state equilibrium location, and viscous "rebound damping", preferably in the return direction only, of magnitude near critical to manage the return travel (between overtravel and free-state locations) as gradually as possible while assuring completion within the characteristic "airborne" phase of a runner's stride, and substantial freedom from resonant behavior.

7 With respect to SSM as it abruptly departs from treading surface contact.

8 From at-rest in contact with treading surface, or deceleration with respect to "departing" SSM.

A key element of forward motion control and efficiency engineered into the foot of the human body is the action of the toes, as hinged about their joints with the metatarsals in the ball of the foot and urged by muscle structures. Principal loads are carried by the bail of the foot during the running stride, but balance and forward impetus both receive key contributions from toe loading and articulation flexibility, with the so-called windlass mechanism engineered into the foot's structure acting to brace the arch for effective transference of calf contraction into metatarsal downward urging. Additionally, the toe region becomes the principal ground contact area and source of balance in the climbing of steep slopes, so high performance footwear must preserve this key toe articulation functionality.

The angular deflectability of the SSM's AMTSM preferably parallels that of the user's foot, by having effective pivot axis in proximity to that of the toes in order to avoid chafing or shearing stresses at the shoe-to-foot interface. The angular deflectability of the GCM's ATPM may, like that of the SSM's AMTSM, be by means of any form of hinge or pivot, including the bending of thin cross-section materials in leaf spring fashion. Preferred for purposes of this disclosure is a piano-type (i.e. full width) ATPM hinge comprising elastomeric bushings that share a common axle in order to possess inherent restoring torque, as well as the other elastomeric torsion bushing advantages cited previously.

Apparatus for converting the angular motion of the GCM's ATPM into a form readily transferred to the SSM's AMTSM, and nearly friction-free conveyance of this motion to be converted into angular deformation of the SSM's AMTSM is also herein disclosed. Numerous mechanisms can achieve this disclosed functionality, e.g. a cable with an end anchored in the GCM's ATPM and which passes below its pivot axis by riding on ATPM pivot housing surfaces that perform the function of a pulley, i.e. to maintain the cable at a radially displaced distance from the pivot axis, so as to transform ATPM rotation into cable axial translation. The cable's axial translation direction is then reversed, substantially free from friction, by a reverser pulley member pivoting about a "knife edge" or equivalent low friction rocker bearing at the rear of the mobile frame member, to then continue forward to engage a pulley-like hinge housing member of the SSM's AMTSM that maintains the cable at radial displacement above the pivot axis of the AMTSM, and to finally be anchored in the SSM's AMTSM itself. The drive ratio of the thus-configured three pulley motion transfer mechanism can be varied by changing the location of the reverser pulley member's pivot with respect to the cable runs, even to the extent of being made continuously variable by choice of pulley groove contour.

Alternative motion control mechanisms include flexible coiled compression sheath control cables at friction penalty, but with packageability benefits.

It is understood that axially stiff tension members (or cables) and pullies represent special cases of FBLs, being interchangeable functionally whenever a link (or bar) can be configured so as to be subjected to only tension.

Dual conjoined FBLs (or CFBLs, as further detailed later), may be utilized adjacent the (substantially horizontal) longitudinal pivot links for ATPM/AMTSM parallelism control while accommodating GCM/ATPM assembly roll mode pivoting, by attaching the substantially vertical lower terminal link to the ATPM with a flexible coupling that, like a Cardin (or "Universal") joint, provides angular or torsional stiffness in the plane of the CFBL while accommodating angular flex or misalignment in a plane normal to the GCM roll axis.

The open space between SSM sole and GCM represents both challenge and opportunity. A challenge to avoid encroachment of foreign objects such as stones from the "mastication space" between soles is preferably addressed by a resilient mesh curtain being sealingly arrayed around the periphery of the soles. The opportunity to increase wearer comfort by ventilation of the SSM's sole is embraced by providing sole member perforations in communication with the open space and is disclosed in combination with other Full Suspension Footwear inventive elements. Further, independently claimed sole cooling structures, in combination with the Full Suspension Footwear inventive elements, but also useful for sport shoes of other types such as cycling, include longitudinally oriented air guide channels, such as might be formed by aluminum extrusion, in and/or as part of the sole member, in conjunction with sole member perforations to enable pumping/breathing action with foot motion, to conduct air through the sole perforations for moisture transfer and convective/evaporative cooling in addition to the conductive cooling benefits of a high thermal conductivity material such as aluminum being utilized to comprise the air cooling channels. These longitudinally oriented air guide channels preferably provide air through-flow capability by means of being flowingly connected with open areas at both of their ends.

The disclosed preferably configured moderate travel Full Suspension Footwear, having both toe articulation functionality and ice skate-like roll mode pivoting of GCM will be understood to be capable of easily negotiating steep, off camber slopes (such as climbing diagonally across a highly sloped surface such as a roof) without either loss of balance, or requirement for awkward unnatural angulations of ankle joints, a clear operational advantage over previously-disclosed current art. Construction from lightweight high strength materials such as carbon fiber promises, in conjunction with the inherently low mass of high aspect ratio elastomeric torsion bushings, to result in high performance Full Suspension Footwear having minimally more mass than the best of current-art running shoes.

The two preferred-for-simplicity embodiments disclosed for the maintenance of prescribed inventive moderate travel embodiment GCM motion with respect to SSM, namely FBLs and non-rotating linear bearings, certainly do not exhaust the large variety of mechanisms capable of producing precisely controlled, substantially linear, single degree of freedom travel. It will be understood that the disclosed inventive functionality and methodology is not limited to the disclosed preferred-for-simplicity apparatus only, but that any apparatus that fulfills the defined functionality as claimed is included within the scope of the present disclosure. In addition, reduced functionalities, e.g. translation normal to plane of SSM without roll mode GCM pivoting, and/or without metatarsal articulation, are included within the scope of the present disclosure to the extent not already represented by specific prior art structures, e.g. Rennex.

Increased performance, i.e. action even more like that of an unbounded trampoline, involves GCM travel increase to avoid, to the extent possible, increased peak compression loads on the leg structures and/or to increase the elevation of the user's center of gravity for increase in "airtime" and potential stride length. In case of these extended travel GCMs, a point is reached where the previously-disclosed direction of extension travel, substantially normal to the SSM, becomes so awkward because of the effect of ankle articulation on fore-aft location of the GCM, that it becomes disadvantaged in comparison with parallel to shin extension travel that still provides for the GCM pitching mode parallelism to SSM as is clearly needed for control and peak performance.

Such inventive extended travel Full Suspension Footwear functionality (i.e. having parallel-to-shin extension travel with resilient urging, concurrent with GCM parallelism to SSM), may be achieved by numerous structural embodiments having, in common, A.) the previously-disclosed anti-rotation LBMA linear extension apparatus fixedly associated with (lower leg and SSM-stabilized) SBM, and B.) the previously-disclosed ankle joint roll mode stability in conjunction with SSM pitching mode mobility, via TAPA substantially coincident with that of the ankle joint. Four preferred embodiments will be briefly described, but it will be understood that the disclosed inventive functionality and methodology is not limited to the disclosed apparatus only, but that any apparatus which fulfills the defined functionality as claimed is included within the scope of the present disclosure.

These four principally-preferred arrangements for achieving the inventive extended travel functionality are briefly described and disclosed as follows:

(1) LBMA-guided extension member-mounted GCM with conjugate four-bar linkages (CFBLs) for resilient urging and pitching mode parallelism control;

(2) LBMA-guided extension member-mounted GCM with triple CFBLs for longitudinally compact resilient urging and pitching mode parallelism control;

(3) Conjugate CFBLs for LBMA extension functionality, with parallel (CFBL-based) pitching mode parallelism control; and (4) LBMA-guided extension member-mounted GCM with conjugate reel springs having rocker pulley member motion transfer for resilient urging and pitching mode parallelism control;

all of which preferably utilize elastomeric torsion springs, but whose resilient urging characteristics may alternatively be provided by, or supplemented by, other springs known in the art including gas compression springs.

Also herein disclosed are transitional apparatus and method, having GCM extension directions between those of the above-disclosed moderate travel and extended travel embodiments, namely where GCM extension directions are continuously variable with ankle articulation, but at lesser angular amplitudes than those of the foot and SSM with respect to the shin. These continuously-variable directions are essentially "weighted averages"[9] of previously-disclosed travel directions: A) normal to plane of SSM, which direction depends upon ankle articulation attitude with respect to shin, and B) parallel to shin The transitional extension directions apparatus and method are not preferred because of the additional complexity involved in their execution, but are disclosed for the purpose of demonstrating the uninterrupted continuity of relationship between the distinct functionalities defined for the preferred, for their relatively simpler architectures, moderate and extended travel embodiments.

9 With weighting being predetermined by structural proportions.

A preferred embodiment for this non-preferred transitional extension direction functionality utilizes an extension travel direction-defining link (or "ETDDL") between bearing members having lateral pivot axes that are fixedly associated with, respectively, the SBM and the SSM. The lower SSM-mounted pivot axis of the ETDDL is located below the SSM's TAPA such that the pitching mode angular attitude of the ETDDL changes in response to ankle articulation, in the same rotational direction but with lesser angular magnitude.

Means are required for dealing with the geometric distance variations inherent in this "triangle" of pivot axes, as the angular relationship between its two shorter sides varies: preferred among the numerous possible alternatives is the employment of a short longitudinal anchor link (which adds an additional preferably rigidly transverse pivot axis with associated bearing members) between the SSM's below-TAPA pivot axis bearing members and the bottom of the ETDDL. This location, with anchor link angular orientation preferably perpendicular to the ETDDL when the plane of the SSM is perpendicular to the shin, minimizes the magnitudes of pitching mode moments about the TAPA which are applied to the SSM by compressive resilient extension member loading when the ETDDL departs from parallelism to the shin.

The extent to which the ETDDL mimics the behavior of either of the defined preferred inventive functionalities (moderate travel and extended travel embodiments) is dependent upon the proximity of ETDDL pivots to the TAPA, and can be varied between zero and 100% of either by this relative location. Whereas a weighted average of the two distinct extension directions inventively defined as preferred embodiments is produced by the lower ETDDL pivot of the as-defined transitional extension directions apparatus being a distance below the TAPA, moderate travel embodiment functionality is 100% replicated when the upper ETDDL pivot is coincident with, or zero elevation above, the TAPA, and extended travel embodiment functionality is 100% replicated when the lower ETDDL pivot is coincident with, or zero elevation below, the TAPA. Enforced division into two differing species is therefore considered inappropriate for preferred inventive functionalities that can be replicated by a single embodiment by the selection of a single parameter, namely ETDDL elevation relative to TAPA.

Now turning to the first of four principally-preferred extended travel embodiments, namely LBMA-guided extension member-mounted GCM with CFBLs for resilient urging and pitching mode parallelism control: adjacent or overlapping FBLs which share a common, or conjoining, link are known for the motion control characteristic of motion or attitude transference between non-adjacent opposing links. In the special case of parallelogram-type linkages operating in parallel or coincident planes, this transference maintains parallelism between opposite links of the same parallelogram. That is, when a FBL such as has been defined earlier, having substantially vertical links connected in substantially parallelogram array by substantially longitudinal links, the vertical[10] links are maintained parallel to one another at all longitudinal link orientations.

10 For brevity of further discussion with respect to link orientation and identification within a substantially parallelogram four-bar linkage array, the term "vertical" will be substituted for, and taken to mean, "substantially vertical" by way of identifying links in said array, and the term "longitudinal" will be substituted for, and taken to mean, "substantially longitudinal". Further, "parallelogram" and "parallelism" will mean "substantially parallelogram" and substantial parallelism", etc. respectively: certain design objectives may favor the other than exactly 1:1 ratio angular transferences of unequal link configurations, as discussed previously.

Conjoined parallelogram FBLs, which share a common vertical link between them, can under appropriate conditions maintain parallelism between vertical terminal links that translate with respect to one another over a relatively wide range of distance from one another. This functionality, and the stiffness with which such a CFBL can readily relate migrating terminal links, is appropriate for maintaining parallelism of GCM with SSM over a wide range of extension travel. These appropriate conditions include having conjoining link pivot axis spacings of the individual FBLs' longitudinal links arrayed with substantially coincident midpoints to avoid imposing longitudinal translation upon terminal link rotation. This midpoint coincidence happens naturally when the opposing adjacent links of the separate FBLs share common pivot axes as is inherent to the employment of elastomeric torsion spring pivots for contribution to resilient urging. Attaching the vertical terminal links to SSM and GCM respectively, or integrating them into either, thus provides for the requisite pitching mode parallelism control between SSM and GCM as the GCM translates away from the SSM. Such a linkage arrangement for controlling angular attitude or parallelism between pivoting members which are free to translate towards and away from one another will be hereafter alternately termed a "Conjoined Four-Bar Linkage", or "CFBL". The CFBL structure provides opportunity for integration of resilient urging, preferably by incorporation of elastomeric torsion springs to resist collapsing of the linkage from an expanded free-state configuration.

The dual array CFBL just described is spatially stable, with the "flown" conjoining link being located without degree of freedom by its fixed length longitudinal links, which are in turn located by the LBMA-related SSM and GCM which comprise the CFBL's vertical terminal links.

A mobile extension member whose motion is LBMA-constrained to anti-rotating linear motion (or substantially linear, in case of advantage by means of slightly arcuate motion), carries its own transverse axis pivot bearing at its lower end, which in turn mounts a GCM assembly that, by pivoting on the extension member lower bearing, is able to follow the motions of, by remaining in substantially parallel relationship to, the SSM as it pivots with ankle articulation.

A preferred embodiment of the anti-rotational LBMA concept for the extended travel embodiment is a preferably extruded tube extension member having football-shaped cross section that transitions smoothly between opposing square corners which are preferably captured by two layers of low inertia, compliant-surfaced rollers comprising small anti friction bearings, each layer comprising a four-roller array that, by engaging the extension member in the vicinity of its opposing square corners with pure rolling contact (i.e. wherein the roller's axis of rotation is parallel to the engaged surface of the extension member and normal to its travel direction), provides strong anti-rotation rigidity concurrent with highly rigid, quiet, minimal friction translational motion in the parallel-to-shin direction by virtue of rigid connection of the two roller array layers to the SBM, the lower array layer as close as practicable to the SSM TAPA bearing in order to provide, in turn, as close as possible support to the GCM's pivot bearing, for reasons of structural rigidity and stress control.

The GCM of extended travel embodiment Full Suspension Footwear is resiliently urged downwardly away from the SSM in a direction substantially parallel to the shin, while being constrained to pitching mode parallelism to the SSM, in order to provide the balance control and performance benefits of ankle joint mobility without overpowering the ankle joint by adverse lateral roll moments from the increased (compared with lesser travels) GCM displacements with respect to SSM, as would be risked by extending the travel of the GCM in a direction normal to the SSM to an excessive amount. This freedom from ankle moment loading, at a cost of the architectural complexity of the extended travel SSM embodiment, is preferably used for travels which are greater than one third the length of the wearer's foot.

The second principally-preferred extended travel embodiment, LBMA-guided extension member-mounted GCM with triple CFBLs for longitudinally compact resilient urging and pitching mode parallelism control, shares the preferred LBMA extension member concept with the first embodiment described immediately above. Its parallelism control between SSM and GCM is also similar, except that in place of the above dual array CFBL, a more longitudinally compact "Z-like" triple array with angular symmetry of longitudinal links, with respect to extension travel direction, is substituted. The triple array of three conjoined FBLs includes two conjoining links to impose angular orientation control between terminal links. The middle of the three FBLs is preferably nearly twice as long longitudinally as the preferably similar outermost FBLs, such that the terminal links overlap at the center of longitudinal length when the array is vertically most compact. The middle FBL, when located only by the conjoining links of adjacent FBLs, is spatially unstable, not being of determined "flown" location as was the case of the conjoined dual FBL array, so for spatial stability of the entire array needs longitudinal location constraint. This longitudinal location constraint is preferably applied to the middle FBL, at the midpoint of a line between midpoints of the two conjoining links' pivot axis spacings, by means of an apparatus such as a pivotable "slider" bearing in substantially shin direction translational communication with a structure which can provide longitudinal location stability, the extension member for example. This longitudinal constraint needs to enable pivoting or rotation in order to accommodate the angular attitude changes of the middle FBL's longitudinal links during vertical or shin-wise expansion and contraction of the Z-like triple CFBL array. It needs to substantially translate in shin direction in order to accommodate the vertical or shin direction location changes of these links' midpoint that occur with extension member and GCM travel with respect to SSM. As in the case of the first principally-preferred extended travel embodiment, the vertical terminal links of the CFBL's "outermost" FBLs are located by their attachment to, or integration with, the LBMA-related SSM and GCM.

The third principally-preferred extended travel embodiment comprises conjugate CFBLs for LBMA extension functionality, with parallel (CFBL-based) pitching mode parallelism control.

A conjoined pair of FBLs of similar proportions can maintain co-linearity of terminal link relative motion at all separation distances, thus providing the longitudinal stability needed for anti-friction LBMA functionality, if conjugate motion is maintained between either pair of angularly opposed longitudinal links extending from separate conjoining link pivot axes, (hereafter "AOLLs"), the conjugacy being with respect to the plane of the pivot axes as if these angularly opposed separately pivoted links were "geared together" for mirrored angularity with respect to the plane of their pivots. The conjugacy constraint may indeed be imposed by means of gearing, or by alternative means of simulating non-slip rolling contact such as flexible linearly stiff tensile members such as cables or ribbons (hereafter "cables") connecting features of substantially constant radii (hereafter "FOSCR") which are fixedly associated with the AOLLs, respectively, the cables crossing one another at the plane of pivot axes from wrapping around one of the FOSCR to wrapping around the other, in non-slip tensile fashion. Alternate means of imposing the conjugacy of CFBL AOLLs as needed for LBMA functionality include, for limited angular travel situations, at least one longitudinally rigid conjugacy link connecting bearing members having pivot axes (which are parallel to AOLL pivot axes) which are anchored in opposing AOLL members, simulating the functionality of crossing cables with a kinematically similar linkage.

Since the conjugacy constraint stabilizes the CFBLs longitudinally, the LBMA-simulating co-linearity of terminal link relative motion may be obtained with either conjoined dual FBLs or conjoined triple FBLs. Even higher order CFBLs theoretically provide the same linear motion control if constrained to conjugacy between AOLLs, but the real-world rigidity of the co-linearity control is subject to the effective rigidities of both pivot bearing members and links, so degraded stability can be expected from increasing orders. An LBMA functionality-providing conjugate CFBL will hereafter be abbreviated as "CCFBL", whether it is of dual, triple, or higher order CFBL construction.

In this CCFBL as LMBA apparatus, GCM parallelism to SSM must be controlled by means other than the LBMA-simulating CCFBL itself, whose terminal links are substantially constrained from allowing either longitudinal translation or pitching mode rotation. The preferred-for-simplicity parallelism control means is a parallelism control CFBL that parallels the LBMA-simulating CCFBL's longitudinal links, and adopts either the upper or lower chain of longitudinal links of the parallel CCFBL's array as sufficing to comprising "half" of the longitudinal links required by the parallelism-controlling CFBL, thus sharing vertical conjoining control link pivot axes with them, wherein the vertical conjoining control links operate independently, angular attitude-wise, of the CCFBL's vertical conjoining links except for the sharing of common pivot locations.

The fourth and last-defined principally-preferred extended travel Full Suspension Footwear embodiment comprises an LBMA-guided extension member which mounts the GCM via transverse pivot axis bearing members as defined previously, with both GCM pitching mode parallelism control and resilient urging with respect to SSM provided by a conjugate-reel springs-with-rocker-pulley member (or "CR/RPM") motion transfer apparatus, including flexible tensile members, or cables, connecting the reel springs to the rocker pulley member, and either cables or links connecting the rocker pulley member to the GCM.

This CR/RPM motion transfer apparatus is defined as an arrangement of:

Paired and conjugately-coupled (or "geared together") torsionally urged pullies (or "reel springs") having respective pivot bearings that are connected structurally to the SSM, so as to maintain pitching mode congruency with it, Two linearly stiff flexible tensile members (or "reel spring cables") that are wrapped in non-slip fashion under each reel spring respectively to depart tangentially upwards, toward fixed or non-slip tensile association with;

A rocker arm, or at least one pulley, or a structure that combines both functionalities (hereafter "rocker pulley member" or "RPM"), that is pivotably (i.e. rotationally) mounted, via bearing members establishing a preferably transverse pivot axis, adjacent the upper end of the extension member in fixed center distance relationship to the GCM pivot bearing members below; and two cables or linkage members (hereafter "GCM control links") extending from the rocker pulley member (RPM) to appropriately separated attachment locations on the GCM.

The coupled reel springs maintain length equality between the reel spring cables that are played out, under resilient tension from the reel springs' restoring torques, upwardly to connect to the RPM at the top of the extension member. Non-slip connectivity of these reel spring cables to longitudinally opposing ends of the RPM, from which also emanate the substantially fixed-length GCM control links, assures that the pitching mode attitude and motion imparted to the SSM by the foot are transferred by the coupled reel springs and the reel spring cables to the RPM, and by the GCM control links to the GCM, so as to maintain parallelism between it and the SSM at all resilient extensibilities of the extension member and GCM with respect to the SSM.

The reel springs of this embodiment are preferably comprised of elastomeric torsion springs, for the mass and energy storage advantages cited previously. The large angular windup capacity required of the reel springs suggests that they be preferably of uniform torsional shear stress configuration, with axial elastomer section widths narrowing inversely with the square of radius as is known in the art. The relatively "tall", radially, elastomer section of such a high windup configuration lacks the radial load carrying capacity of radially compact section bushings such as those preferred for previously-defined FBLs, so must, in order to provide pulley functionally for reel spring cable payout location stability, either be of multiple interleaf construction, for dimensional stability under tangential cable loads, or else have pulley structures "in parallel", i.e. to allow rotation via single degree-of-freedom bearing means, while providing radial and lateral stiffness to assure location stability of the rim section as required by defined functionality. This defined functionality, in addition to reel spring cable payout location stability, includes the gearing, or coupling, together of the two reel springs in a tangency or closest proximity area such that they are substantially prevented from slippage or transmission error relative to each other so as to assure mirrored rotation.

The conjugate coupling functionality is preferably provided by crossed reel spring cables which are secured and wrapped in non-slip fashion around both pullies in both directions to constrain circumferential travel of one to the other in both directions, for the "toothless gear" functionality of non-slip rolling contact between two cylinders or discs. Outside surfaces of the reel springs preferably touch in rolling contact to assist in carrying the inwardly radial loading of the crossed reel spring cables. The outside surface of each reel spring is preferably cushioned, for silence of contact and rotation, by an elastomeric cushion ring of rounded conic outer "diameter", so as to offer slightly crowned rolling contact area with its mating reel spring that will assure sufficient durability under service. The conic outer surface maximizes rolling contact area despite the axes and the planes of the reel springs being preferably skewed such that the planes of the reel springs are folded with respect to one another about a substantially vertical intersection line for packaging space conservation and reel spring cable payout location optimization.

This preferred crossed cables configuration for the conjugate coupling of the reel springs in their tangency/proximity area may alternatively be either combined with, or replaced by, meshing gear teeth at penalty to operational quietness. The conjugacy of the reel springs' outer rim members combines with their radial stiffnesses to cause the reel spring cables paid out to the RPM to reflect the pitching mode attitude of their (the reel springs) central axis bearing members, which are preferably attached directly to the SSM.

At all extents of cable payout, the effective lengths of the reel spring cables differ by the same amount as they would if reel spring rotation were to be prohibited, thereby accurately conveying SSM pitching mode attitude and motion into RPM attitude and motion. GCM attitude and motion are maintained to staying parallel with SSM as conveyed by the GCM control links from the RPM. These GCM control links either comprise CFBLs, with parallelogram proportionalities between pivots, or else act like pullies, with constant radii at payout points and cables engaging (or wrapping around) the constant radii. The pulley type payout region option offers advantages of reduced mass and inertia in that the RPM can substitute angular travel for radius, for structural compactness advantage, in the case where the GCM control links comprise cables. A corollary advantage of this approach is that the inward slanting of the reel spring and GCM control cables towards the RPM moves their payout regions upward in the case of the GCM, increasing ground clearance in the real-world conditions of heel strike and toe-off angularity of GCM to treading surface. It is necessary, for maintenance of FBL-like geometry as pitching mode attitude of the SSM is varied, that the engagement radii of the RPM about its pivot axis reflect the proportionality of reel spring payout radii about the TAPA, and that GCM control link engagement radii similarly reflect this proportionality, thus also reflecting the mechanical advantages (or leverages) engineered into the foot itself.

Examples of inventive Full Suspension Footwear elements are shown in the drawings; it is to be understood that not all useful permutations of these elements are illustrated, and that these drawings are merely illustrative of concept, not to be interpreted as limiting in scope. Moreover, while various illustrations are shown, it will be understood that the various components of the disclosed motion control apparatus can be interchanged or combined as desired to suit the specifics of an application or situation.

In schematic illustration FIG. 1, parallelogram type four-bar linkage (FBL) 100 is illustrated. Substantially horizontal, equal length, parallel rigid links 101 and 102 connect to a substantially vertical array of pivot bearings 105 and 106, which are held in fixed relationship by the anchoring frame 103. The pivots 107 and 108, which are held in fixed relationship to one another by the substantially vertical mobile link 104, locate the other ends of the links 101 and 102. The rotation of the links 101 and 102 about the pivots 105 and 106 is allowed by the single degree of freedom, angular mobility, inherent to the pivot bearings that locate them. Such rotation carries the vertically mobile link 104 in an arcuate path, but the equal length geometry of the parallelogram linkage maintains strict parallelism between vertically mobile link 104 and a line connecting the centers of the pivots 105 and 106.

Figure 2:
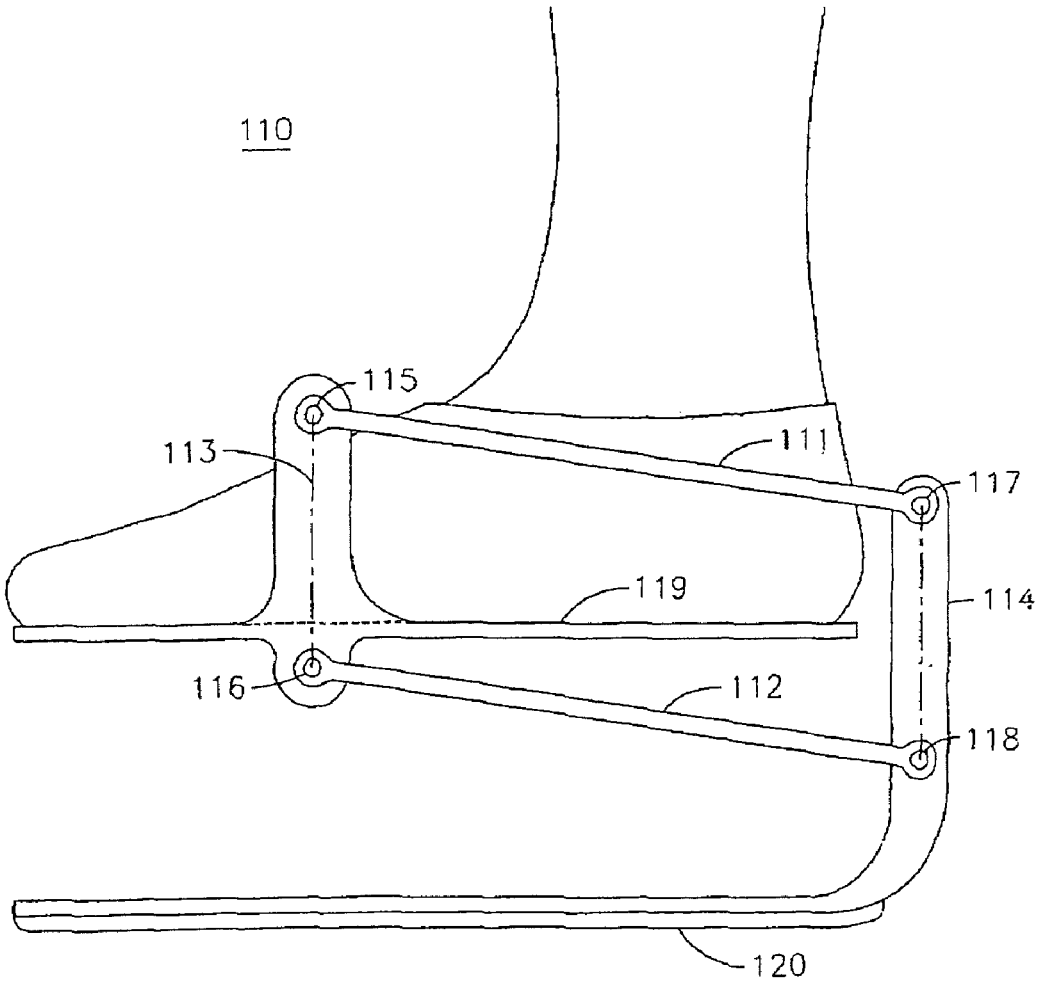
FIG. 2 is a schematic illustration of a single-plane parallelogram-type four-bar linkage adapted for motion control of the extended-position ground contact member of an embodiment of the present invention.

In schematic illustration FIG. 2, such an in-plane parallelogram type four-bar linkage 110 is applied to provide precise motion control to the relationship between the shoe sole member (SSM) 119 and the ground contact member (GCM) 120 of inventive Full Suspension Footwear in accordance with a preferred embodiment. Substantially horizontal links 111 and 112 compare with the counterpart links 101 and 102 of FIG. 1, while the pivots 115, 116, 117, and 118 similarly correspond to the pivots 105, 106, 107, and 108 of this figure. The vertical anchoring link 113 holds the pivots 115 and 116 in fixed relationship with the shoe sole member 119, and the vertically mobile link 114 locates the GCM 120 such that it maintains pitching mode parallelism with the SSM 119. The GCM 120 is shown in an extended positional relationship with respect to the SSM 119.

Figure 3:
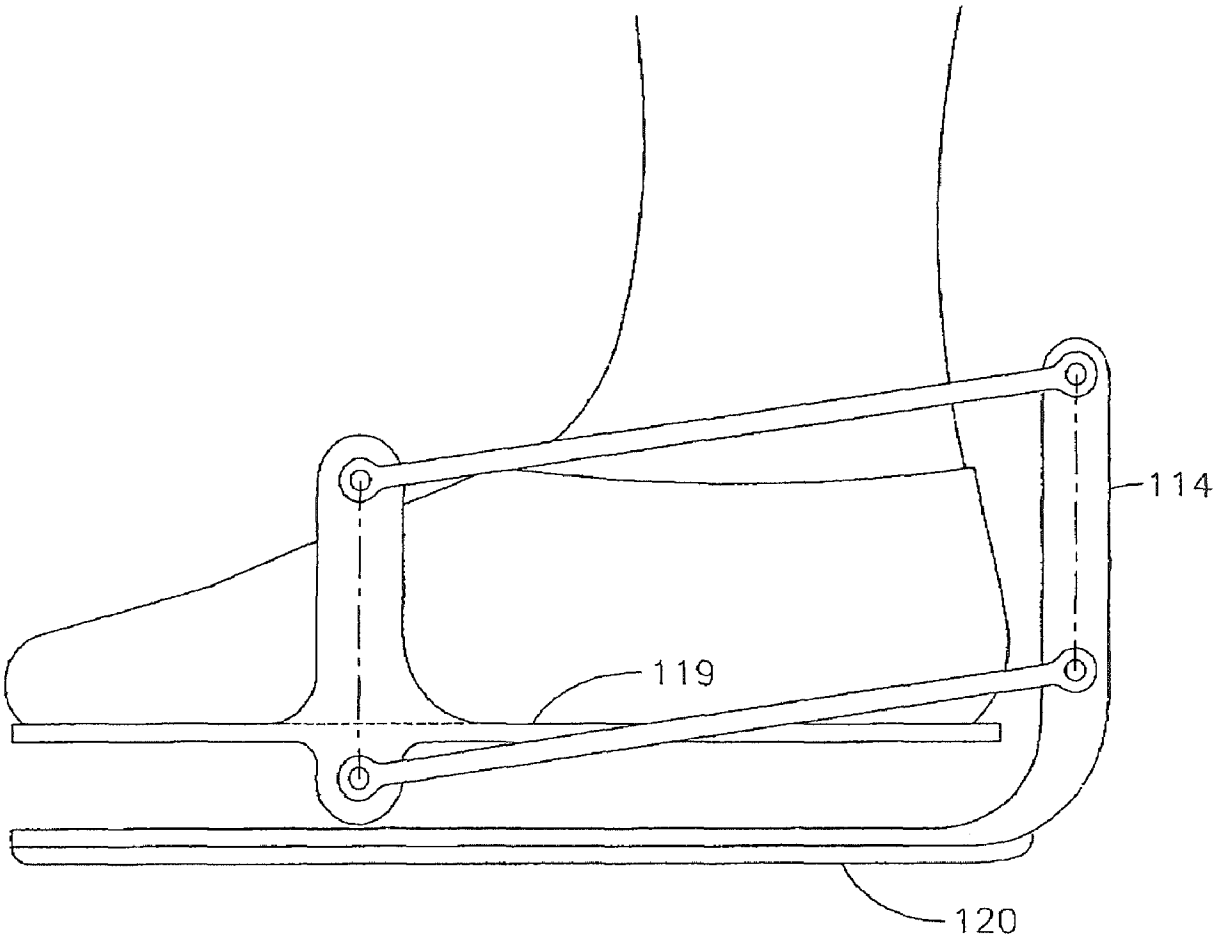
FIG. 3 is a schematic illustration of the apparatus of FIG. 2, with ground contact member in a fully-retracted position.

FIG. 3 shows the system 110 of FIG. 2 with the GCM 120 in a retracted position with respect to the SSM 119, corresponding to full compression of resilient urging towards the extended position of FIG. 2.

Figure 4:
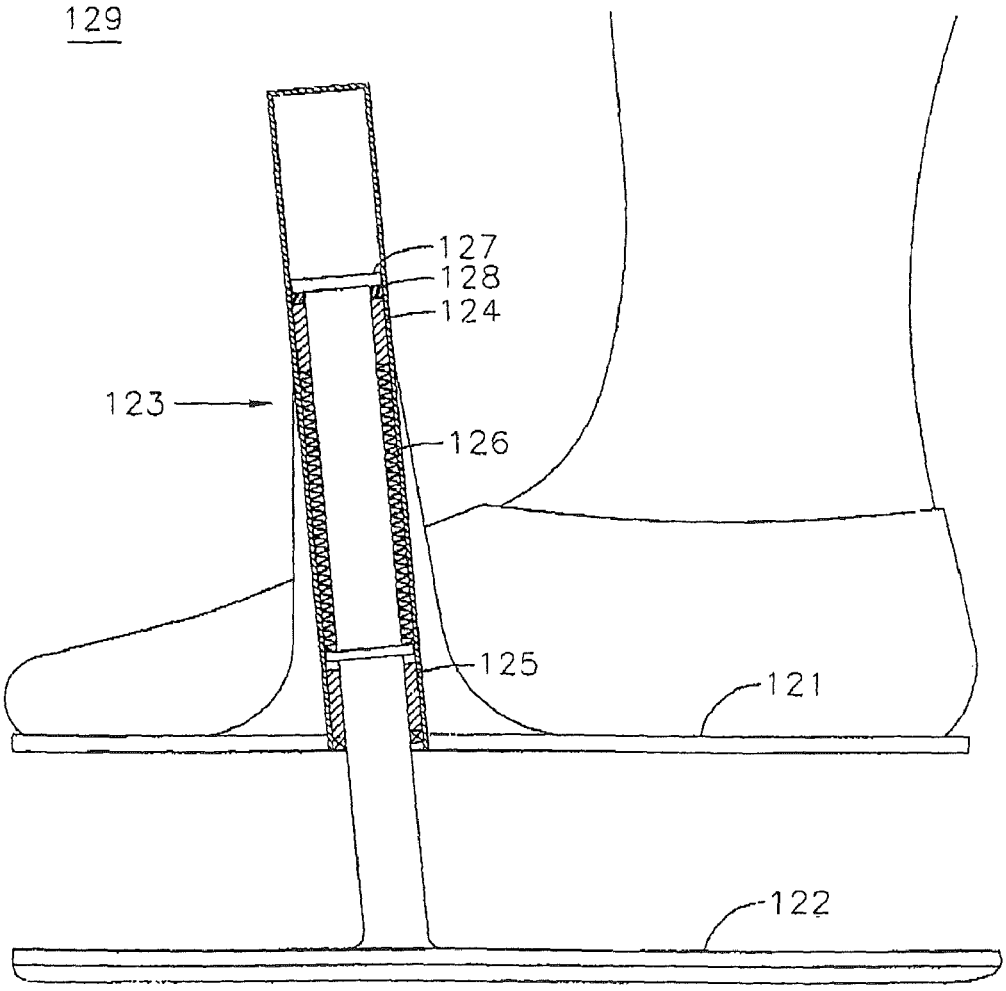
FIG. 4 is a schematic illustration of a linear bearing member assembly adapted for motion control of the extended-position ground contact member of an embodiment of the present invention.

In FIG. 4 an alternatively preferred motion control apparatus 129 for Full suspension Footwear is schematically illustrated. The GCM 122 is related to the SSM 121 by means of the LBMA 123 which maintains parallelism between them while allowing substantially vertical translation motion between predetermined positions. The LBMA 123 includes the upper and lower linear bearings 124 and 125, the resilient urging device 126, and the travel-limiting features 127 and 128.

Figure 5:
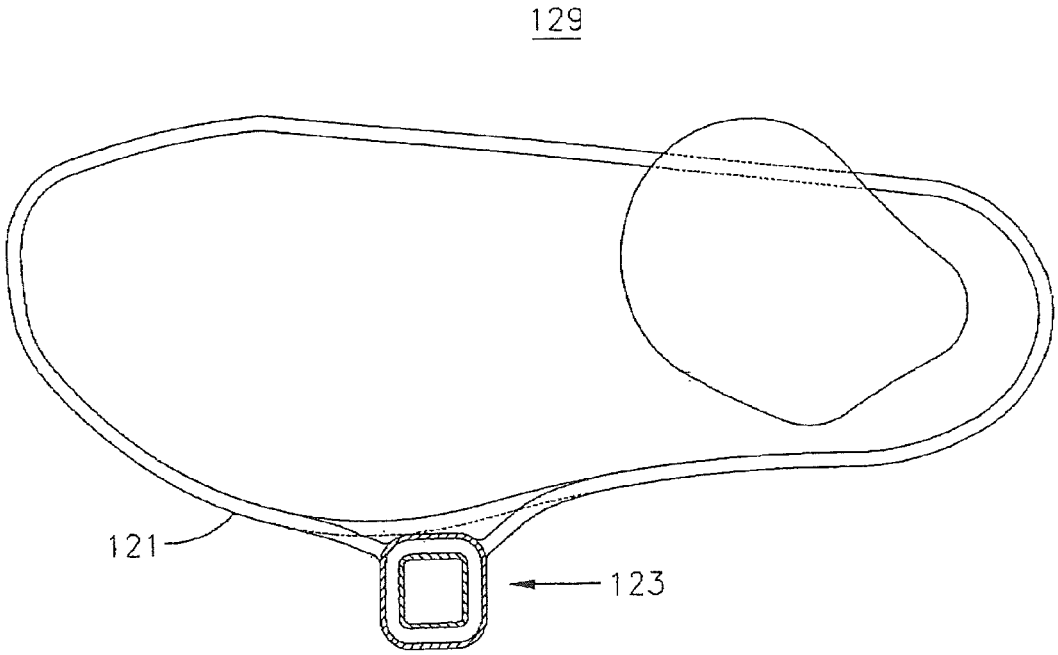
FIG. 5 is a schematic illustration of a top view of the apparatus of FIG. 4.

FIG. 5 shows the apparatus 129 of FIG. 4 in a top view, revealing preferred relationship of the LBMA 123 to the SSM 121 adjacent the metatarsal area where it substantially avoids interference with the lower leg of a user. A four-sided linear bearing member assembly is illustrated for anti-rotation control, but other configurations, e.g. three-sided, are included as preferred.

Figure 6:
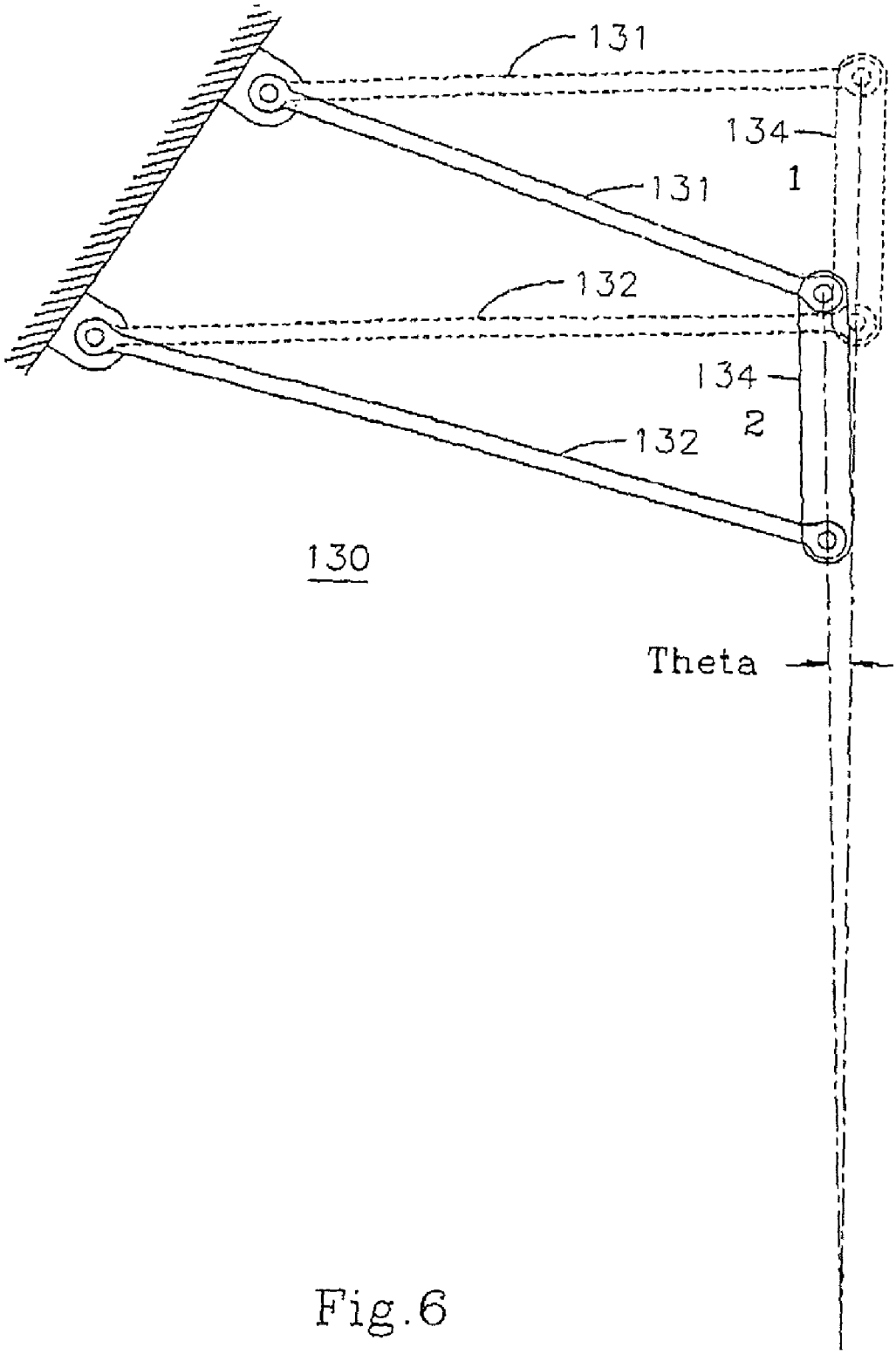
FIG. 6 is a geometric study of the terminal link axis non-parallelism inherent to unequal link lengths in an in-plane four-bar linkage.

FIG. 6 shows two different orientations of the in-plane FBL 130 which has substantially parallel horizontal links 131 and 132 of differing lengths. The mobile link 134, initially vertical in position 1, has rotated by angle Theta upon reaching position 2.

Figure 7:
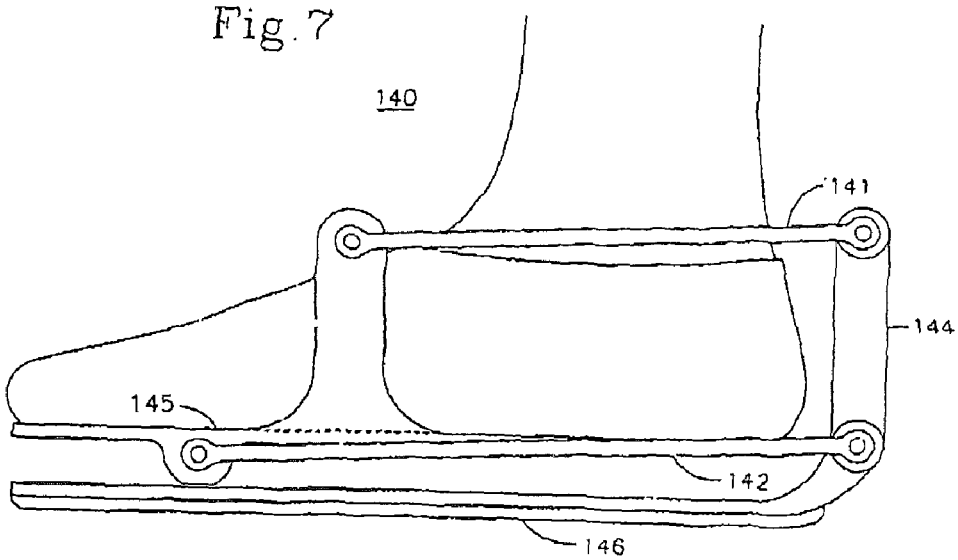
FIG. 7 is a schematic illustration of unequal link lengths adapted for motion control of the retracted-position ground contact member of an embodiment of the present invention.

FIG. 7 schematically shows an unequal length FBL 140 applied to Full Suspension Footwear: the substantially horizontal longitudinal links 141 and 142 locate the GCM 146 parallel to the SSM 145 in the retracted position shown, by virtue of the vertical link 144 formed by pivot locations in the GCM 146.

Figure 8:
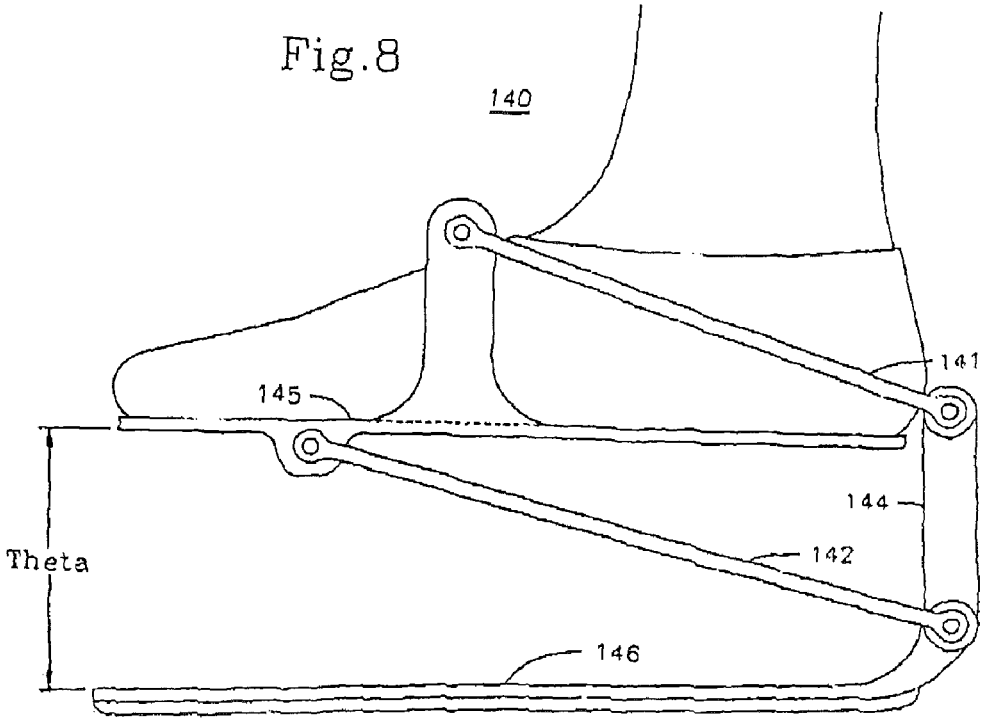
FIG. 8 is a schematic illustration of the apparatus of FIG. 7, with ground contact member in an extended position.

FIG. 8 shows the apparatus of FIG. 7 in an extended position, with angle Theta rotation imposed on its translational motion from the retracted position. The different travel magnitudes between the heel and toe portions of the GCM represent differing effective spring rates between heel and toe, a possible product benefit.

Figure 9:
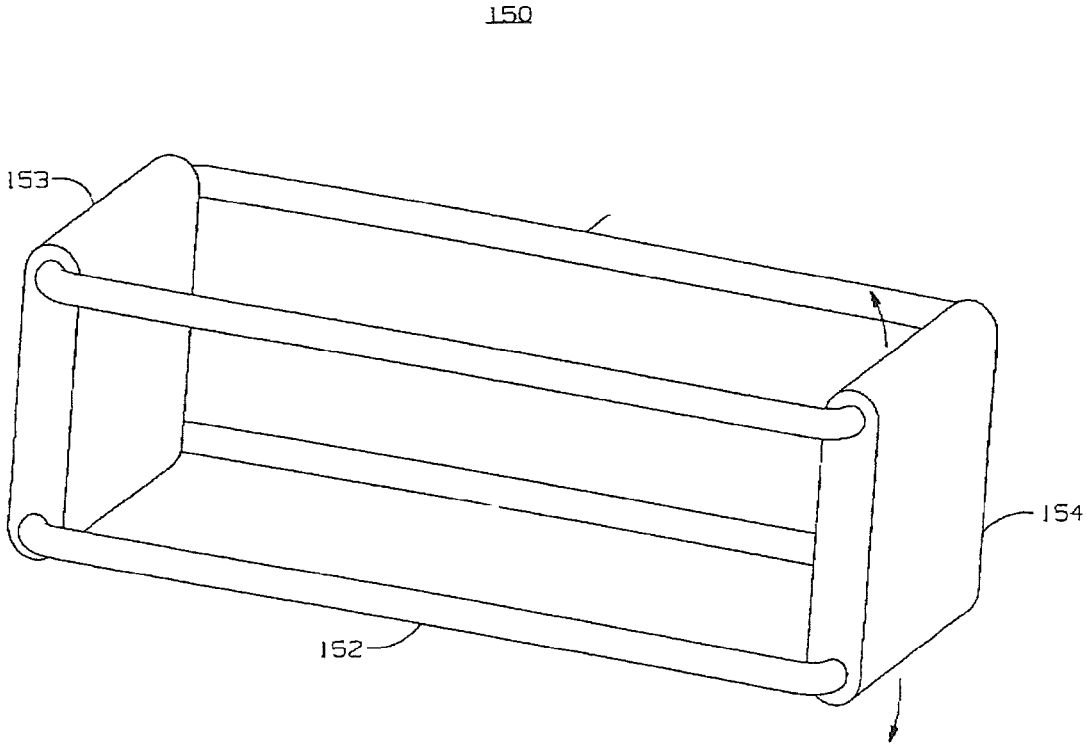
FIG. 9 is an isometric schematic illustration of an in-plane parallelogram-type four-bar linkage having closed-loop style longitudinal links.

FIG. 9 schematically illustrates the axis alignment-maintaining longitudinal pivot links 151, 152, and the vertical pivot links 153, 154 of the FBL 150 as needed for precisely controlling the substantially vertical motion of the GCM with respect to the SSM of Full Suspension Footwear. The links 151 and 152 are of the two-sided or "closed loop" configuration most effective towards maximizing axis alignment stiffness for given material stiffness properties.

Figure 10:
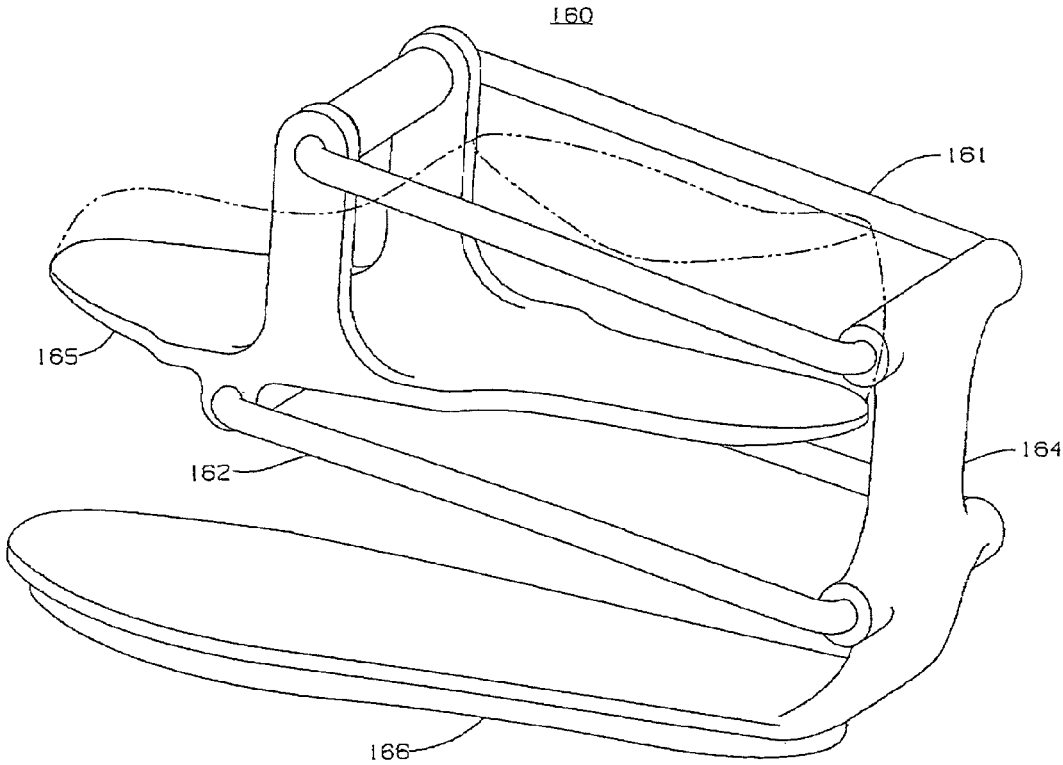
FIG. 10 is a schematic illustration of closed-loop style links of an in-plane unequal length four-bar linkage adapted for motion control of an extended-position ground contact member of a non-preferred embodiment of the present invention.

FIG. 10 schematically illustrates the motion control apparatus 160 with the highly rigid closed loop type longitudinal pivot links 161 and 162 employed for the GCM 166 parallelism with the SSM 165 of inventive Full Suspension Footwear by means of the vertical link 164's integration with the GCM 166.

Figure 11:
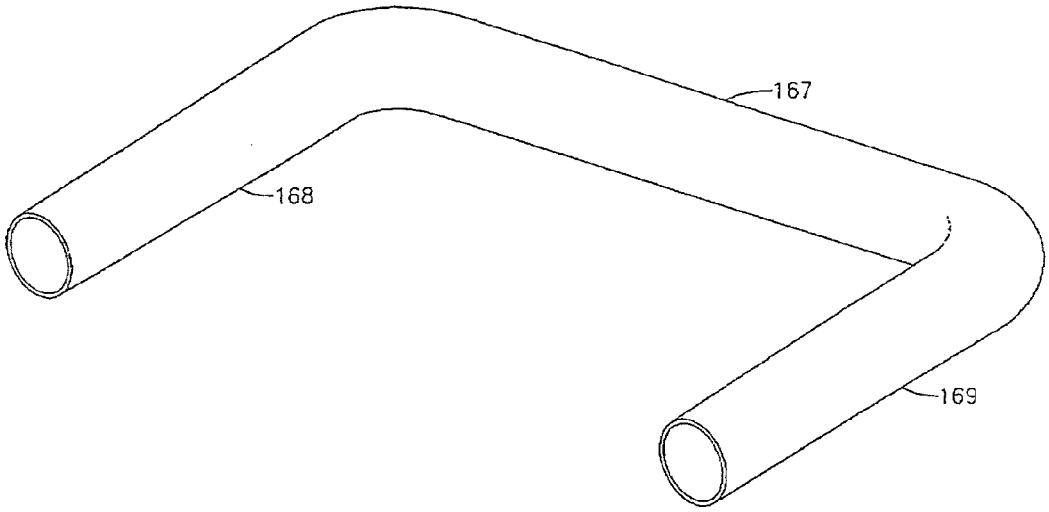
FIG. 11 is a schematic illustration of an open-loop style longitudinal link component of a preferred embodiment of the present invention.

FIG. 11 schematically illustrates a one-sided or open loop tubular longitudinal pivot link 167 featuring slightly tapered pivot pins 168 and 169. This one-sided link avoids encroachment of the natural clearance space between shoes while the tubular construction minimizes mass. Tapering the outside diameter of a constant inside diameter tube varies bending stiffness in accord with application loading while facilitating assembly of post-vulcanization bonded elastomeric torsion springs.

Figure 12:
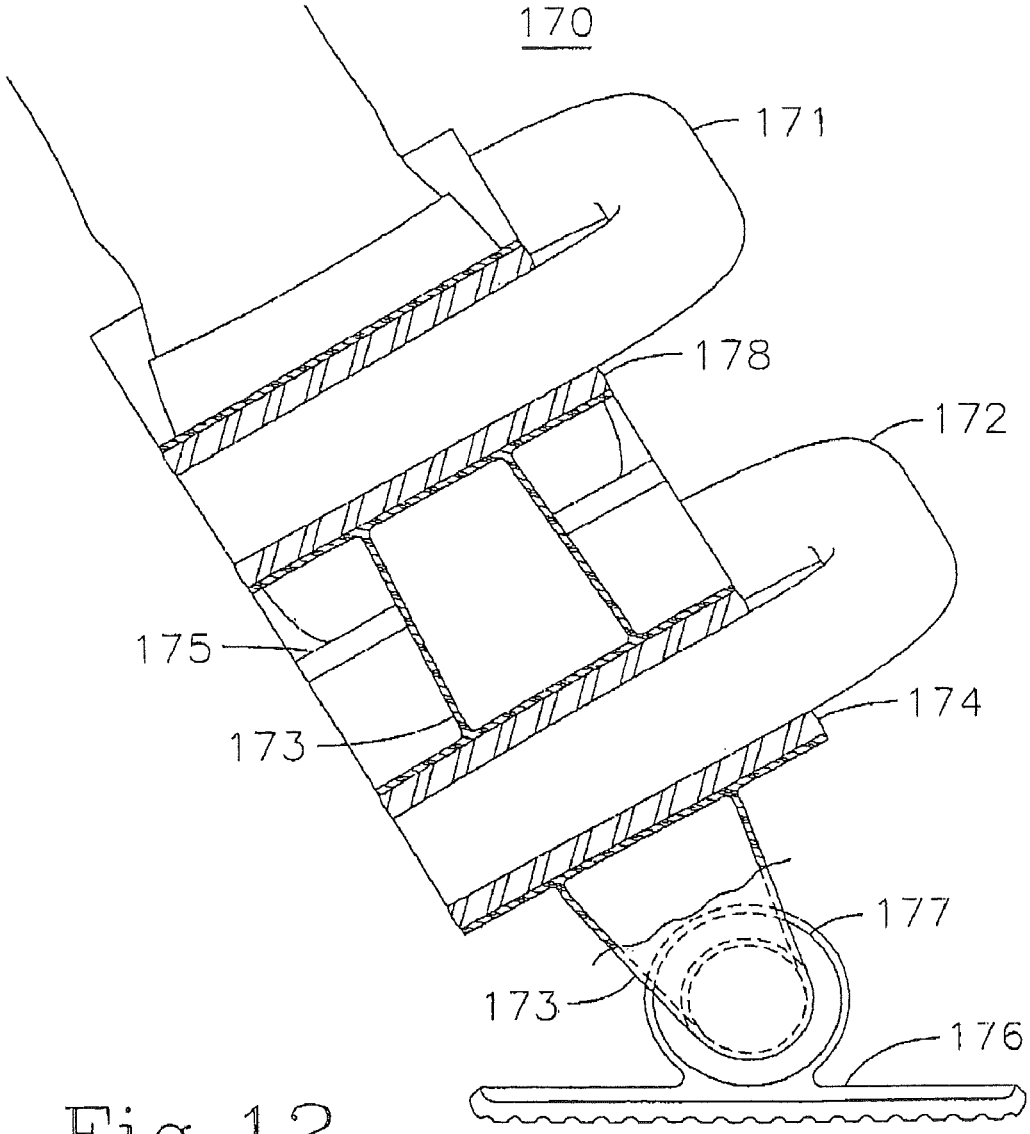
FIG. 12 is a schematic cross-sectional view illustration looking down the longitudinal pivot axis of a roll-mode pivoting ground contact member in accordance with a preferred embodiment of the present invention.

FIG. 12 is a schematic partial cross-sectional illustration of the FBL motion control apparatus 170 viewed from the rear of a user's foot. The mobile frame member 173 carries the GCM 176 in extended position with respect to the SSM 175, being located by means of the elastomeric torsion spring (ETS) pivots 178 and 174 which engage the one-sided longitudinal pivot links 171 and 172 with high axis alignment rigidity. The GCM 176 has rotated on the ETS pivot 177 to allow solid contact with treading surface without undue moment loading of the user's ankle joint, in accordance with a preferred embodiment of the present invention.

Figure 13:
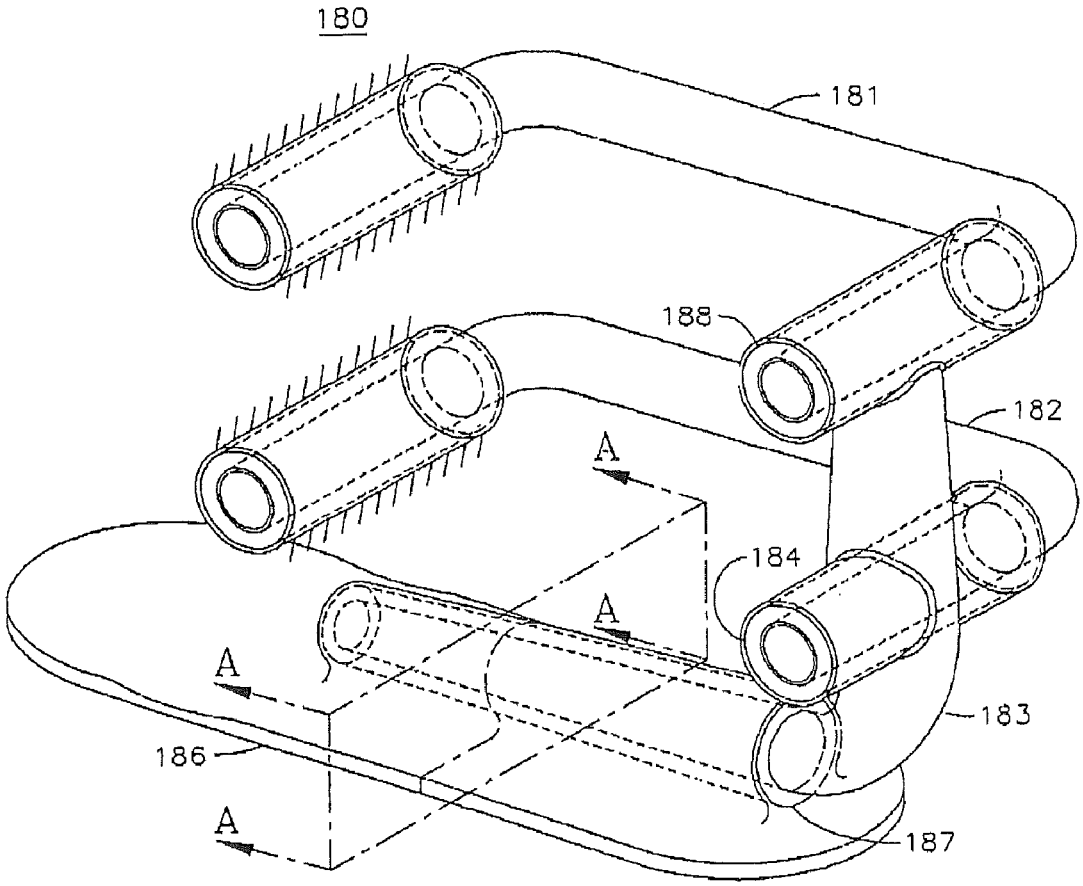
FIG. 13 is an isometric schematic illustration of the motion control apparatus of FIG. 12.

FIG. 13 is an isometric schematic illustration of the apparatus 180 like that of FIG. 12 for further clarity. The longitudinal pivot links 181 and 182 relate the mobile frame member 183 to the forward ETS pivot bushings ("grounded" in phantom SSM locating features) by the ETS pivots 188 and 184. The GCM 186 has single degree of freedom (roll mode rotation) with respect to the mobile frame member 183 by means of the ETS pivot 187 which provides resilient urging of the GCM 186 to parallelism with the SSM concurrent with high axis alignment rigidity.

FIG. 13A is a cross-sectional view of the GCM 186 as connected to the mobile frame member 183's forward extension by the ETS pivot 187. The ETS pivot 187 is shown in optional non-round shape as may be employed for non-linear (rising) torsional spring rate in an ETS.

FIG. 13A.1 shows the GCM 186 rotated 35 degrees clockwise with respect to the mobile frame member 183 as might occur in a laterally aggressive user maneuver. Portions of the ETS 187's cross-section have been placed under compression as well as rotary shear stress, a condition which produces the non-linearity.

Figure 14:
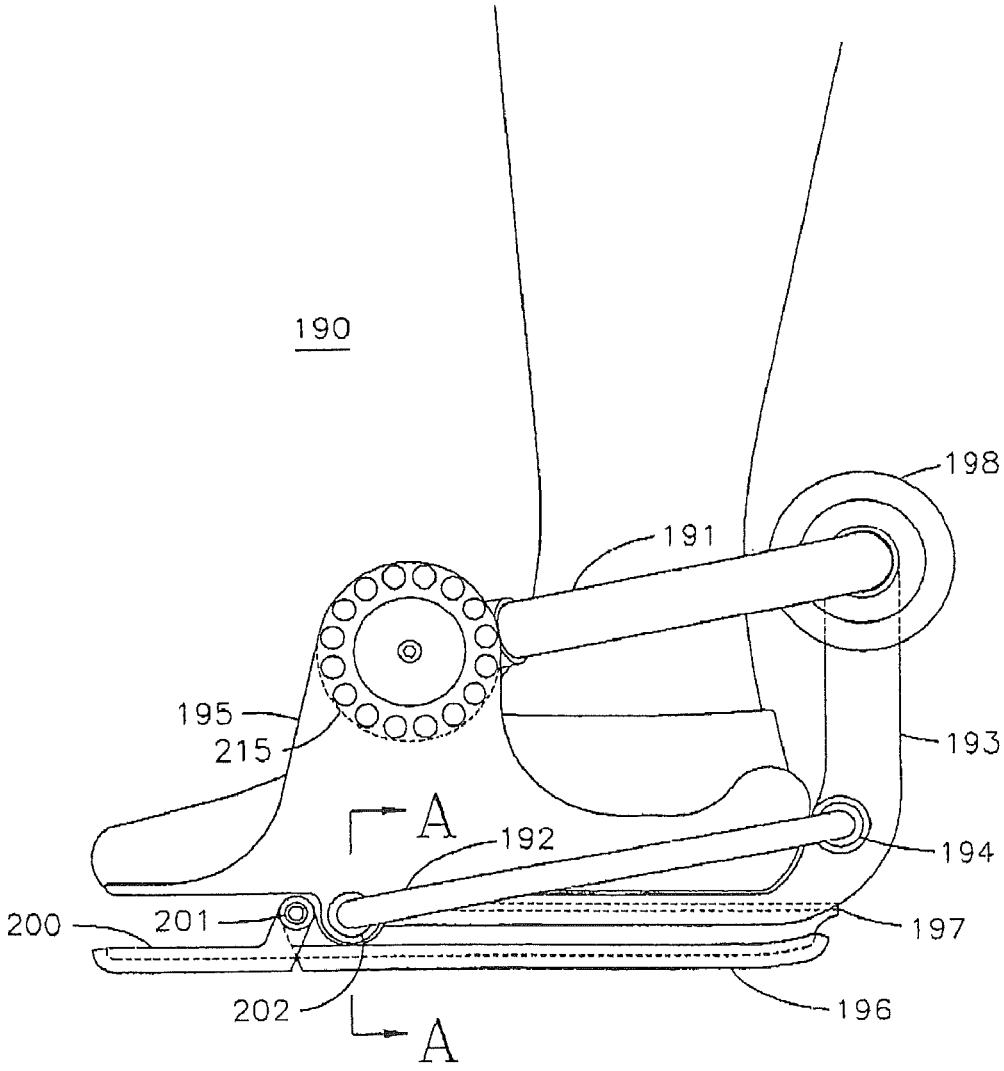
FIG. 14 is a schematic illustration of a medium travel embodiment of the present invention showing the four-bar linkage controlled ground contact member in fully-retracted position.

FIG. 14 is a schematic view from the left side of a user's left foot, i.e. an "outside" view, of the fully compressed FBL motion control apparatus 190 in accordance with a preferred embodiment of Full Suspension Footwear. The SSM 195 and the GCM 196 are related, by the FBL longitudinal pivot links 191 and 192 in the preferably ETS pivots 215, 198, 202, and 194, to the mobile frame member 193, through the ETS roll mode pivot 197. The upper ETS pivots 215 and 198 enjoy greater packaging space provision than do the lower ETS pivots 202 and 194, because the latter are factors in the SSM's proximity to the treading surface. Thus it is expedient to size the lower pivots 202 and 194 for compactness and axis alignment rigidity, in interactive association with lower pivot link stiffness, and to place the remainder of the resilient urging torque requirements on the more generously endowed, packaging space wise, upper pivots 215 and 198.

The GCM 196 features the ATPM 200 resiliently urged to parallelism with the majority lower surface of the GCM 196 by the ETS pivot 201, having piano hinge-like construction about a common axle to halve the torsional displacement (and thus requisite elastomeric section height) of its individual, adjacently interspersed, torsion bushings. These individual torsion bushings are preferably torsionally balanced, having equal lateral direction length sums in fixed associativity with the ATPM 200 and the GCM 196 respectively, such that their common axle is rotated one-half the total displacement angle of the ATPM 200 with respect to the GCM 196, for uniform torsional shear stress distribution among the hinge bushings.

Figure 14A:
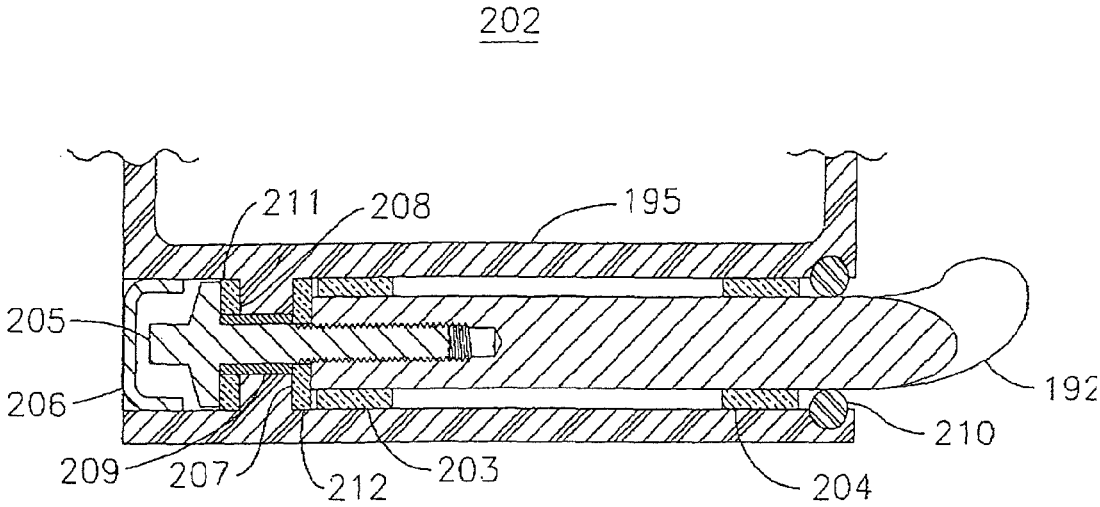
FIG. 14A is a schematic illustration of an alternative pivot bearing configuration of the FIG. 14 apparatus.

FIG. 14A is a cross-sectional view of an alternative to the ETS pivot 202 of FIG. 14, serving to clarify by its complexity the attractiveness and value of the preferred ETS embodiment. Lacking inherent resilient urging, this alternative pivot configuration must be accompanied by additional mass and package space elsewhere to replace the contribution to resilient urging provided by the ETS embodiment. Substantially higher manufacturing cost and susceptibility to both noise emissions and wear add to potential lubricant sealing failures as comparative disadvantages of this alternative over appropriately designed (peak elastomer stress-wise) ETS pivots. The pivot link 192 acts as a bearing journal to the bearings 203 and 204, a sealing journal to the O-ring seal 210, and a thrust bearing capture means in conjunction with the bolt 205 and the spacers 209, 211, and 212. Precision feature control, likely requiring machining, of the SSM housing 195 is required to reliably retain the plug 206, the bearings 203 and 204, and to provide the thrust surfaces 207 and 208, while wear resistance and clearance stability similarly require the pivot link 192's outside diameter to be constrained to excellent geometry and texture controls if not hardening, as is known.

Figure 15:
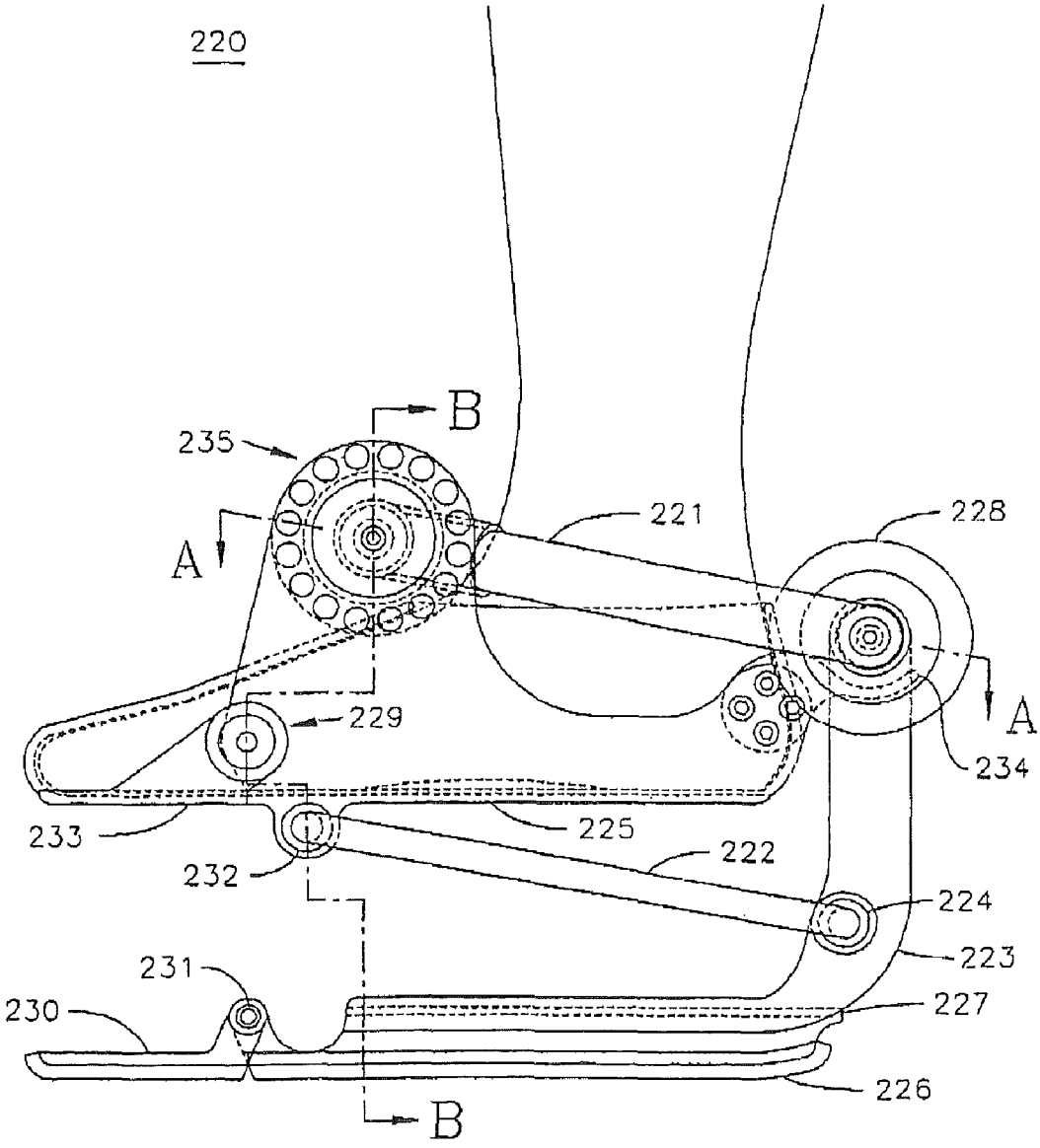
FIG. 15 is a schematic side view illustration of a four-bar linkage controlled embodiment of the present invention.

FIG. 15 is a schematic illustration of the FBL motion control Full Suspension Footwear apparatus 220 featuring the AMTSM 233 as well as the ATPM 230. Various preferred means of the inventive parallelism control between these features are detailed in subsequent figures. The AMTSM 233 rotates about a transverse pivot axis that is preferably coincident with the metatarsal joints of a user's foot, a condition that results in forward movement of the below-hinge portion of the AMTSM in conjunction with angular displacement, to the extent that this transverse pivot axis is elevated above the plane of the SSM. Preferable construction for elevated axis AMTSM pivot bearings is the employment of small sealed single row ball bearings 229 for their composite advantages of pivot axis stability, wear resistance, compactness, and operational silence. Full width leaf spring construction, the $2^{nd}$ preferred embodiment for this inventive pivot axis functionality, is discussed in subsequent figures.

The SSM 225 supports the user's foot and includes known structures (not detailed) or for its firm attachment to same. Alternatively, the SSM 225 includes known structures (not shown) for attaching to a separate shoe member that securely encloses the user's foot. Sidewall upward extensions, preferably on both sides of the foot, from the plane of the SSM region, mount the upper longitudinal link pivot 235 in fixed relationship to the lower link pivot 232, which is preferably integrated into the SSM's forward portion. The use of a full width ETS pivot bushing is illustrated, with its practical requirement of pivot axis location below the SSM, but it is understood that other types of link pivot bearings at other locations may be substituted within the scope of the invention, a sealed single row ball bearing elevated to being adjacent the small toe metatarsal, for example.

The GCM 226, which includes the ATPM 230 attachment via the common axle piano hinge 231 similar to that of FIG. 14, is located and resiliently urged away from the SSM 225 by engagement of the longitudinal pivot links 221 and 222 with the ETS pivots 235 and 232, 228, and 224 similar to FIG. 14. The vertical mobile link 223 passes in arcuate, substantially vertical motion between support details of the damped resilient travel stop 234, which enables "preloading" of the FBL's resilient urging to an initial magnitude comparable to the user's gravitational force. This preloading avoids waste of extension travel that would otherwise be needed just to reach static equilibrium with the weight of the user, by restricting GCM extension position to a predetermined extension position that preferably corresponds to a preload force substantially equivalent to the gravitational force of the user's mass, an extension value less than that of its "free state", or equilibrium position.

Figure 15A:
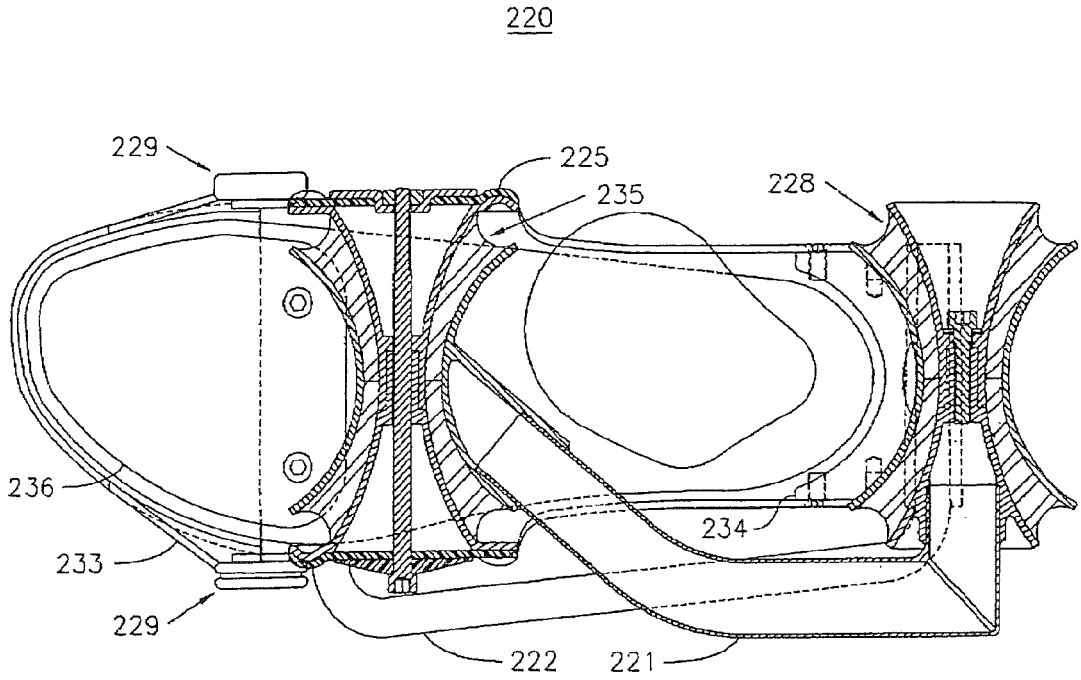
FIG. 15A is a top view schematic illustration of the FIG. 15 apparatus.

FIG. 15A is a "top view" section of the apparatus 220 through the front upper ETS pivot 235, the pivot link 221, and the rear upper ETS pivot 228. The cross-hatched areas of the ETS pivots represent curvilinear, preferably axisymmetric, elastomeric sections bounded by high stiffness circular section torque transfer members that transfer the windup energy stored in the shear stress of the elastomer to the FBL structure to produce resilient urging of the GCM away from the SSM. The ETS pivots are necked down to smaller diameter at their length midpoints for a packaging space benefit that enables reduced link length. A shorter link carries a leverage advantage of reduced ETS torque requirement for given resultant force, synergistically reducing required ETS size at given elastomer stress levels. The curvilinear section shape of these ETS pivots adopts transition section geometry of prior art springs in mirrored fashion as is detailed in FIGS. 15C-19. The AMTSM 233, mounted on the pivot bearings 229, preferably includes a bridging leaf 236 to avoid pinching of the foot in cases where, as here illustrated, the pivot axis of the AMTSM bearings 229 is indeed elevated above the plane of the SSM and thus produces an air gap with angular mobility away from the plane of the SSM.

Figure 15B:
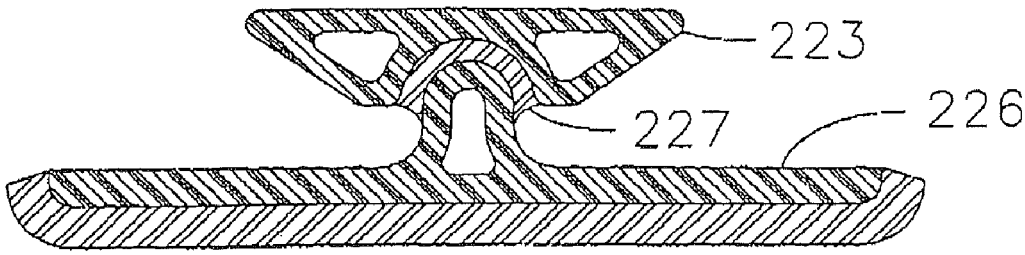
FIG. 15B is a cross sectional schematic illustration of the FIG. 15 apparatus.
Figure 15B:
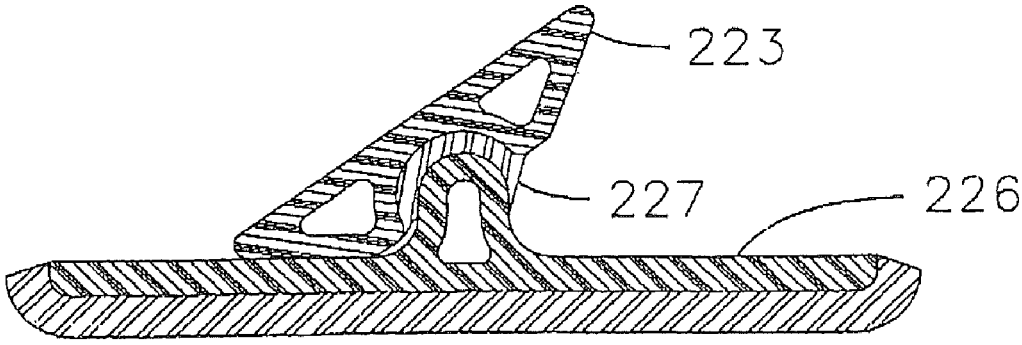
Figure 15B:
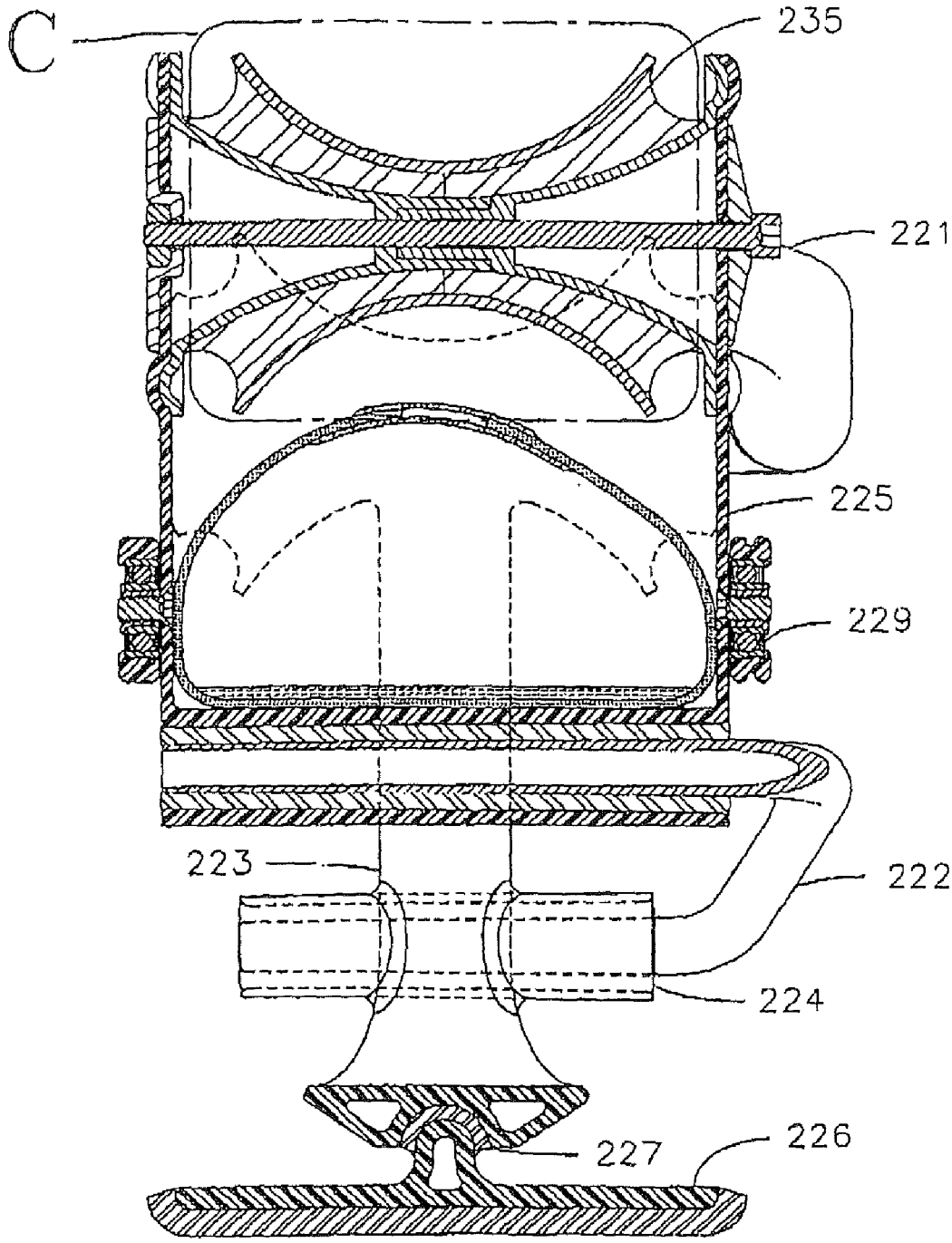

FIG. 15B is a schematic cross-sectional illustration as viewed from the front, towards the rear, of the apparatus 220. The lower forward ETS pivot 232 is shown in section, with the tubular lower longitudinal pivot link 222 seen at its center, a much simpler construction than that detailed in FIG. 14A. The upper forward ETS pivot 235 is seen to be located by the sidewall extension portions of the SSM 225 in proximity to the instep of the user's foot as represented by a schematic section through a shoe upper portion. Outline C encloses the ETS pivot 235's curvilinear section shape as further explained in FIG. 15C. The mobile frame member 223 extends forward from the rear of the SSM for economy of fully compressed height (of SSM above treading surface), concurrent with freedom from restriction on the ability of the GCM 226 to pivot freely about the horizontal longitudinal pivot axis formed by the ETS 227 when in extended (from SSM) positions. The "half round" configuration of the GCM ETS pivot 227 is more compact vertically than full ETS bushings such as those shown in FIGS. 13 and 13A, allowing increase of SSM proximity to treading surface under full compression, which works to the advantage of this proximity at all extension travel positions. FIGS. 15B.1 and 15B.2 illustrate GCM pivoting about the GCM ETS pivot 227. An alternative half round ETS GCM pivot 227 is illustrated in FIGS. 15B.3 and 15B.4, including a design advantage of mechanical interlocks to help carry side loading at high roll angles and so limit stress levels within the ETS pivot, but with disadvantage to proximity of the ATPM control cable to the treading surface (effective limitation on cable pulley radius) for centralized cable architectures such as those later seen in FIGS. 21 and 28.

Figure 15C:
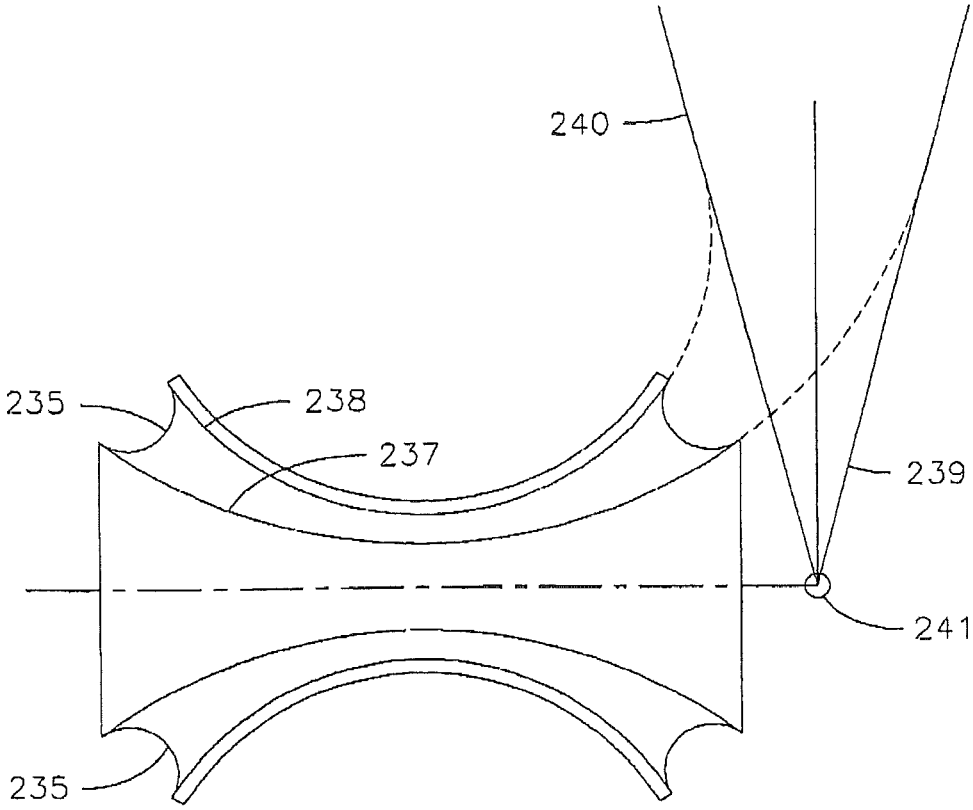
FIG. 15C is a cross-sectional view of the elastomeric torsion spring of FIG. 15 showing how its boundary geometry relates to so-called "common vertex" disc spring torque transfer members.
Figure 16:
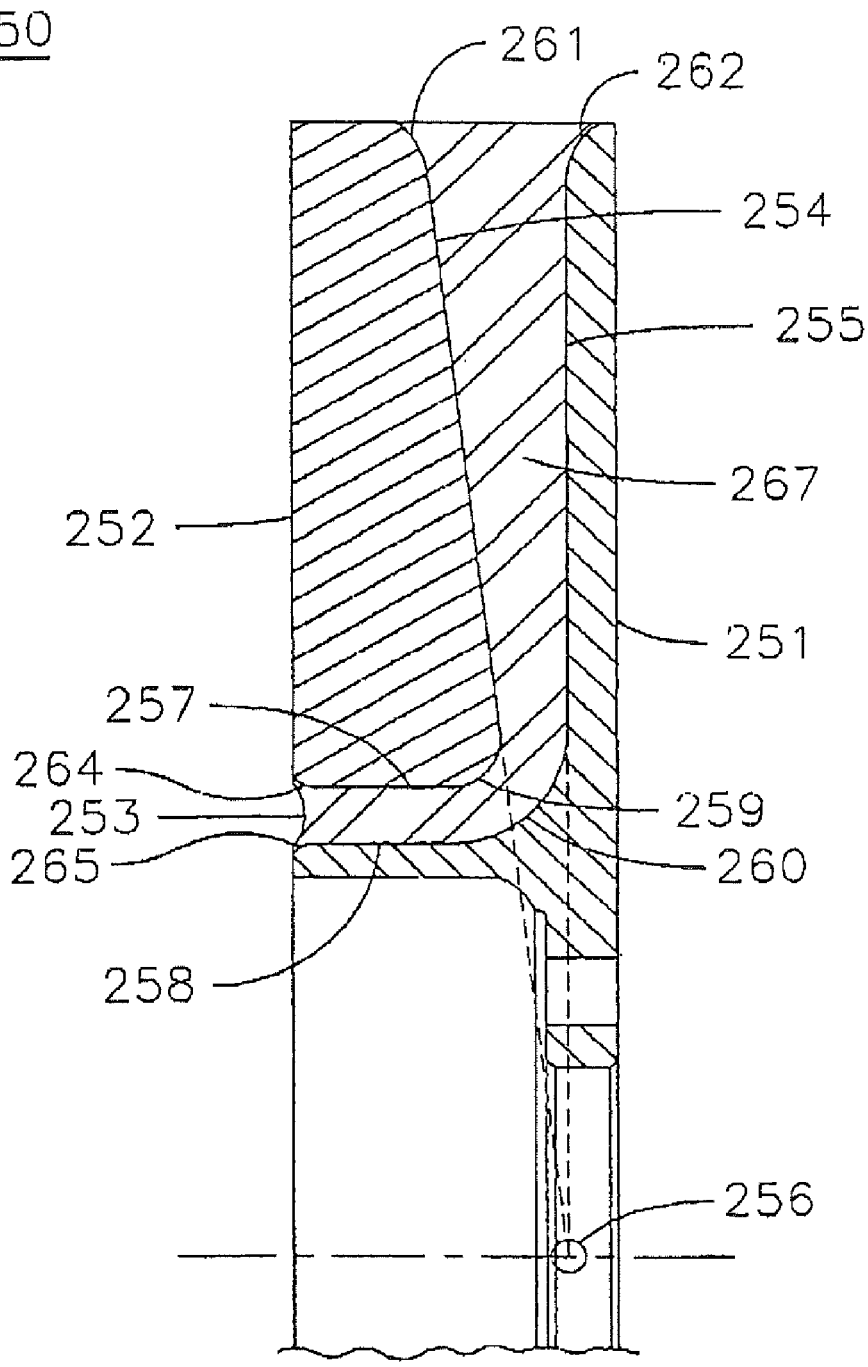
FIG. 16 is a cross sectional view of a mold-bonded torsional vibration damper (TVD), exemplifying prior art elastomeric torsion spring boundary geometry practice.

FIG. 15C shows how the inner boundary member 237 of the ETS pivot 235 is tangent to the disc spring boundary line 239, and the outer boundary member 238 of the ETS 235 is tangent to the line 240 which shares the "common vertex" centerline location 241, as is known preferred design practice in the art, and as is illustrated in FIG. 16. The FIG. 15 construction is the mirrored union, at its smallest diameters, where the transition region joins the cylindrical section, of this FIG. 16 prior art configuration.

FIG. 16 shows prior art mold-bonded ETS design practice as embodied in the crankshaft torsional vibration damper 250 of an internal combustion (piston) engine. Such crankshafts are subjected to periodic torsional excitations by compression, combustion, and inertia loads transmitted by the attached connecting rods and pistons. Being typically lengthy structures, these crankshafts exhibit resonant vibration modes in torsion (or twist) of frequencies which are dependent upon the entirety of the so-called mass-elastic system, with the effective inertias of pistons and connecting rods adding to the crank throw and counterweight inertias acting to twist portions of the crankshaft with respect to its undeformed state. A torsional vibration damper, such as the mold-bonded configuration here illustrated, uses torsional resonance of an inertia member (or ring) as attached to a hub (which is mounted on the crankshaft) with engineered torsional spring rate, to counteract, by amplitude phase shift and the relative torques thereby generated, the crankshaft's inherent resonant tendencies, enabling the avoidance of catastrophic failure that metal fatigue would otherwise be risked in high stress areas such as the fillets of the main journals. The engineered torsional spring rate is achieved at elastomer torsional shear stress levels known to survive service conditions by design choices that include both elastomer properties and the geometry of the high stiffness circular section torque transfer members (ring and hub) that define the shape of the elastomer's section. It is critical to the commercial success of these products to avoid stress concentrations that would jeopardize service life, so design practices that, to the extent possible, equalize torsional shear stresses throughout the elastomer section have evolved for these and other ETS applications. It is to the design efficiency (mass, size, cost) and durability advantage of preferred Full Suspension Footwear ETS pivots that these prior art practices are utilized.

The hub 251 and the inertia member 252 of FIG. 16, which together form the section shape of the ETS 267, include the transition region, bounded by the radii 259 and 260, that is used to packaging efficiency benefit by the preferred Full Suspension Footwear ETS pivot 235. The "vertical", or axially connected, disc spring region, bounded by the section lines 254 and 255, which share the common vertex 256 at the centerline, represents the ideal, from stress concentration avoidance standpoint, of uniform numerical shear stress under torsional displacements between hub and ring, because the "axial" gap between the boundary members increases with distance from the common rotational centerline such that torsional shear strain, the ratio of relative circumferential displacement to section thickness of the elastomer, remains constant. The cylindrical "bushing" region, bounded by the section lines 257 and 258, is typically added both for moldability and for its contribution to radial stiffness, and has shear stresses inherently greater at the inner boundary member 258 than at the outer 257 because of both the surface area and the leverage radius differences between them. The transition region bounded by the radii 259 and 260 being tangent to the disc spring area boundary lines 254 and 255 respectively, helps redistribute the stress inequality inherent to the cylindrical bushing region, both by its natural increase in section width with distance from the centerline, and also by its curvature stress concentration effects, the concavity tending to reduce the otherwise highest stresses of the hub, and the convexity tending to increase, or concentrate, the otherwise lowest stresses of the ring. The transition radii 259 and 260 share coincident axial locations of their tangencies with the cylindrical region boundary lines 257 and 258, a key element to their proper sizing in order for them to truly represent the theoretical best gradual widening of the section gap as it proceeds around the corner and begins to take on additional distance from the pivot centerline.

It is also known best practice to incorporate generous transition radii at section free ends, to gradually reduce bond line shear stresses instead of incurring stress concentrations of more abrupt transitions. The section end corner radii 261, 262, 264, and 265 exemplify this prior art practice, with further benefit from the section end fillet radius 253 which the mold bonding process facilitates.

Figure 17:
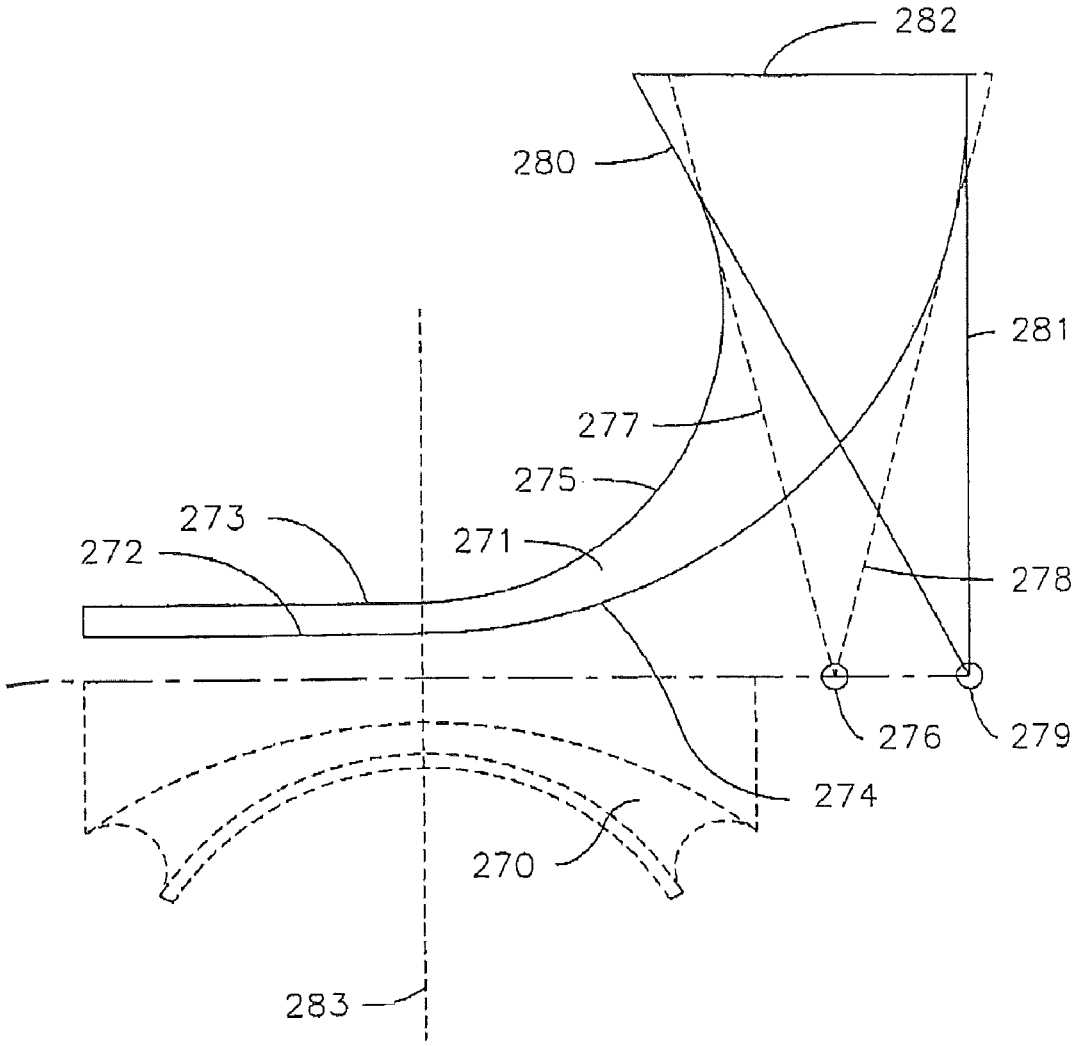
FIG. 17 is a cross sectional view of elastomeric torsion spring boundary geometry in accordance with prior art TVD practice.

FIG. 17 shows, above its centerline, a similarly configured elastomer section 271 bounded by the cylindrical radii 272 and 273, the fully tangent transition radii 274 and 275, and the common vertex 279 for the disc spring boundary section lines 280 and 281. The outer free end section line 282 corresponds to line 266 of FIG. 16. Below the centerline is the ETS pivot section 235 of FIGS. 15A and 15C. The "same as prior art" features above its centerline have been proportioned to coincide with those of the ETS pivot section of FIGS. 15A and 15C, which have maximum elastomer stress and strain levels adopted to the much higher angular displacements of the present application by virtue of section thickness adjustment as is known in the art. The vertex 276 joins the "vertically symmetrical" disc region boundary lines 277 and 278, also tangent to the transition radii 275 and 274, respectively, showing the similarity between the ideal, vertically symmetrical, disk spring configuration and the often more packaging-expedient vertical outer boundary configuration exemplified by the TVD 250 of FIG. 16, as far as transition radius sizes are concerned. Both vertically symmetrical and vertical outer configurations have the uniform "numerical" strain property described above, but the asymmetry of the vertical outer configuration produces slight inequality of shear stresses in the disc region in actuality, because the tilting of the section introduces elements of a cylindrical bushing region's inherent stress inequalities.

Figure 18:
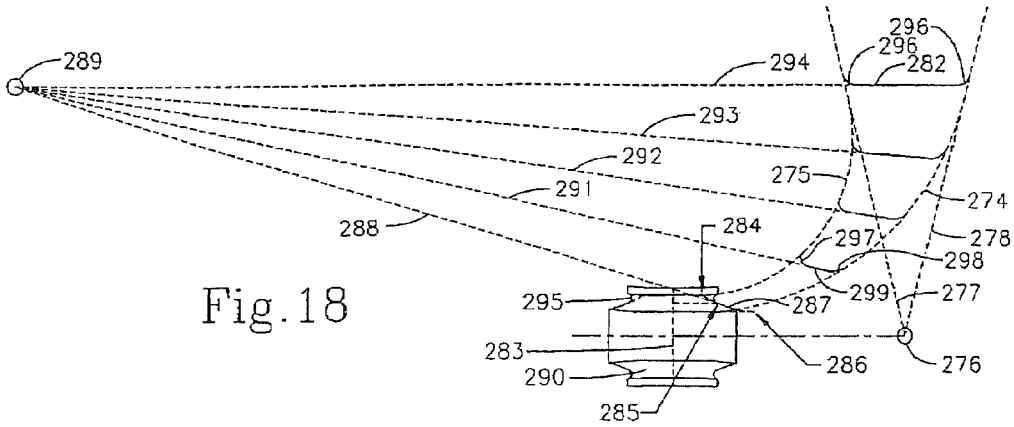
FIG. 18 is a cross sectional view of elastomeric torsion spring boundary geometry in accordance with prior art TVD practice, showing interpolative application of preferred section free end configurations to various extents of fill.
Figure 19:
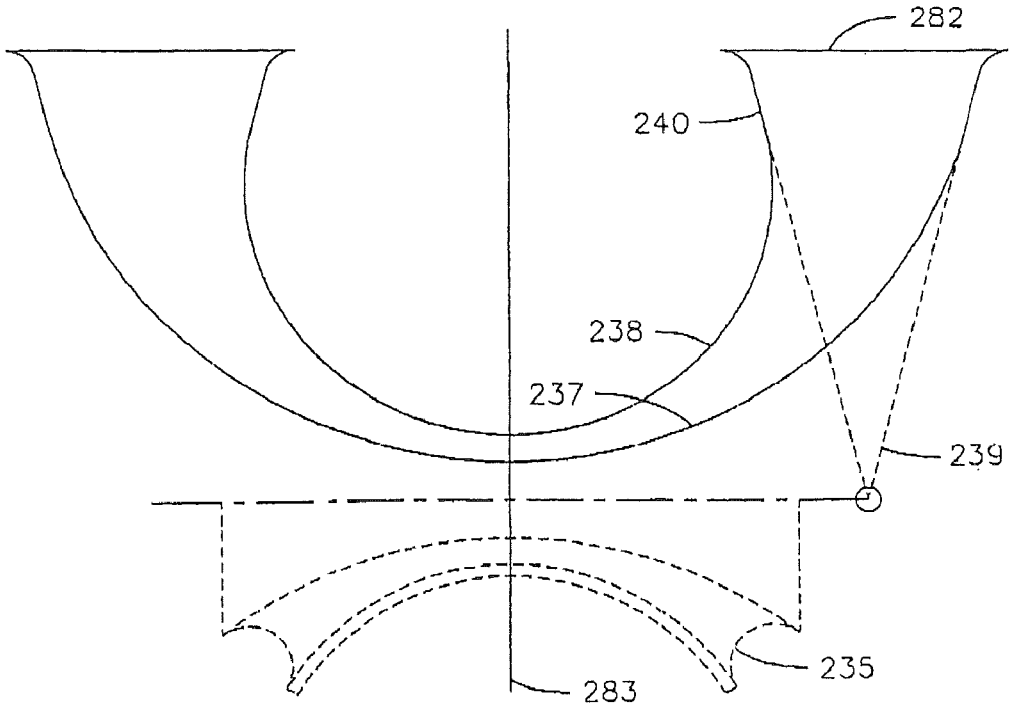
FIG. 19 is a cross sectional view of elastomeric torsion spring boundary geometry in accordance with prior art TVD practice, showing the mirrored union of transition sections as preferably applied to the current invention.

FIG. 18 represents a study of preferred section end shapes, as a function of how much transition region volume is utilized by an ETS. A predominantly cylindrical bushing is shown, having construction symmetry about a center plane represented by line 283. The proportions of the ETS pivot section 235 of FIGS. 15A and 15C are again displayed. The truly cylindrical portion of the section 290, represented by the width 284 mirrored about the plane 283, bounds the elastomer section 290 with constant radii about the pivot centerline. The transition region boundary radius 275 is tangent to the outer cylindrical boundary line at point 284 and also to the disc region boundary line 277. The transition region boundary radius 274 is tangent to the inner cylindrical boundary line at the same axial location (directly below point 284), and also to the disc region boundary line 278 which shares the common vertex 276 with the disc boundary line 277. As is known in the art, the preferred section end configuration for a cylindrical bushing type spring is the so-called uniform numerical stress boundary, where section widths vary inversely with the square of a cylindrical element's radius from the pivot centerline. Using as starting point the radius and section width represented by point 284, this relationship generates point 285 at the gap midpoint radius and point 286 at the inner boundary radius. Connecting these three points with a simple radius 287 closely approximates the hyperbolic curve of the uniform numerical stress calculation, a technique typically used to define boundary configurations for uniform numerical stress bushings in practice. A bondline stress relieving fillet 295 is preferably used to "soften" the transition to the outer torque transfer member, while the inherent "pointiness" of the section's union with the inner torque transfer member may not require further stress relief.

The general slope of the section end boundary radius 287 between the bondline stress relieving fillet 295 and the transition region boundary radius 274 is represented by the construction line 288. Since this line, and the horizontal (parallel to centerline) construction line 294, which reflects the preferred section end boundary 282 of the disc region just above the tangency points of the transition region radii, can be said to represent best practice boundary configurations at both ends, respectively, of the transition region, preferred section end boundary configurations for partial usage of transition region geometry by ETS elastomeric sections may be found by interpolation between them, by the device of using their intersection point or the vertex 289 for construction of the preferred partial usage ETS section end configurations. Accordingly, an ETS section configured by means of prior art transition region radii for packaging advantage that needs to utilize only that volume represented by the boundary line 299 will preferably use the construction line 291, from the construction vertex 289, to define the general slope of the section ending boundary line 299. The bondline fillet radii 297 and 298 may be of differing size in cases of being near the cylindrical, uniform numerical stress boundary condition, in light of the intersection angles therein comprised, but will preferably approach equality as the symmetry of the disc region is neared. The disc region end boundary 282, for example, preferably uses equal sized bondline transition fillets 296 because of the symmetry with which the purely axial construction line 294 intersects the disc section boundary lines 277 and 278.

FIG. 19 again shows the geometry of ETS 235 of FIGS. 15A and 15C below the centerline, for reference. Above the centerline this same geometry is extended to fully include portions of uniform numerical stress (common vertex construction) disc region geometry. The side-by-side disc regions may be extended further outward from the pivot centerline as needed to achieve an application target torsional spring rate as is known in the art. These highly adaptable prior art best practice constructions offer significant design flexibility and utility while avoiding, to the extent possible, the stress concentrations that reduce flex life and so are preferably utilized for resilient urging of CFBL embodiment Full Suspension Footwear such as FIGS. 30 and 31, and as further detailed in FIG. 31B.

Figure 20:
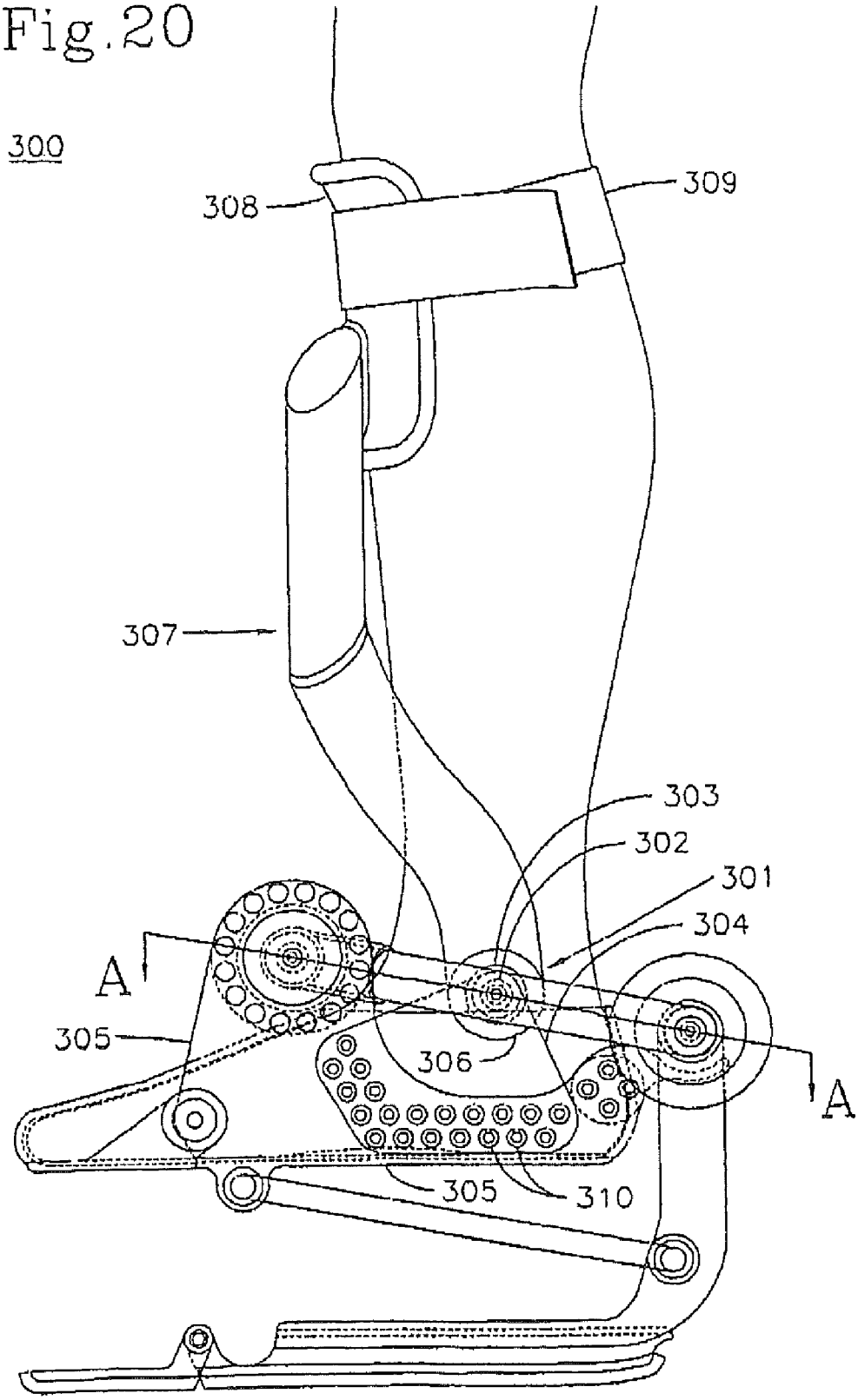
FIG. 20 is a schematic side view illustration of the FIG. 15 apparatus with the addition of ankle joint stabilization structures in accordance with a preferred optional embodiment of the present invention.

FIG. 20 shows the apparatus 300, similar to the apparatus 220 of FIG. 15, with the addition of the SBM 307 and the TAPA bearing 301 as an optional moderate travel Full Suspension Footwear embodiment providing ankle stabilization for aggressive maneuvers or usage on rough terrain. Ankle stabilization with pitching mode freedom for normal articulation control is provided by the TAPA bearing 301, which allows pivoting about a transverse axis preferably substantially coincident with the user's ankle joint between the SSM 305 and the SBM 307, to both of which it is fixedly associated. The SBM 307 is preferably located and stabilized by the user's lower leg by the nesting pad 308 and the snugging structure (or strap, hereafter "snugging strap") 309 at its upper end, and by the user's foot by the SSM 305's location of the TAPA bearing 301 at its lower end. It thus carries roll mode moment loading, or ankle turning moments, comfortably by virtue of the large spacing between the SSM 305 and the upper attachment features 308 and 309. The TAPA bearing 301 is fixedly associated with the SSM 305 by a TAPA bracket 304 which may be integrated into the SSM 305 or, as illustrated, fastened to it with fasteners such as screws 310. The TAPA bearing has a first member 302 in fixed associativity with the TAPA bracket 304, and a second member 303 in fixed associativity with the SBM 307 preferably through the fixture 306. Numerous types of SSM, SBM, and TAPA bearing architectures are of course possible, the architecture shown is only one practical configuration, detailed for illustrative purposes only and by no means intended to introduce limitation to the scope of the invention.

Figure 20A:
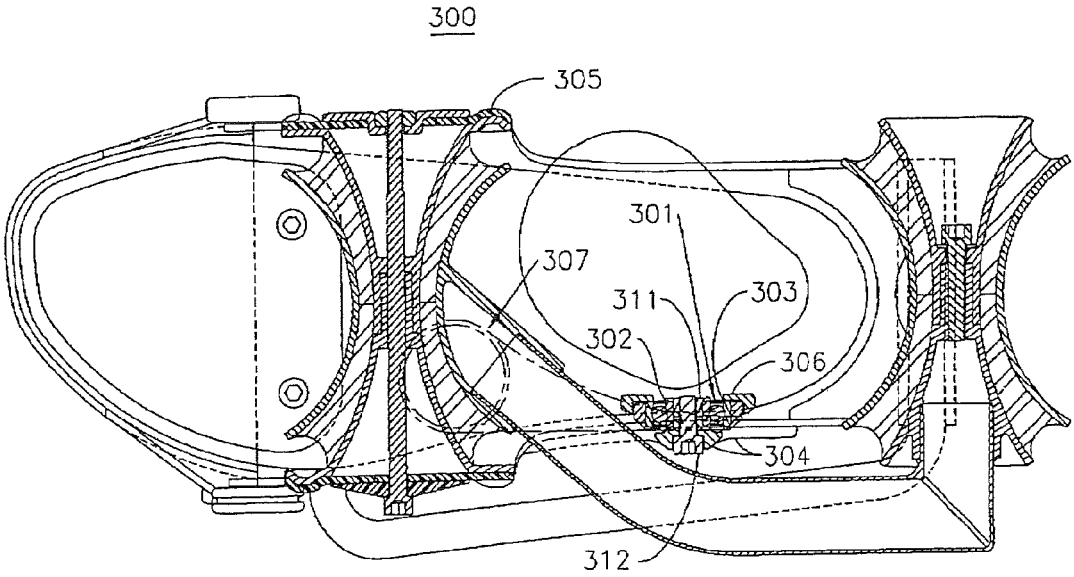
FIG. 20A is a schematic top view cross sectional illustration of the FIG. 20 apparatus showing the ankle joint stabilizing bearing.

FIG. 20A shows in schematic cross-sectional illustration the view from above section line A-A of FIG. 20. The TAPA bearing 301 is oriented to have pivot axis coincident with a user's ankle joint, being fixedly associated with the SBM 307 through the fixture 306, and with the SSM 305 through the TAPA bracket 304. The fastener 312 engages the collar 311 to fixedly associate the TAPA bracket 304 with the first bearing member 302.

Figure 21:
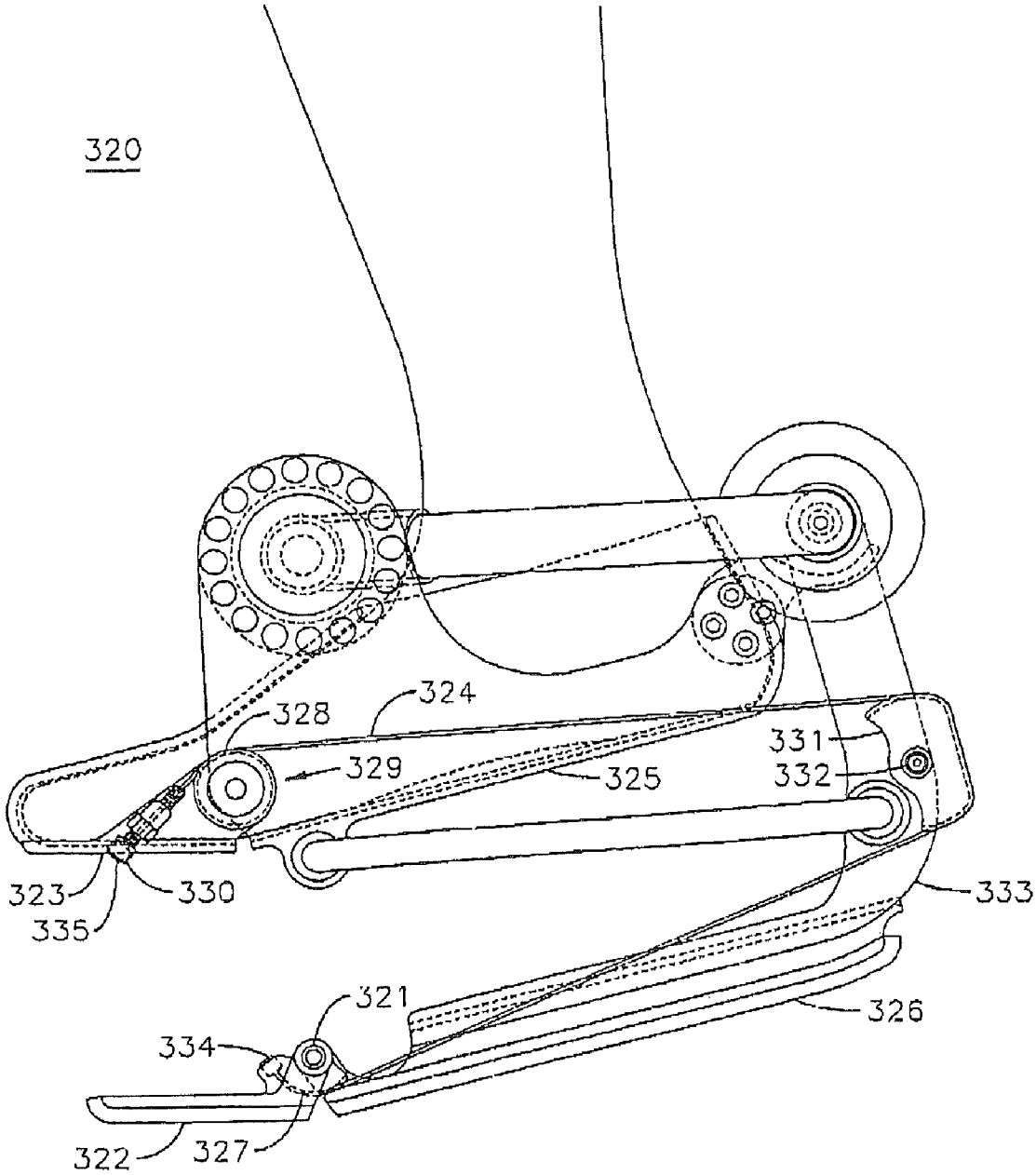
FIG. 21 is a schematic side view illustration of a parallelism control apparatus relating a ground contact member's articulating toe pressure member to a shoe sole member's angularly mobile toe support member in accordance with a preferred embodiment of the present invention.

FIG. 21 is a schematic illustration of an apparatus 320, similar to the apparatus 220 of FIG. 15, with added structures for the inventive parallelism control between the ATPM 322 and the AMTSM 323 in accordance with a preferred embodiment of moderate travel FBL motion controlled Full Suspension Footwear. The ATPM 322 includes a socket that captures the enlarged first end 334 of the cable 324, and the pulley-like FOSCR 327 to maintain the cable 324 at radial displacement below the ATPM pivot 321 for torque transmittal. The cable 324 extends without friction-inducing contact with other features from the FOSCR 327 to a FOSCR feature at a first end of a reverser pulley 331 which pivots in as nearly friction-free manner as possible on the pivot axis member 332, which is fixedly associated with the mobile frame member 333. Another FOSCR is preferably employed at the second end of the reverser pulley 331, to pay out the preferably same continuous cable 324 extending in forward longitudinal direction to a preferably FOSCR 328 in fixed associativity with the AMTSM 323's portion of the AMTSM pivot bearing 329. From this FOSCR 328, the cable 324 preferably extends to an adjuster receptacle 330 which houses the cable 324's enlarged second end 335. This nearly friction-free motion control apparatus replicates the functionality of a CFBL, the radius between the FOSCR 327 and its pivot 321 forming a first vertical terminal link, the cable 324 and the fixed distance between the pivots 321 and 332 constituting a first longitudinal pivot link pair, the reverser pulley constituting a double-ended conjoining vertical link, the cable 324 and the fixed distance between the pivots 332 and 329 constituting a second longitudinal pivot link pair, and the radius between the FOSCR 328 and its pivot 329 constituting the second vertical terminal link. Thus cable actuation systems may be considered special cases of FBL motion control apparatus: in the case of so-called control cables, with a linearly stiff yet flexible coiled wire concentric sheath outside the tensile member, the concentric sheath provides, in conjunction with its receptacle sockets, the functionality of the fixed pivot distances links of the above discussion.

Figure 22:
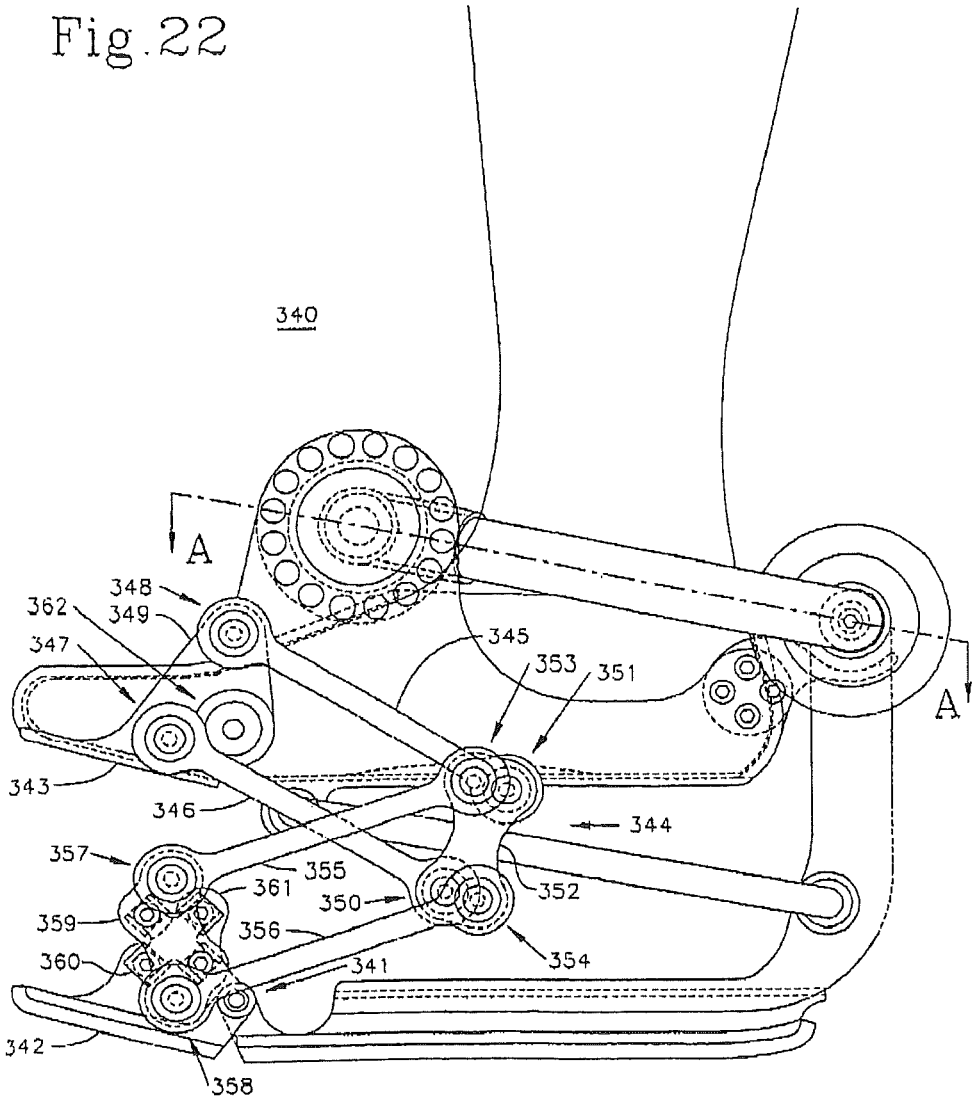
FIG. 22 is a schematic side view illustration of an alternative parallelism control apparatus relating a ground contact member's articulating toe pressure member to a shoe sole member's angularly mobile toe support member in accordance with a preferred embodiment of the present invention.

FIG. 22 is a schematic illustration of another apparatus 340, similar to the apparatus 220 of FIG. 15, with added structures for the inventive parallelism control between the ATPM 342 and the AMTSM 343 in accordance with another preferred embodiment of moderate travel FBL motion controlled Full Suspension Footwear. In this case the apparatus for parallelism control between the ATPM 342 and the AMTSM 343 is an actual CFBL 344, which for its mass and complexity penalties offers potential stiffness benefit for increased accuracy of motion control under load. An AMTSM 343 vertical link 349 is preferably formed in conjunction with the structures which mount AMTSM 343 to the AMTSM pivot bearing 349 such that it is fixedly associated with AMTSM 343 so also pivots on the AMTSM pivot bearing 349. The upper pivot 348 of the vertical link 349 is connected, by the longitudinal link 345, to the pivot 351 of the conjoining link 352. The lower pivot 347 of the vertical link 349 is connected, by the longitudinal link 346, to the pivot 350 of the conjoining link 352. The upper pivot 353 of the conjoining link 352 is connected, by the longitudinal link 355, to the flexible coupling adapter 359's upper pivot 357. The lower pivot 354 of the conjoining link 352 is connected, by the longitudinal link 356, to the flexible coupling adapter 359's lower pivot 358. The flexible coupling adapter 359, as a CFBL 344 terminal link is thus constrained to follow any angular orientation change of the CFBL 344's other terminal link 349, and vice versa, independently of the extension magnitude of the GCM with respect to the SSM. The flexible coupling adapter 359 is angularly related in the pitching direction to the ATPM 342's vertical link 361 by the flexible coupling assembly 360, which accommodates GCM roll mode pivoting and the accompanying roll mode pivoting of the ATPM 342, which is thereto related by the ATPM pivot 341.

Figure 23:
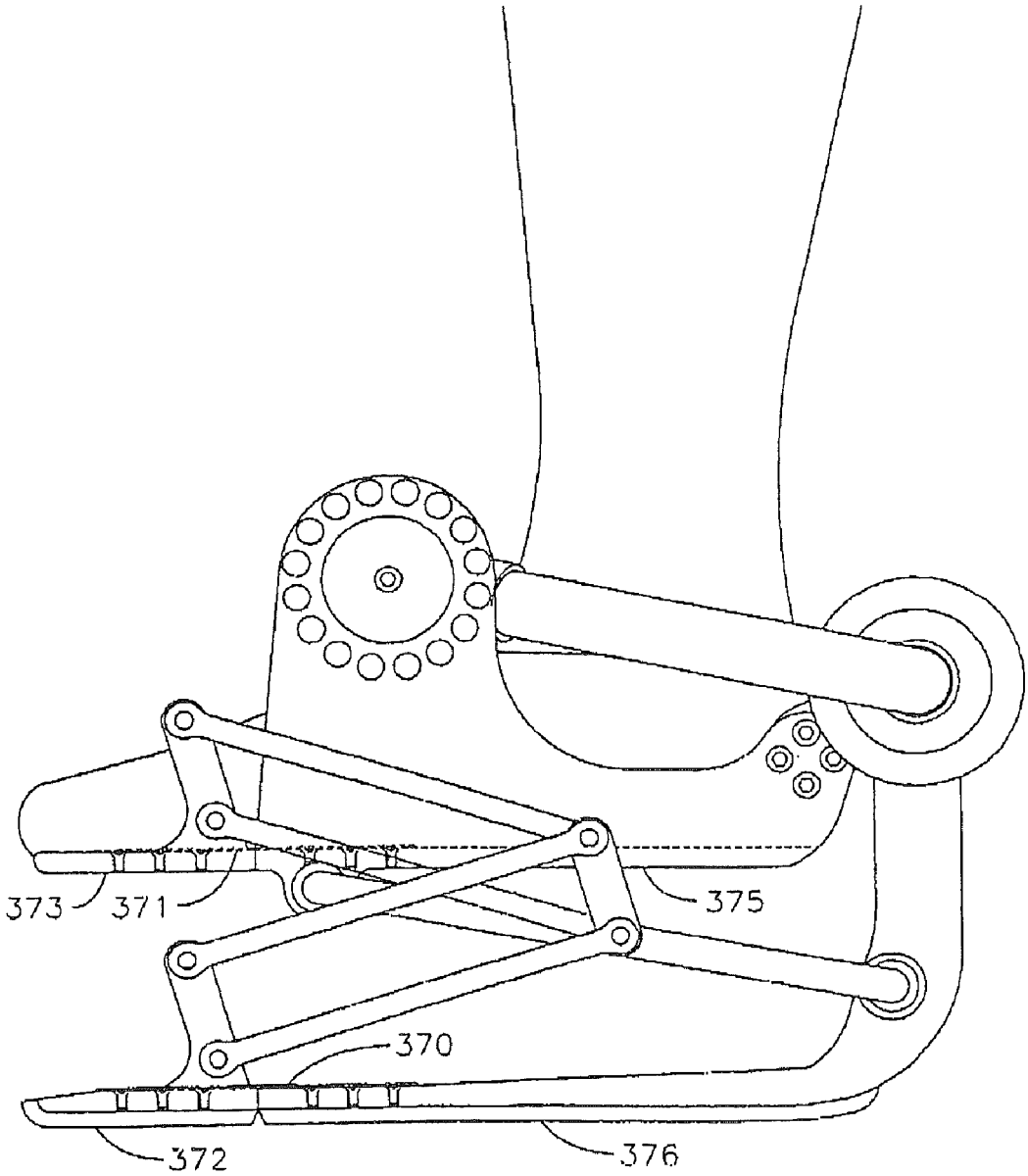
FIG. 23 is a schematic side view illustration of the application of leaf spring type pivot bearings to the ground contact member's articulating toe pressure member and the shoe sole member's angularly mobile toe support member in accordance with the present invention.

FIG. 23 is a schematic illustration of apparatus similar to the apparatus 340 of FIG. 22, but having bending membrane leaf spring pivots for both the ATPM 372 and the AMTSM 373. The leaf spring member 370 is fixedly associated with both the GCM 376 and the ATPM 372, and by elastic bending allows articulation or rotation of the latter with respect to the former. The leaf spring member 371 is fixedly associated with both the SSM 375 and the AMTSM 373, and by elastic bending allows articulation or rotation of the latter with respect to the former.

Figure 24:
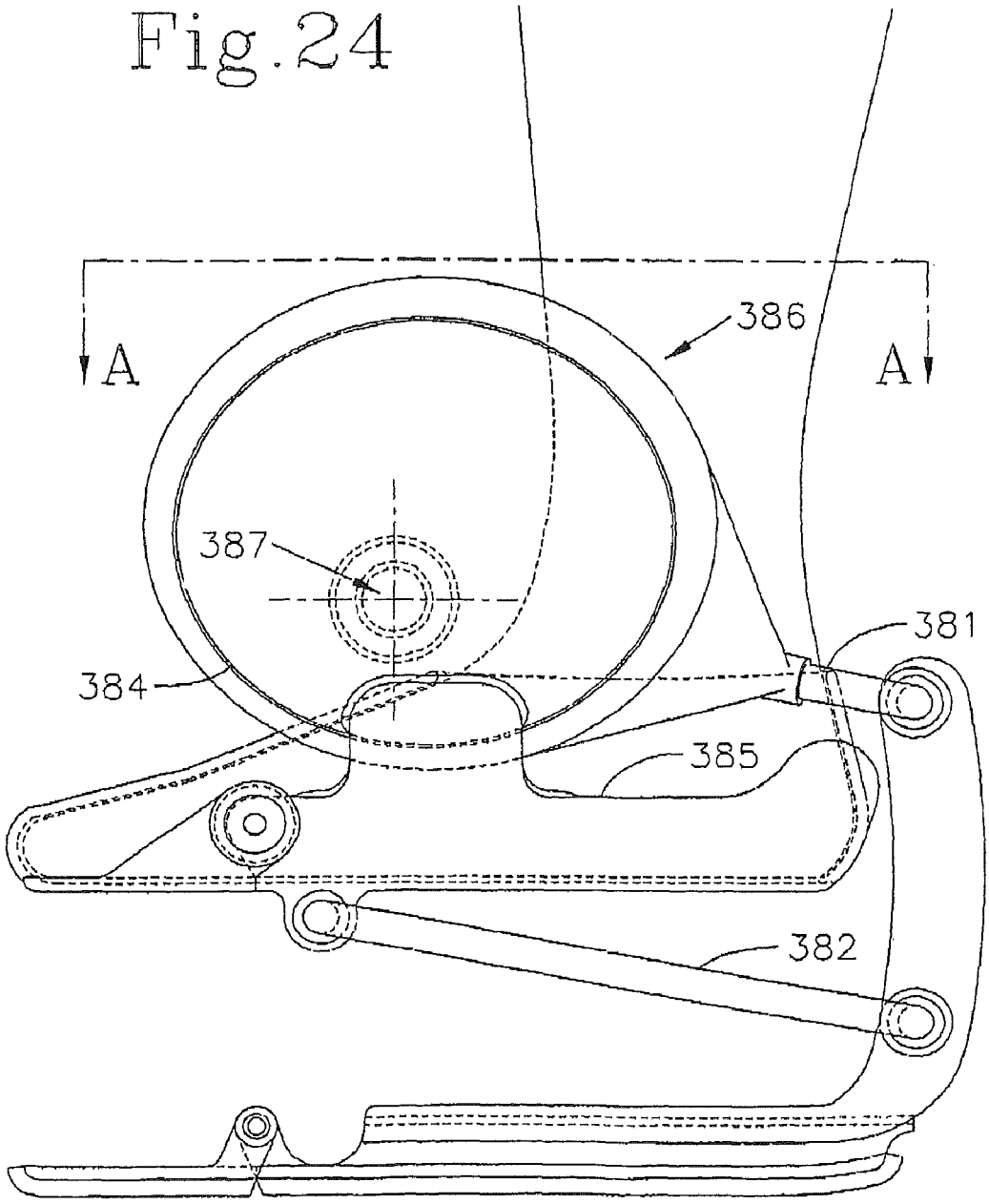
FIG. 24 is a schematic illustration of an alternative configuration elastomeric torsion spring in accordance with the present invention.

FIG. 24 is a schematic representation of moderate travel FBL-controlled Full Suspension Footwear similar to previous illustrations, but having the upper ETS pivot 386 of the SSM 385 enlarged to carry the majority of the resilient urging duties for reduction of unsprung weight. The enlarged disc region of ETS 386 is modified radially in the regions of the plane of the SSM 385 from constancy with respect to the pivot axis 387 for operating clearance to the lower link 382 and the AMTSM where parallelism control apparatus might make space claim. These departures from axisymmetry of the outer boundary of the ETS 386's disc region are permitted, if not ideal, constructions for such a disc region in the effort to increase torsional spring rate of the ETS 386. The outer disc flange 384 comprising the ETS 386's inner torque transmitting member is attached, in this example, to an abbreviated sidewall upward extension member of the SSM 385. The upper longitudinal pivot link 381 preferably connects outer torque transmitting member 388 of ETS pivot 386 to a lightweight compact upper mobile frame member pivot of high axis alignment rigidity.

Figure 24A:
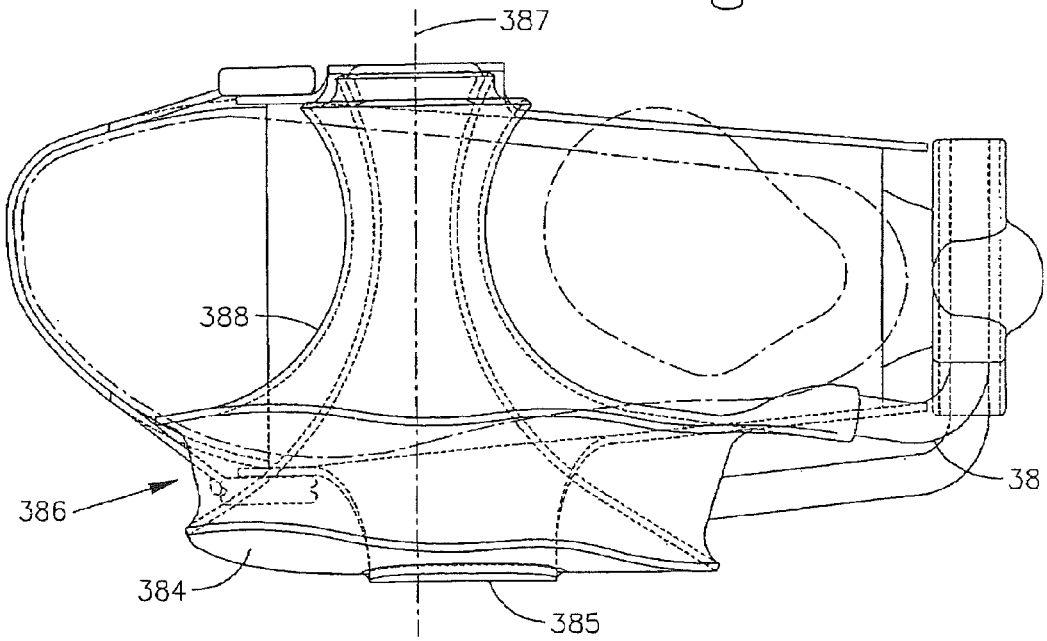
FIG. 24A is a schematic top view of the apparatus of FIG. 24.

In FIG. 24A, a top view of this special construction ETS pivot 386 reveals axial undulations of the disc region of the ETS pivot 386, wherein non-linearity of torsional spring rate may be augmented. The disc region flanges of the inner torque transmitting member 384 and the outer torque transmitting member 388 form substantially uniform elastomer section widths at any given radius about pivot centerline 387, but the axial undulations give rise to compressive stresses in the elastomeric section with torsional relative motion, contributing to the non-linearity of the spring rate. This disc region undulation is not the first preference for creation of non-linearity because of the relatively more flexible nature inherent to structure of the torque transmitting member features in this region and the potential for axial displacement in response to compressive stresses in the case of such axial asymmetry as is here illustrated. The first preference for creation of non-linearity of spring rate is the previously-discussed departure from roundness, such as illustrated in FIG. 13A, because of the inherent radial stiffness of such sections.

Figure 25:
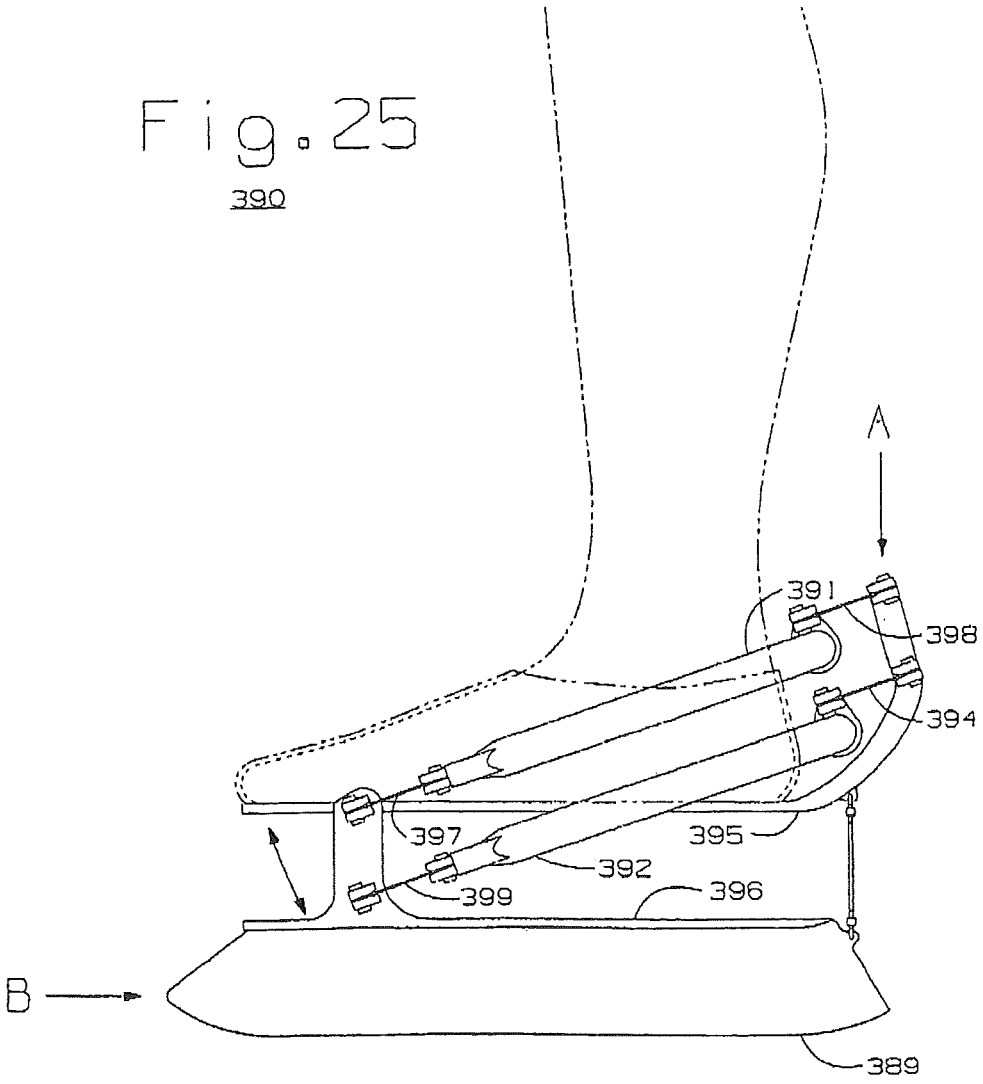
FIG. 25 is a schematic side view illustration of the use of leaf-type four-bar linkage pivot springs in accordance with the present invention.

FIG. 25 illustrates schematically an apparatus 390, a moderate travel FBL-controlled Full Suspension Footwear embodiment with a GCM 396 having an ice skate blade member 389 and leaf spring type pivots 397, 398, 394, and 399. The stationary pivots 398 and 394 are in this case at the rear, with the mobile pivots 397 and 399 in the metatarsal region. The upper and lower longitudinal links 391 and 392 connect the GCM 396 to the SSM 395 by means of the leaf spring pivots, which alternatively may themselves comprise the longitudinal links.

Figure 25A:
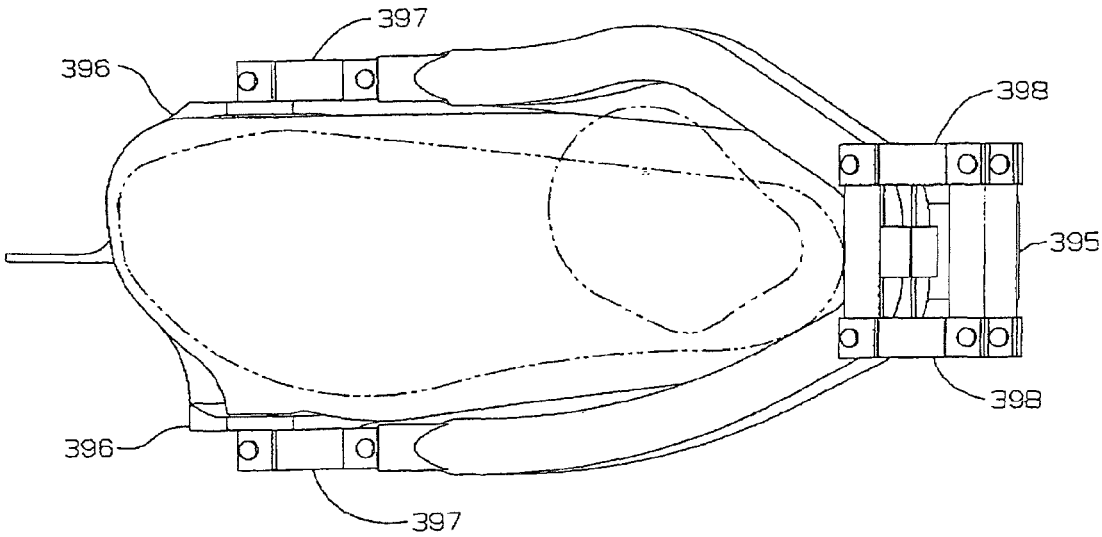
FIG. 25A is a schematic top view illustration of the apparatus of FIG. 25.

FIG. 25A shows a schematic top view illustration of the apparatus 390 of FIG. 25. A rearward extension of the SSM 395 is shown to anchor the visible upper rear pivots 398 behind the longitudinal links, but alternatively the links may be lengthened to wrap around at the rear of the leaf spring pivots 398 to reduce link angulations.

Figure 25B:
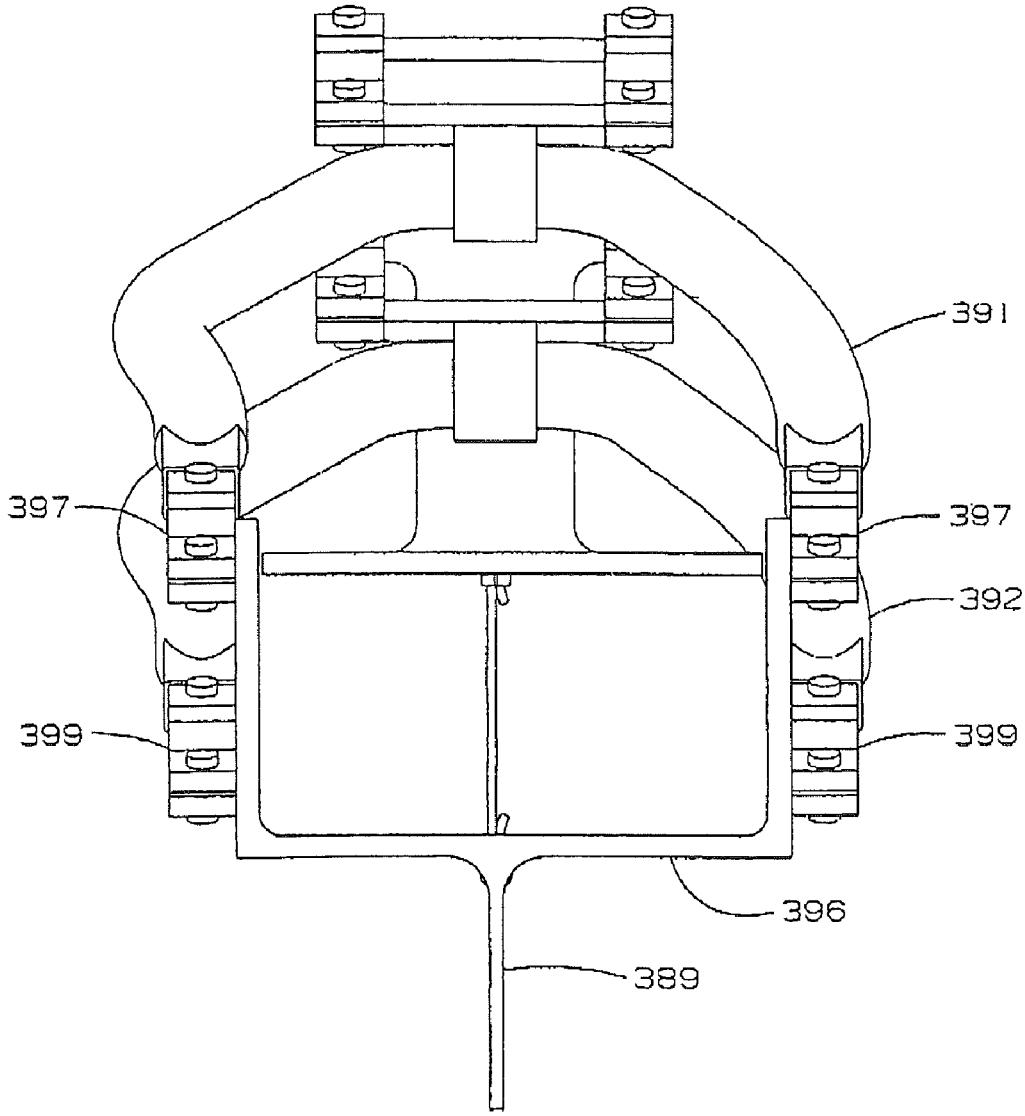
FIG. 25B is a schematic frontal illustration of the apparatus of FIG. 25.

FIG. 25B is a schematic frontal illustration of the apparatus 390 of FIG. 25. The upper pivot link 391 extends rearward from the upper forward leaf spring pivots 397, and the lower pivot link 392 extends rearward from the lower forward leaf spring pivots 399. The forward leaf spring pivots 397 and 399 are fixedly associated with upward sidewall extensions of the GCM 396, which also comprises the ice skate blade member 389.

Figure 26:
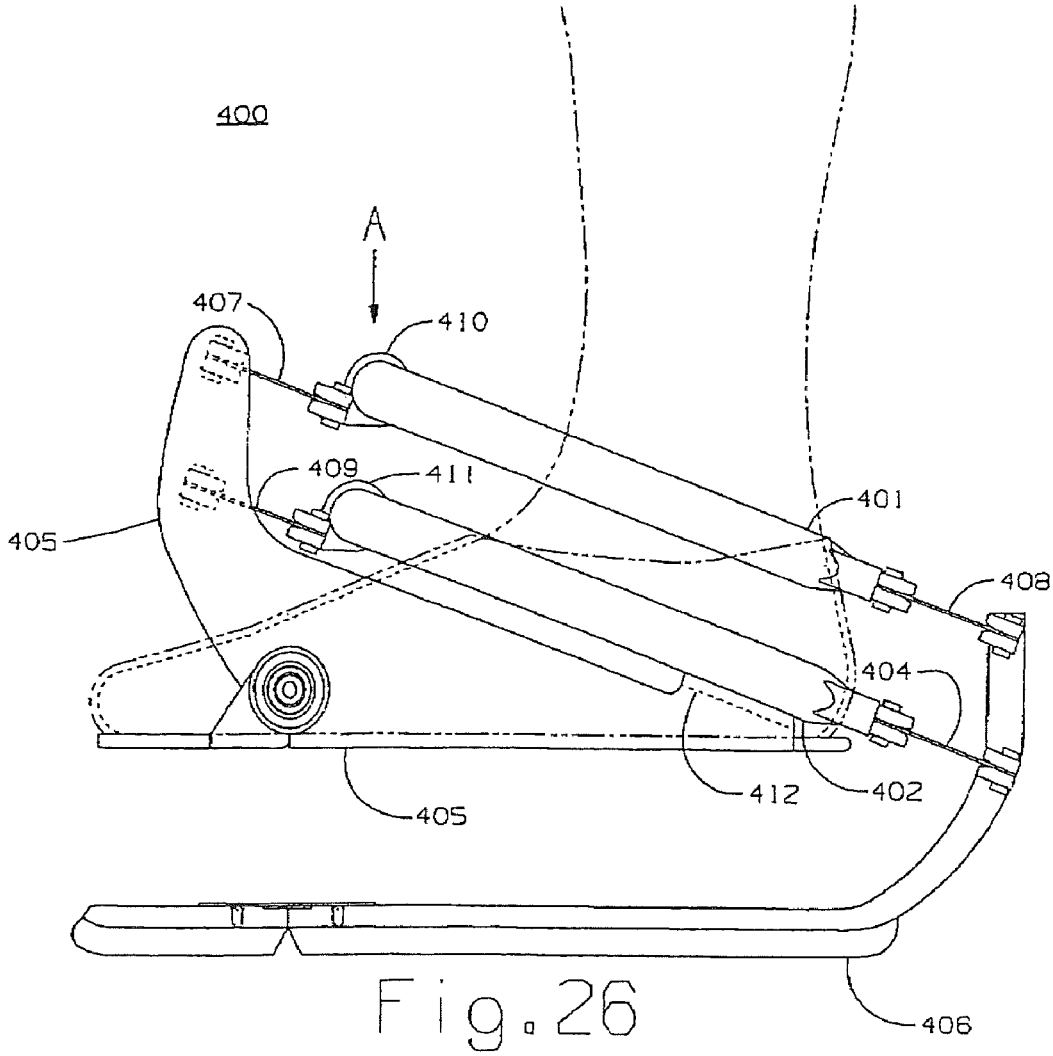
FIG. 26 is a schematic illustration of an alternative configuration using leaf-type four-bar linkage pivot springs in accordance with the present invention.

FIG. 26 is a schematic illustration of the FBL type moderate travel Full Suspension Footwear apparatus 400, which also utilizes leaf spring type pivots in the more frequently illustrated stationary forward pivots FBL configuration. This embodiment avoids the width penalty, exacted at the widest portion of the user's foot, of the previous FIG. 25 embodiment because it does not require sidewall upward extensions with pivot links to be packaged outside the SSM in this widest region. This width advantage comes at penalty of the reduced spacing between the stationary leaf springs 407 and 409, which are now located inboard of the sidewall upward extensions of the SSM 405. The pivot adaptors 410 and 411 preferably connect longitudinal links 401 and 402 to the forward leaf spring type pivots 407 and 409 above the instep/metatarsal region of the user's foot in this embodiment. The rear FBL pivots 408 and 404 connect the longitudinal links 401 and 402 to GCM mobile frame member 406.

Figure 26A:
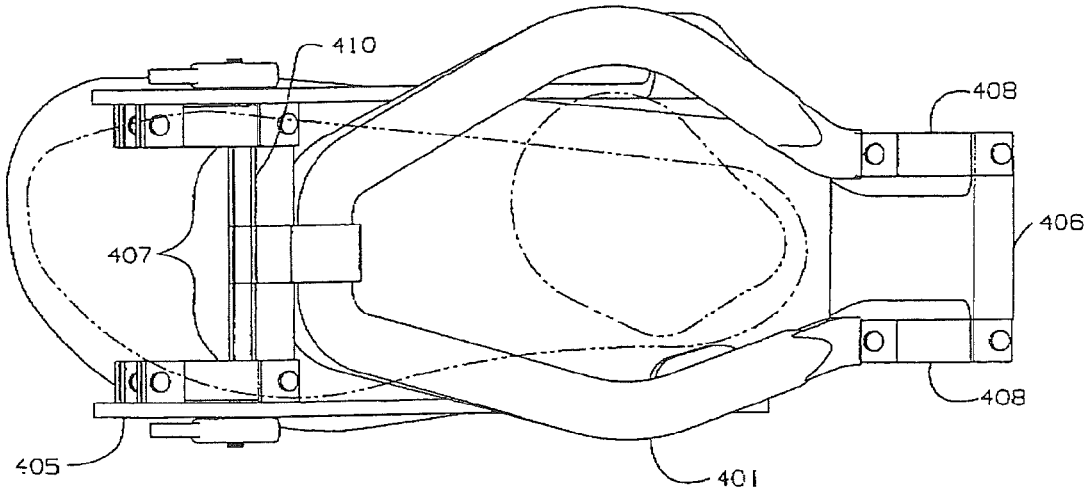
FIG. 26A is a schematic top view illustration of the apparatus of FIG. 26.

FIG. 26A clarifies the more inboard packaging of the forward pivots 407 between the sidewall upward extensions of the SSM405, with metatarsal region width penalty avoidance.

Figure 27:
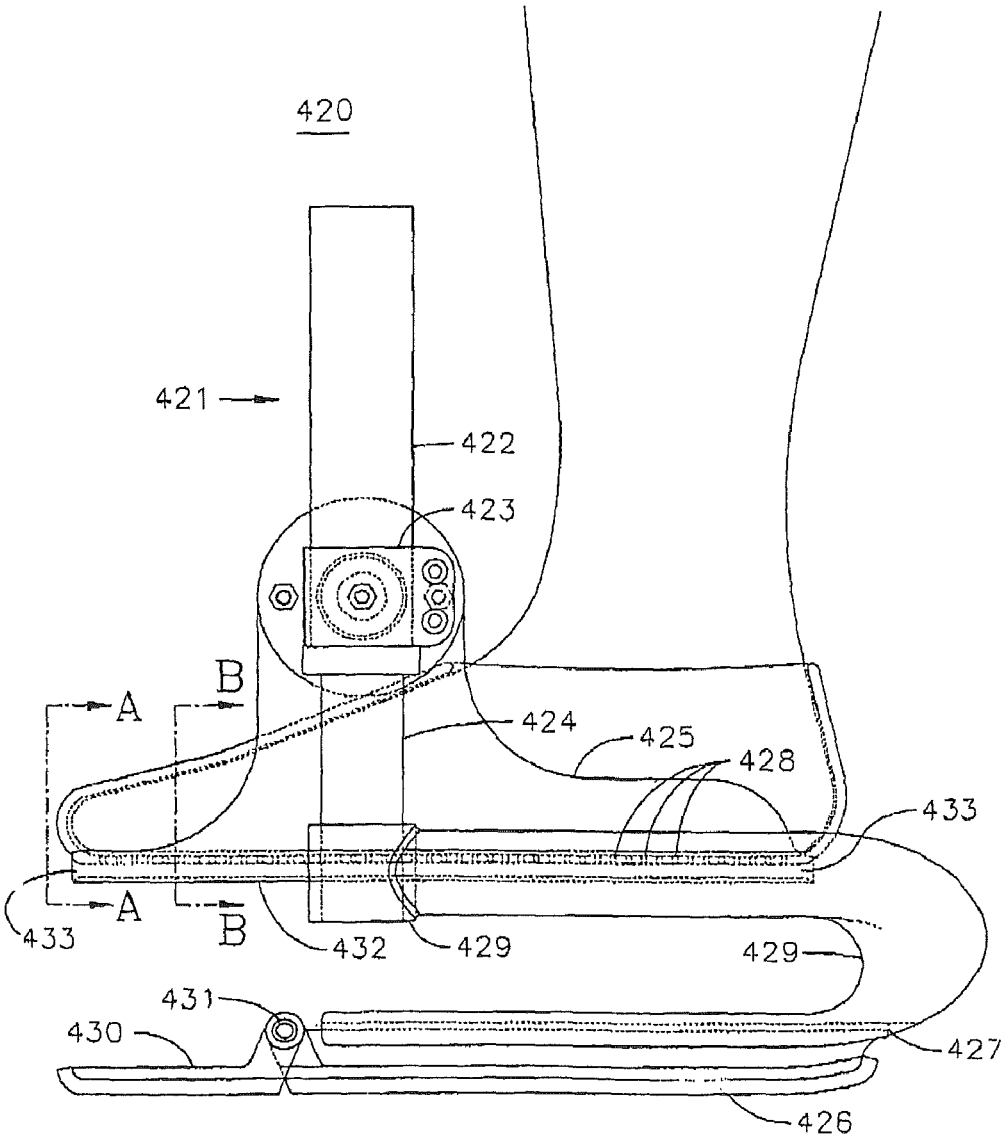
FIG. 27 is a schematic side view illustration of a linear bearing member assembly-controlled ground contact member in accordance with a preferred air-cooled embodiment of the present invention.

FIG. 27 is a schematic illustration of the $2^{nd}$ preferred embodiment for the motion control of inventive moderate travel functionality. Full Suspension Footwear apparatus 420 utilizes an LBMA 421 for motion control of a mobile frame member 429 which mounts the GCM 426 with roll mode pivoting and resilient urging back to parallelism with the plane of the SSM 425 by means of the ETS pivot 427. The GCM 426 preferably incorporates an ATPM 430 that pivots with resilient urging towards parallelism with the lower, treading, surface of the GCM 426 on the preferably ETS pivot 431. The LBMA 421 preferably comprises an outer housing 422 that is secured to the SSM 425 by a mounting clamp 423, and an extension member 424 which translates within the outer housing 422 on linear bearings between a first position and a second position with resilient urging. The mobile frame member 429 is fixedly associated with the extension member 424 such that it has single degree of freedom, namely translation in direction normal to the plane of the SSM 425, and it extends to and from the rear of the SSM 425 in order to not compromise roll mode rotational freedom of the GCM 426 in extended positions, and/or fully compressed proximity of the SSM 425 to the treading surface, by the necessarily added height of sideways structural connections in support of the preferably ETS roll mode pivot 427.

The SSM 425 also preferably comprises air guide passages 433 that extend between and communicate with openings at the front and rear of the SSM to promote ventilation. The upper walls of the air guide passages 433 preferably form the plane of the SSM 425, and are preferably perforated with breathing orifices 428 which enable heat and moisture to be transferred from the sole of the user's foot according to a preferred embodiment of the invention.

Figure 27A:
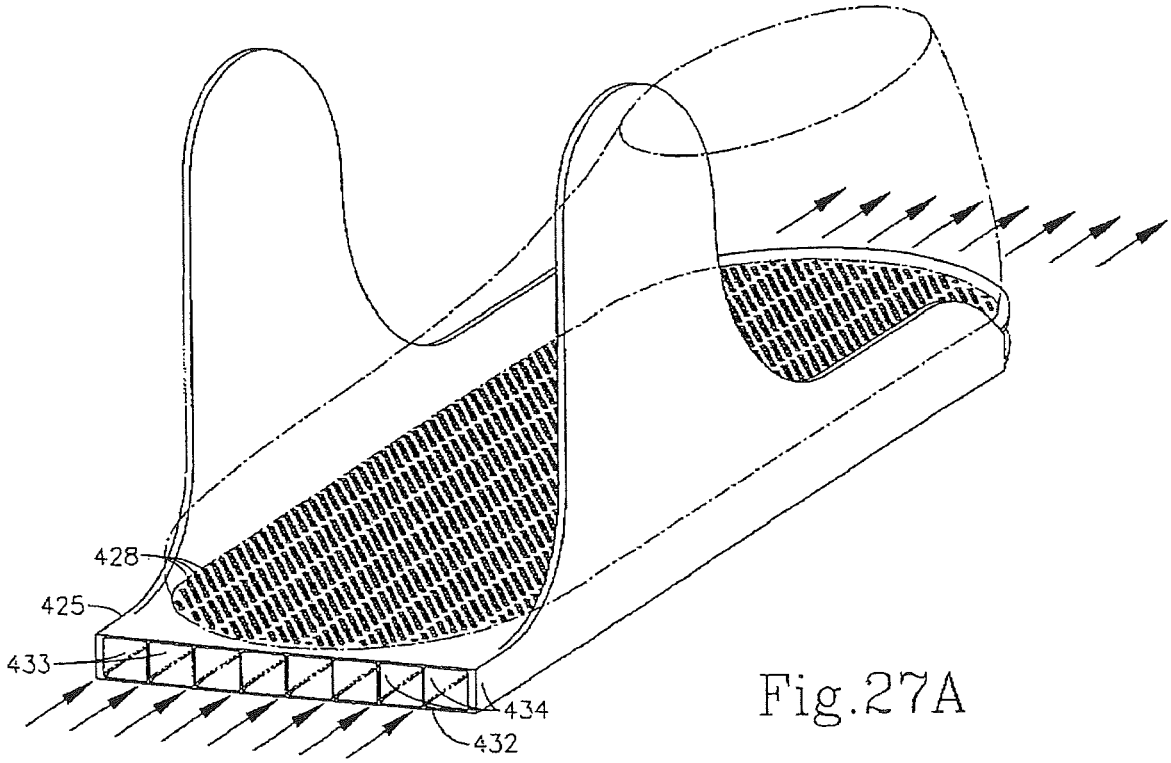
FIG. 27A is a schematic isometric illustration of the air cooling sole support structures of the apparatus of FIG. 27.

FIG. 27A is an isometric schematic view of the air guide passages with perforated upper walls as is useful for cooling and drying a user's foot to enhance comfort and reduce buildup of potentially deleterious moisture during use according to an advantage of the invention. The air guide passages 433 are formed by side walls 434 which connect the SSM 425 upper walls with a lower wall 432. A single air guide passage having orifices 428 in its upper wall operably fulfills the intent of the invention, but preferably a plurality of adjacent, side-by-side air guide passage is employed for structural stiffness of the SSM 425.

Figure 27B:
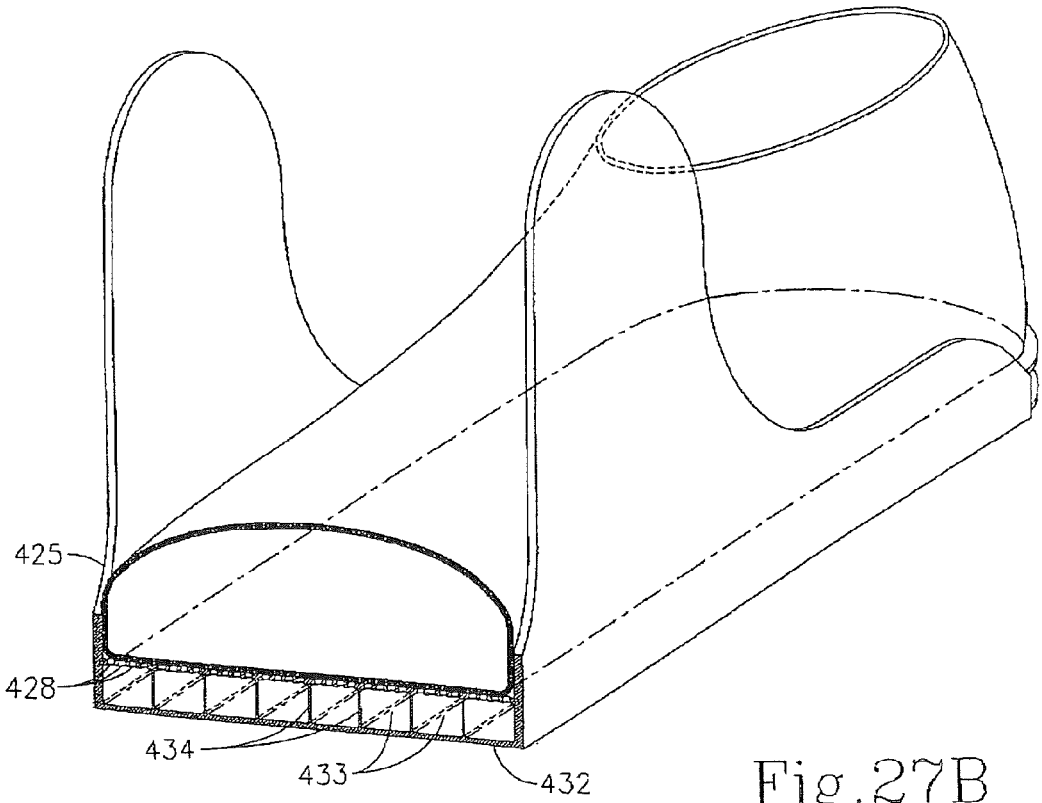
FIG. 27B is a schematic cross sectional illustration of the air guide channels of the air cooling sole support structures of the apparatus of FIG. 27.

FIG. 27B is a schematic cross-sectional view that further illustrates the inventive air cooling passages. In addition to features noted above, a porous insole of a foot-enclosing shoe member is preferably situated immediately above the orifices 428 of the upper walls of the air guide passages. This preferred porous insole 434 may be an integral part of the foot-enclosing shoe member or a separate insert, depending on designer preference. The porous insole 434 acts to bridge the perforations 428 of the upper wall while "breathing" with foot motion to facilitate moisture and heat transfer away from the user's foot.

Figure 28:
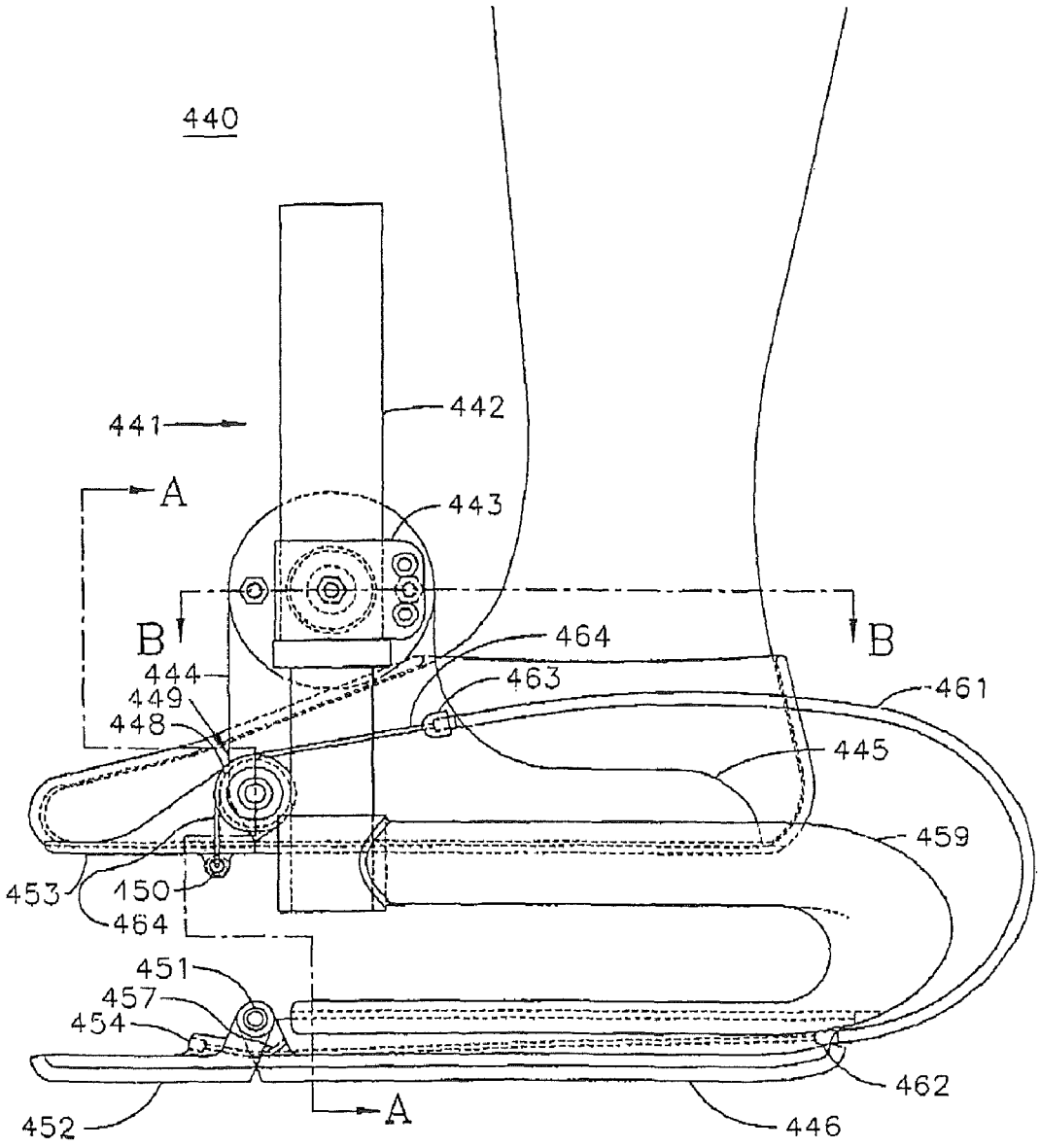
FIG. 28 is a schematic side view illustration of a linear bearing member assembly-controlled ground contact member in accordance with a preferred embodiment of the present invention having control cable motion control for parallelism between the ground contact member's articulating toe pressure member and the shoe sole member's angularly mobile toe support member.

FIG. 28 is a schematic illustration of the apparatus 440 preferred embodiment which is similar to the apparatus 420 in FIG. 27. Additionally shown are the AMTSM 453, which pivots on ANTSM pivot bearings 449, and a flexible sheath type control cable embodiment for the inventive parallelism control between the ATPM 452, which pivots on the preferably ETS pivot 451, and the AMTSM 453 which pivots on preferably sealed single row ball bearing pivots 449. A first end 454 of cable 464 is anchored to the ATPM 452 by a receptacle with FOSCR pulley detail 457 of the ATPM 452's fixed associativity with the preferably ETS pivot bearing 451 so that lifting of the ATPM 452 results in tensile translation motion in the cable 464. The cable 464 extends rearward to enter a flexible coiled compression sheath 461, whose end is fixedly associated with a receptacle 462 of the GCM 446. The flexible coiled compression sheath 461's other end is received in a receptacle 463 of the SSM 445, from which emerges the cable 464, which extends to a FOSCR pulley detail 448 of the AMTSM 453 that holds the cable 464 radially displaced from, and above, the pivot bearing 449's pivot axis to perform the pulley functionality of converting translation into rotation as a result of the cable 464's fixed associativity with the AMTSM 453 through an adjuster receptacle 450.

Lifting of the ATPM 452 thus pulls and causes translation of the cable 464 within the sheath 461, concurrently lifting the AMTSM 453.

Figure 28A:
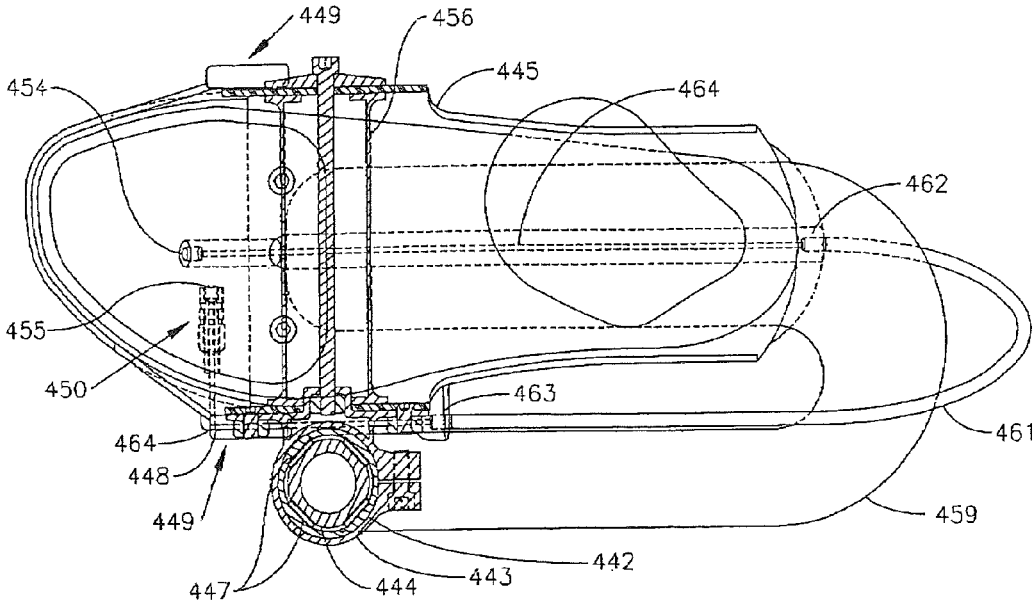
FIG. 28A is a schematic top view illustration of the apparatus of FIG. 28.

FIG. 28A is a schematic top view cross-sectional illustration of the LBMA apparatus 440 which further details preferred embodiment features. The LBMA outer housing 442 is secured by the mounting clamp 443 to the sidewall upward extensions of the SSM 445, with structural rigidity augmented by a bridge tube 456. The extension member 444 translates within the outer housing 442 on a plurality of roller bearing members 447 which by construction prevent yaw mode rotation of the mobile frame member 459 and the GCM 446 with respect to the SSM 445. The enlarged first end 454 of the cable 464 is preferably centrally located within the ATPM 452 so as to be able to pass through a central channel of the GCM 446 for location stability of the receptacle 462 and the control cable sheath 461 amidst roll mode pivoting of the GCM 446. The cable 464 is located by FOSCR groove 448 as it wraps around the pivot bearing 449 on its way to the adjuster receptacle 450 which locates its enlarged second end 455 in fixed associativity with the AMTSM 453.

Figure 28B:
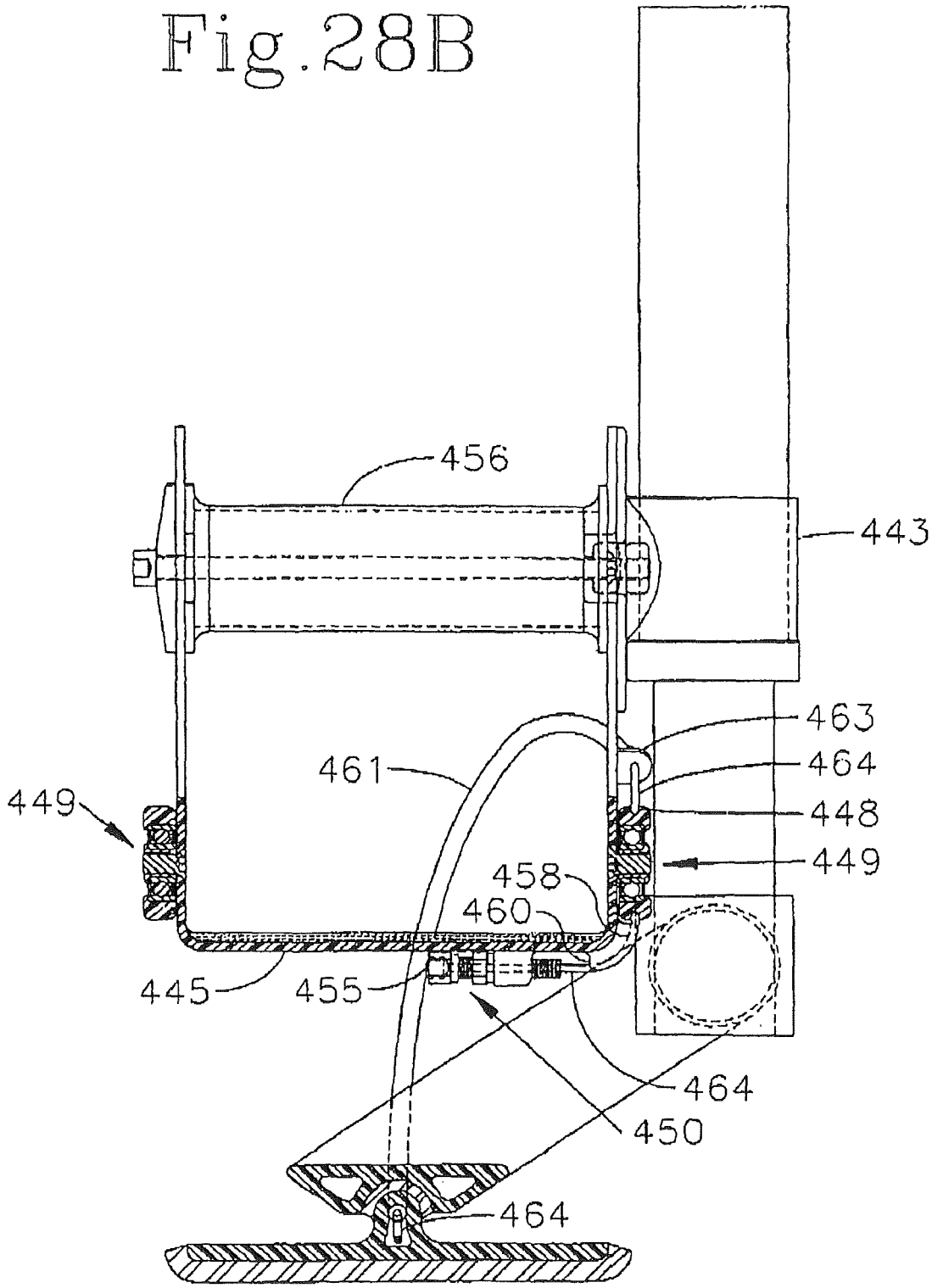
FIG. 28B is a schematic front view illustration of the apparatus of FIG. 28.

FIG. 28B is a schematic cross-sectional illustration of the apparatus 440 from the front. The bridging tube 456 distributes loading from the user's foot as applied to the SSM 445, and carried by the upward sidewall extensions of the SSM 445, to the mounting clamp 443 of the LBMA 441. The cable 464 passes through a central channel of the GCM 446, joins the sheath 461 and then emerges from the receptacle 463 to engage the groove 448 of the AMTSM pivot 449. The cable 464 is guided by a groove 458 of a guide 460 around the bottom of the AMTSM on its way to the adjuster receptacle 450.

Figure 29:
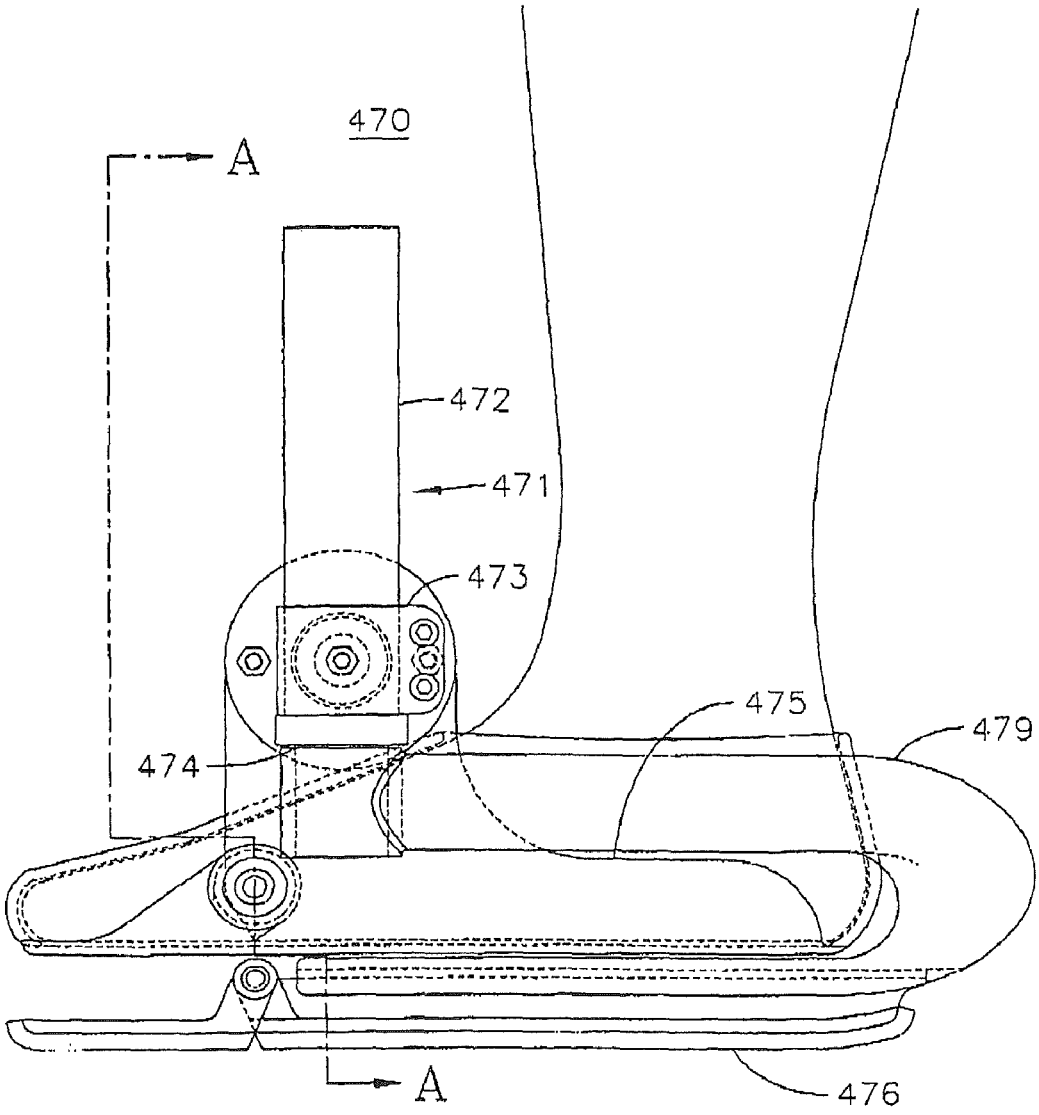
FIG. 29 is a schematic side view illustration of the FIG. 28 apparatus with ground contact member in fully retracted position.

FIG. 29 is a schematic illustration of an apparatus 470 that is similar to the apparatus 440 of FIG. 28, with the GCM 476, the extension member 474 of the LBMA 471, and the mobile frame member 479 that fixedly associates them in a retracted position that corresponds to full compression of resilient urging under peak vertical acceleration. The GCM 476 and the forward extension of the mobile frame member 479 nest in close proximity to the SSM 475, minimizing the height at all degrees of extension travel of the SSM 475 over the GCM 476.

Figure 29A:
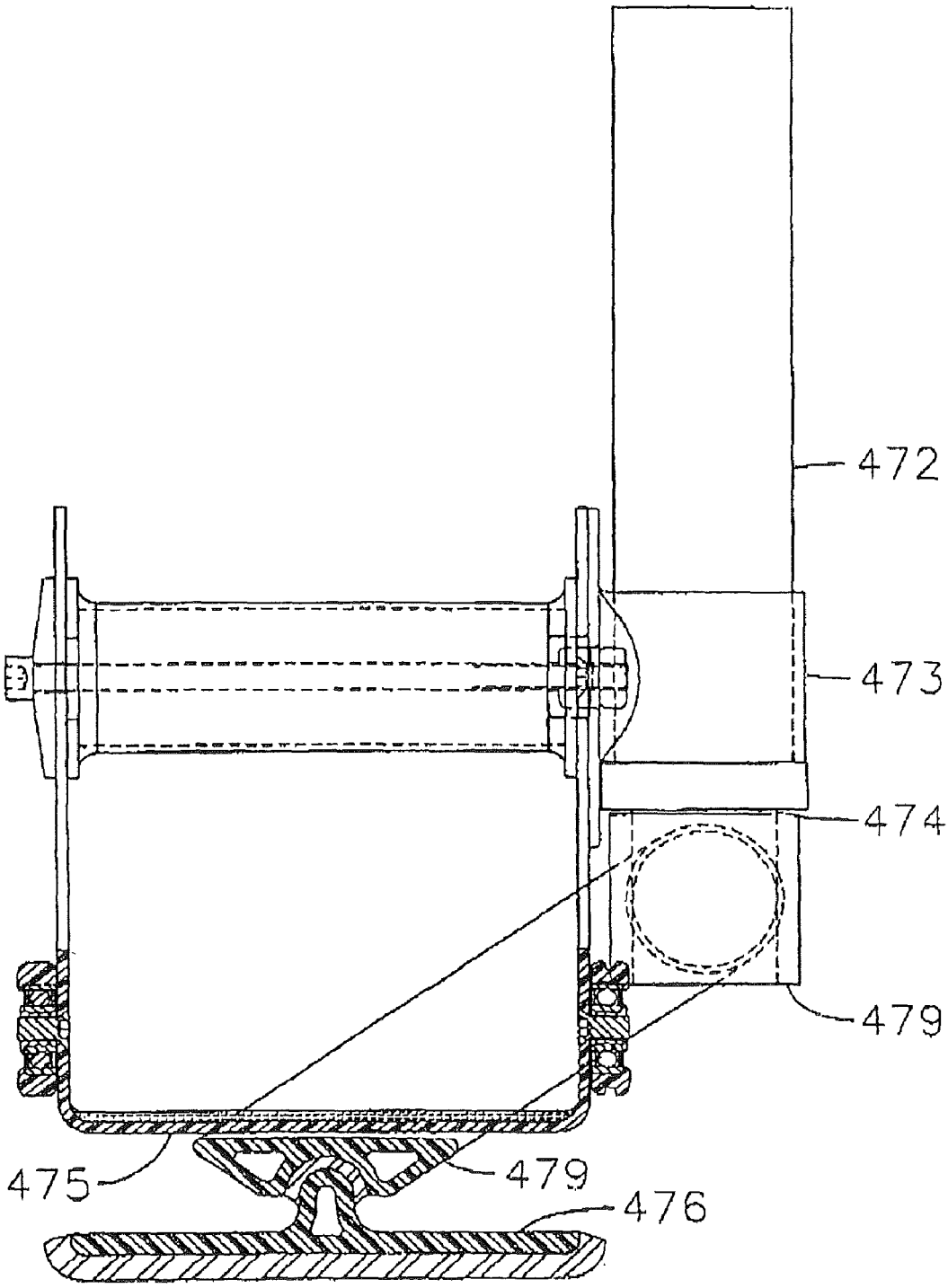
FIG. 29A is a schematic front view illustration of the FIG. 29 configuration.

FIG. 29A is a schematic cross-sectional illustration from the front of the apparatus 470 in its fully compressed position. The entry of the mobile frame member 479 from the rear of the SSM 475 facilitates the compactness or proximity of the GCM 476 to the SSM 475 in this position, concurrent with maximization of roll mode pivoting in extended positions, because out-the-side structural connection would necessarily either increase the height of this fully compressed position or limit roll mode travel freedom in extended positions, or both.

Figure 30:
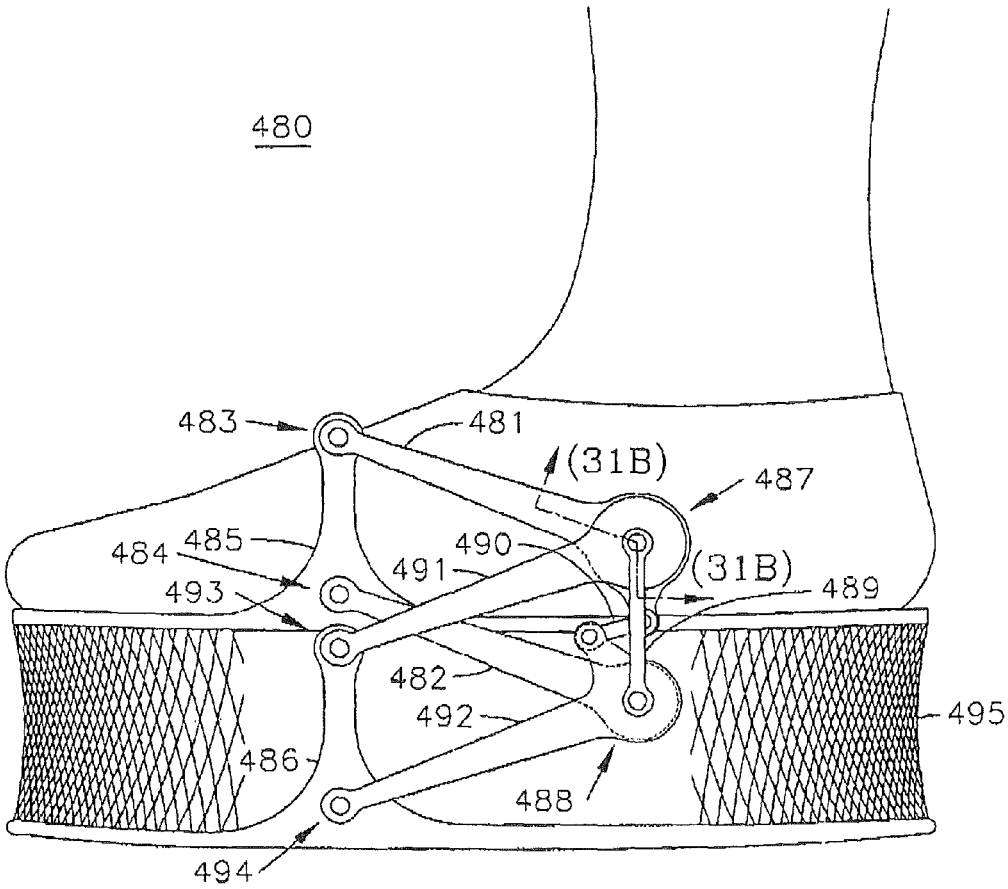
FIG. 30 is a schematic side view illustration of a conjugate conjoined four-bar linkage-controlled ground contact member in accordance with the present invention

FIG. 30 is a schematic illustration of a third embodiment of moderate travel Full Suspension Footwear motion control apparatus 480, conjugate conjoined four-bar linkages or CCFBLs, which may be substituted for an LBMA by virtue of providing LBMA functionality as discussed earlier. This embodiment is not considered preferred, because of its relatively greater complexity, but it serves to illustrate that the inventive functionality as defined for moderate extension travels may be achieved by a plurality of different structural arrangements that suffice the inventive functionality of normal-to-SSM motion control. In addition to the alternative motion control apparatus, this Figure illustrates inventive Full Suspension Footwear curtaining between GCM and SSM, engineered elasticity or leaf spring bending of GCM for ATPM pivot functionality, and optional, but not preferred, absence of GCM roll mode pivoting for structures other than the prior art Rennex "P-diamond" structure.

The motion control apparatus of this Figure includes FBL pivots 483 and 484 in substantially vertical array, fixedly associated to an SSM 485 and forming a first terminal link (485); FBL pivots 493 and 494 in substantially vertical array and with pivot spacing substantially identical to that of the pivots 483 and 484 of the first terminal link, fixedly associated to a GCM 486 and forming a second terminal link (486); a conjoining link 489 with pivots 486 and 487 also in substantially vertical array and with pivot spacing substantially identical to that of the pivots 483 and 484 of the first terminal link (485), substantially parallel upper longitudinal links 481 and 482 extending between the pivots of the first terminal link (485) and the conjoining link 489; substantially parallel lower longitudinal links 491 and 492 extending between the pivots of the conjoining link 489 and the second terminal link (486); and a conjugacy link 490 connecting pivots of AOLLs 481 and 492. The conjugacy link 490 assures mirrored angularity of the AOLLs with respect to the plane of their pivot axes as discussed previously, limiting the relative motion of the first and second terminal links (485) and (486), and the SSM 485 and the GCM 486 that comprise them, to linear translation, as is known. Resilient urging is preferably provided by ETS spring loading between adjacent links of a common conjoining link pivot, as illustrated in FIG. 31B but applicable also to the section defined in this Figure.

The curtain member 495 is provided to prevent foreign objects from entering the "mastication space" between the SSM 485 and the GCM 486, but is preferably also utilized as a travel stop for preloading of resilient urging. The GCM 486 preferably comprises engineered elasticity of the region forward of that corresponding to the metatarsals of the user's foot so that leaf spring action with resilient urging back to free state flatness of the GCM 486 provides ATPM functionality.

FIG. 31 is a schematic illustration of the first of four preferred embodiments for the provision of inventive extended travel motion control, an LBMA-guided extension member-mounted GCM with conjugate four-bar linkages (CFBLs) for resilient urging and pitching mode parallelism control. An apparatus 500 includes SBM 501, which is fixedly associated with the upper regions of the user's lower leg by a snugging strap 502, and which is fixedly associated with the user's foot by a TAPA bearing 503 which is in turn fixedly associated with an SSM 505 that includes a foot snugging strap 504. Two linear bearing member roller arrays 507 fixedly associated with the SBM 501 capture the preferably square corners of an extension member 508 of preferably football section extruded tube construction, constraining its motion to the defined single degree of freedom i.e. translation in shin direction. At the lower end of extension member 508 is the GCM 506, which pivots in pitching mode single degree of freedom on transverse axis pivot bearing 509.

The disclosed parallelism of the GCM 506 with the SSM 505 is provided by a previously disclosed CFBL motion control apparatus. The SSM 505 comprises pivots 515 and 516 in substantially vertical array, forming a first terminal link (505); the GCM 506 comprises pivots 519 and 520, in substantially vertical array and with substantially identical spacing as that of first terminal link (505), forming a second terminal link (506); a substantially vertical conjoining link 510 comprises pivots 517 and 518 in substantially identical spacing as that of first and second terminal links (505) and (506); substantially parallel upper longitudinal links 511 and 513 extend between the pivots of the first terminal link (505) and the conjoining link 510; substantially parallel lower longitudinal links 512 and 514 extend between the pivots of the conjoining link 510 and the second terminal link (506). The adjacent angularly opposed links comprising each individual conjoining link pivot location are preferably resiliently urged torsionally by preferably ETS pivots as illustrated in FIG. 31B. Additional resilient urging, to "fine tune" vertical spring rate for specific usages is preferably provided by elastomeric tensile members (not shown) which are stretched by upward motion of the extension member 508 and the GCM 506, being preferably anchored between the upper end of the extension member and the lower end of the SBM.

Figure 31A:
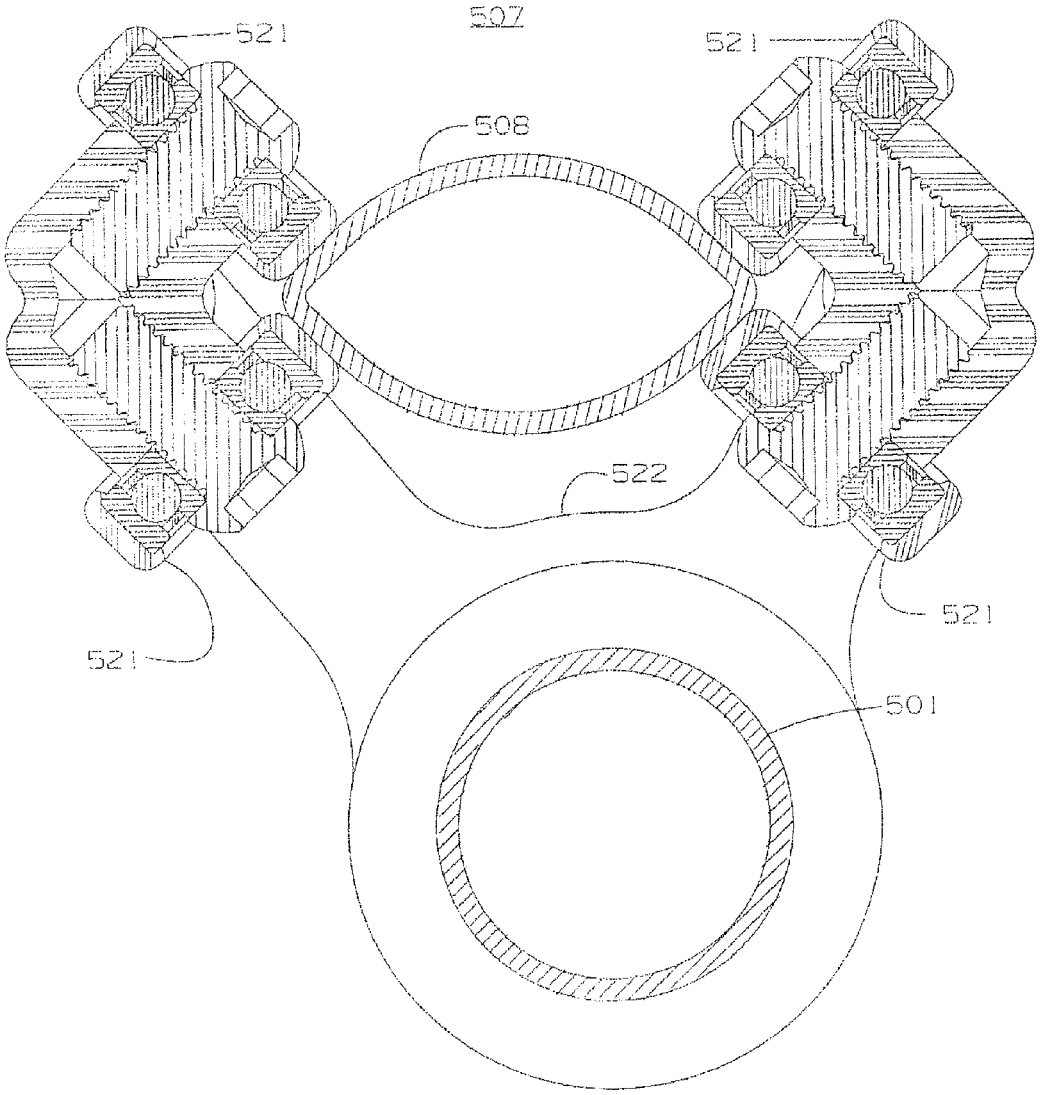
FIG. 31A is a schematic cross-sectional illustration of one of two linear bearing member roller arrays used for translational motion control of the ground contact member in the FIG. 31 apparatus.

FIG. 31A is a schematic cross-sectional illustration of one of the two linear bearing member roller arrays 507 fixedly associated with the SBM 501 capturing the preferably square corners of an extension member 508 of preferably football section extruded tube construction, in order to constrain its motion to the defined single degree of freedom i.e. translation in shin direction. The rollers 521 preferably comprise small sealed single deep groove ball bearings such as the 8-22-7"608" bearing used for roller blade wheels, with their outside diameters captured by a bonded-in-place and machine trued HDPE "tread" layer for silence of operation and freedom from wear. A roller frame 522 is configured to maintain the light preload between the rollers 521 and the extension member 508.

FIG. 31B is a schematic cross-sectional illustration of a conjoining link pivot where resilient urging between adjacent links is provided by a preferred axially compact ETS configuration is adapted from best practice prior art mold bonded hybrid spring transition regions and disc regions. This illustration also applies, by parenthetical link numbers, to the pivot 487 of FIG. 30, having section lines identified "31B-31B". The longitudinal pivot link 513, from the SSM 505, and the adjacent longitudinal pivot link 512, from the GCM 506, are shown in section with conjoining link 510; resilient urging between the SSM and the GCM is preferably provided by the resilient urging of a torsional spring rate about the pivot axis between the longitudinal links connecting the SSM to the GCM, which acts to separate the GCM from the SSM without influence on pitching mode parallelism control by the CFBL. Conjoining link pivots 517 and 518 preferably share the task of resilient urging. The conjoining link 510 preferably utilizes small sealed ball bearings to locate the axis of pivot 518 accurately and with freedom from wear or noise emissions. The upper longitudinal pivot link 513 is preferably coplanar with the lower longitudinal pivot link 514 beyond the radius where they must overlap. The preferred ETS resilient urging between adjacent longitudinal links 513 and 514 results from shear stresses across the section of the elastomer section 523, which is preferably post-vulcanization bonded to a radially outer torque transfer member 525 and a radially inner torque transfer member formed as the rigid connection of ETS housing features of the pivot link 513 with an ETS housing extension 524. It will be readily recognized that the radially outer torque transfer member 525, which is fixedly associated with the longitudinal pivot link 514, forms an elastomer boundary configuration that corresponds to the inertia member (or ring) 252 of the TVD 250 of FIG. 16, and that ETS housing members 513 and 524 form elastomer boundary configuration corresponding to the hub 251 of the same Figure.

Figure 31C:
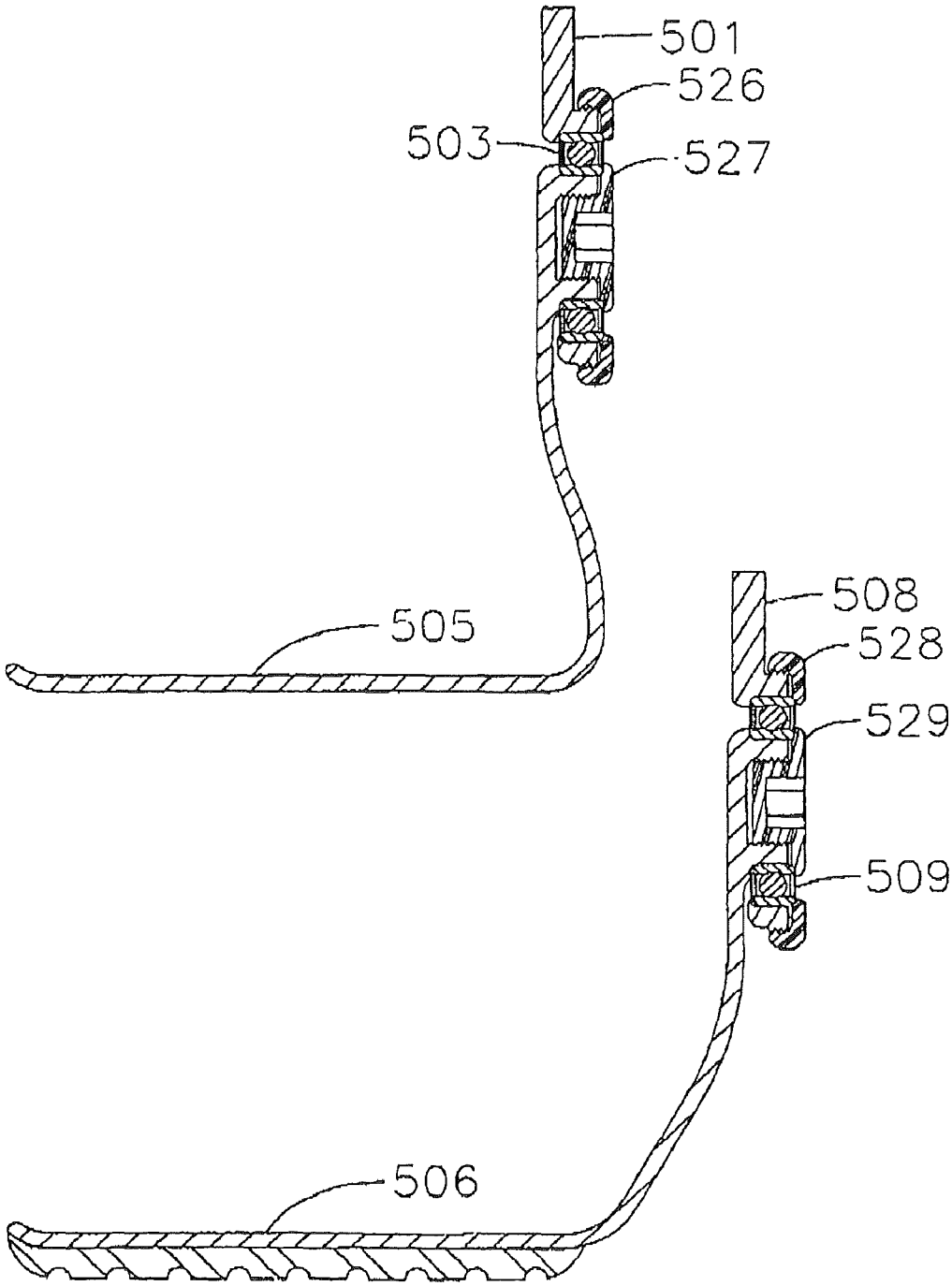
FIG. 31C is a schematic cross-sectional front view illustration of the ankle joint stabilizing bearing and the ground contact member pivot bearing of the FIG. 31 apparatus.

FIG. 31C is a schematic cross-sectional illustration of preferred configurations for the TAPA bearing 503 which connects the SBM 501 to the SSM 505, and the transverse axis pivot bearing 509 which connects the GCM 506 to the extension member 508. Sealed single row ball bearings having internal clearance specification and fitting practice that result in negative fitted internal clearance are preferably employed for both of these pivots 503 and 509, because of the high value offered by such commodities, namely freedom from wear, noise emissions, and high cost, while providing appropriately high values of overhung (or axis alignment maintaining) load capacity and narrow packaging space claim. The bearings are preferably secured on shouldered interference fit inner mounting diameters by shoulder screws 527 and 529, and in interference fit outer mounting diameters by shoulder nuts 526 and 528.

Figure 32:
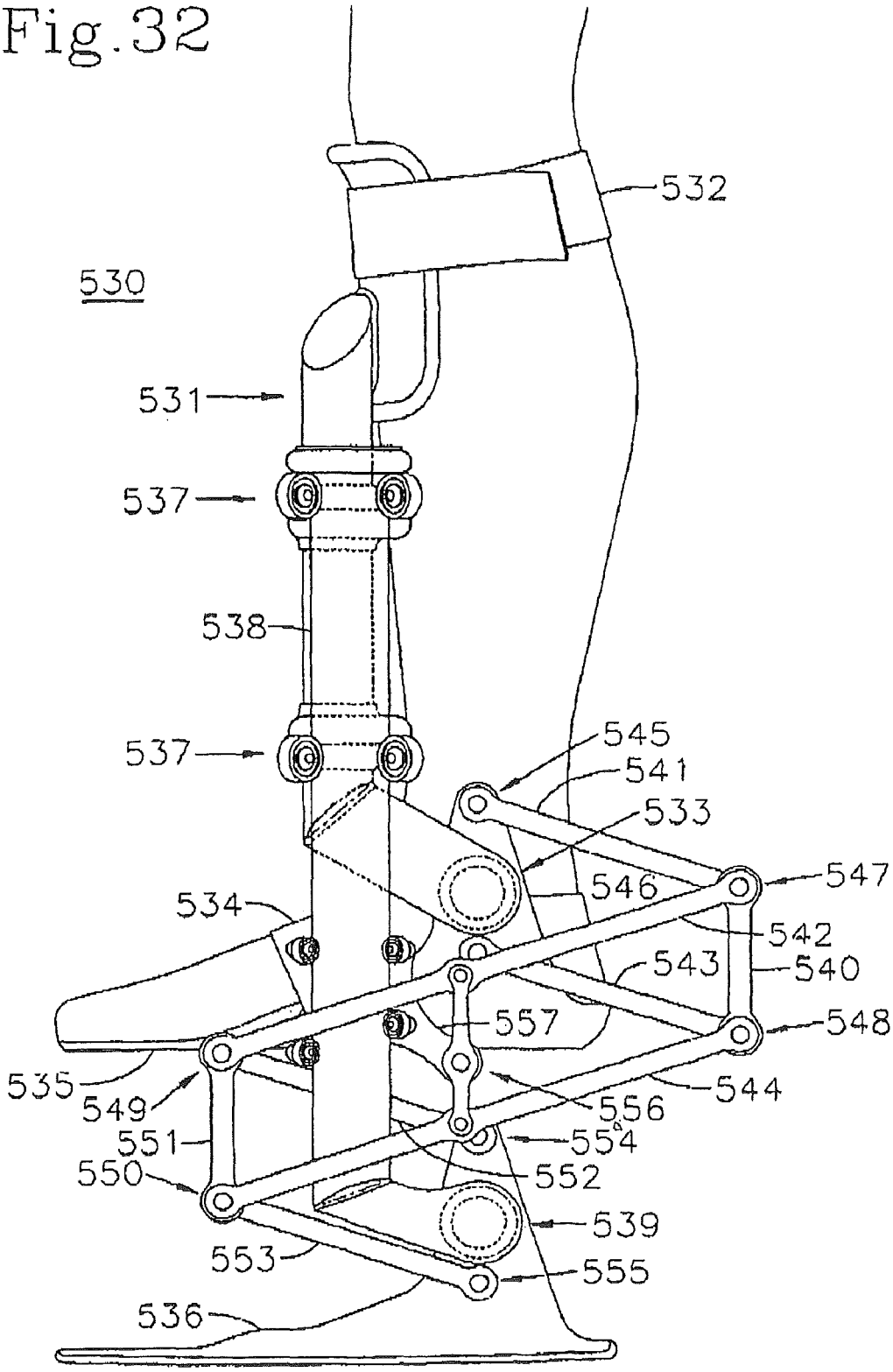
FIG. 32 is a schematic side view illustration of an extended travel embodiment of the present invention having conjoined triple four-bar linkage parallelism control between shoe sole member and ground contact member in accordance with a preferred embodiment of the present invention.

FIG. 32 is a schematic illustration of the second of four preferred embodiments for the provision of inventive extended travel motion control, an LBMA-guided extension member-mounted GCM with triple CFBLs for longitudinally compact resilient urging and pitching mode parallelism control. The apparatus 530 is similar in all respects to the apparatus 500 of FIG. 31 except that more longitudinally compact triple CFBLs are employed for control of the pitching mode parallelism control between the SSM 535 and the GCM 536. Accordingly, feature numbers 531 through 539 of the present illustration correspond to feature numbers 501 through 509 of FIG. 31, including its supplemental view figures, so the above detailed descriptions are here incorporated by reference for brevity.

The disclosed parallelism of the GCM 536 with the SSM 535 is provided by a previously disclosed triple CFBL motion control apparatus. The SSM 535 comprises pivots 545 and 546 in substantially vertical array, forming a first terminal link (535); the GCM 536 comprises pivots 554 and 555, in substantially vertical array and with substantially identical spacing as that of first terminal link (535), forming a second terminal link (536); a substantially vertical first conjoining link 540 comprises pivots 547 and 548 in substantially identical spacing as that of first and second terminal links (535) and (536), and a substantially vertical second conjoining link 551 comprises pivots 549 and 550 in substantially identical spacing as the others; substantially parallel upper longitudinal links 541 and 543 extend between the pivots of the first terminal link (535) and the first conjoining link 540; substantially parallel lower longitudinal links 552 and 553 extend between the pivots of the second conjoining link 551 and the second terminal link (536). Extending between the pivots of the first and second conjoining links 540 and 551 are substantially parallel middle longitudinal links 542 and 544, one of which (the lower, 544 in this example) is constrained longitudinally by comprising a slider pivot 556 that, by means of a roller carriage 557 in substantially shin direction translational communication with the extension member 538, provides longitudinal location stability to the middle FBL while allowing its vertical motion with respect to the SSM pivot 533 that accompanies shin-wise translation of the GCM 536. Resilient urging is preferably by means of ETS torsion distributed among the four conjoining link pivots as detailed previously, but may alternatively be any known means of resilient urging.

Figure 33:
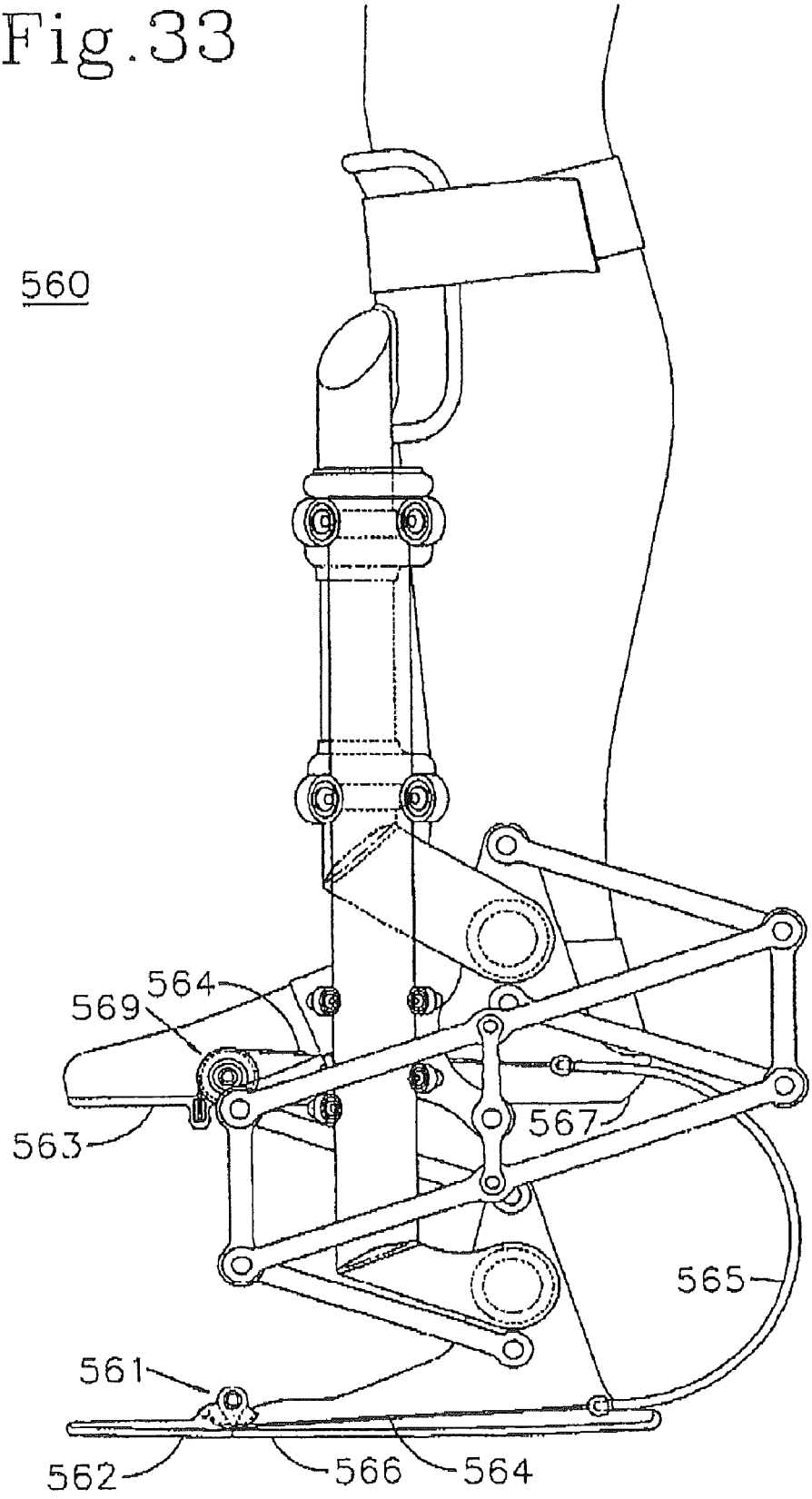
FIG. 33 is a schematic side view illustration of an extended travel embodiment of the present invention having conjoined triple four-bar linkage parallelism control between shoe sole member and ground contact member, and cable-controlled parallelism between angularly mobile toe support member and articulating toe pressure member in accordance with a preferred embodiment of the present invention.

FIG. 33 is a schematic illustration of an apparatus 560, identical to the apparatus 530 of FIG. 32 except for the incorporation of ATPM and AMTSM with parallelism control according to a preferred embodiment of extended travel Full Suspension Footwear functionality. An ATPM 562 is rotationally associated with the GCM 566 by means of a pivot 561, and an AMTSM is rotationally associated with the SSM 565 by pivots 569 preferably on either side of the users foot; sheathed control cable 564 and 565, similar to that of FIG. 28 whose descriptions are herein incorporated by reference, operates to lift the AMTSM 563 when the ATPM 562 is rotated with respect to the GCM 566 by forward angulations of the GCM 566 with respect to the treading surface.

Figure 34:
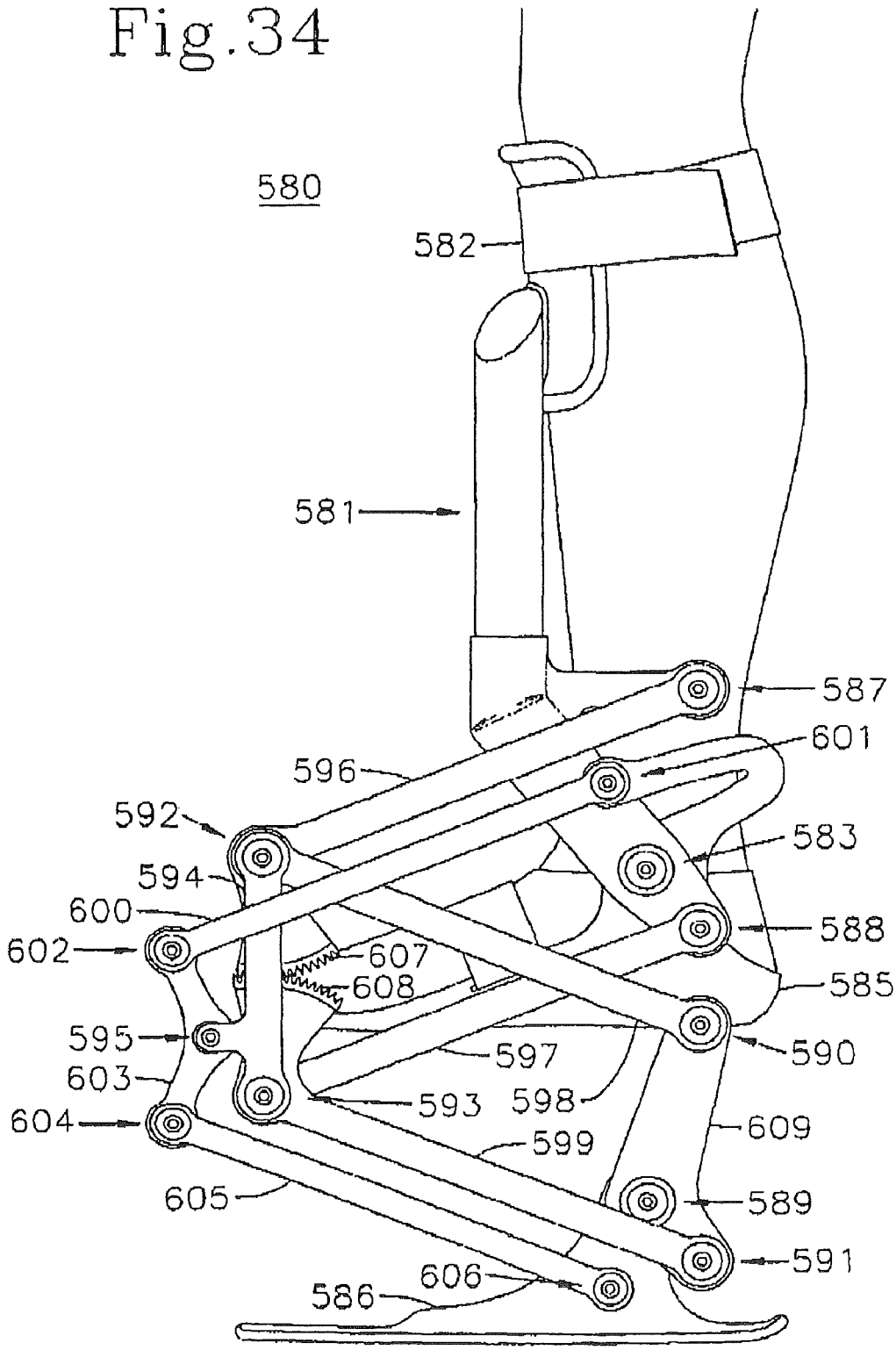
FIG. 34 is a schematic side view illustration of a preferred extended travel embodiment of the present invention having conjugate conjoined dual four-bar linkage for extension motion control and parallel conjoined dual four-bar linkage for ground contact member parallelism control with respect to shoe sole member in accordance with the present invention.

FIG. 34 is a schematic illustration of apparatus 580, the third of four preferred embodiments for the provision of inventive extended travel motion control, namely Conjugate CFBLs for LBMA extension functionality, with parallel (CFBL-based) pitching mode parallelism control. Instead of the LBMA with roller arrays and extension member of the previous embodiments, LBMA functionality like that detailed in FIG. 30 descriptions is provided for this embodiment by constraining AOLLs of a dual CFBL to conjugate motion. A GCM-SSM parallelism control CFBL utilizes existing fixed pivot relationships of the CCFBL apparatus for one set of longitudinal links so adds only single parallel links to and from a conjoining link to provide requisite functionality.

The SBM 581, which is fixedly associated with the shin by a snugging strap 582, etc., comprises pivots 587 and 588 in substantially vertical array, forming a first terminal link (581); the extension member link 609 comprises pivots 590 and 591, in substantially vertical array and with substantially identical spacing as that of first terminal link (581), forming a second terminal link (609); a substantially vertical conjoining link 594 comprises pivots 592 and 593 with substantially identical spacing as that of first and second terminal links (581) and (609); substantially parallel upper longitudinal links 596 and 597 extend between the pivots of the first terminal link (581) and the conjoining link 594; substantially parallel lower longitudinal links 598 and 599 extend between the pivots of the conjoining link 594 and the second terminal link (609). The upper longitudinal link 596 and the lower longitudinal link are AOLLs that if constrained to conjugacy with respect to the plane of their pivots 592 and 593 constrain the two FBLs to mirrored motion, precluding independence of angularity of the separate FBLs with respect to the conjoining link. This mirrored motion constrains the upper and lower terminal links (581) and (609) to colinear relative motion, mimicking the action of linear bearing member assemblies. The upper FBL longitudinal link 597 and the lower FBL longitudinal link 598 also are AOLLs that could alternatively, or additionally, be constrained to conjugacy in order to produce LBMA functionality. The prescribed conjugacy is, for expediency in this illustration, provided by meshing gear teeth 607 and 608, formed in upper and lower AOLLs 596 and 599, respectively. Lower cost conjugacy controls such as crossed tensile members (ribbons or cables) or a conjugacy link may be preferable in actual practice.

The SSM pivots in pitching mode on TAPA bearing 583, while the GCM 586 pivots in pitching mode on transverse axis pivot bearing 589. The selection of a location, for conjoining control link pivot bearing 595, on the conjoining link 594 which corresponds to those of the TAPA 583 and transverse axis pivot bearing 589 in relation to their terminal link pivots provides a fixed "phantom link" length relationship that can serve as half of the parallelism control CFBL structure. The GCM 586 thus is angularly controlled, with respect to its transverse axis pivot bearing 589, by a single lower longitudinal control link 605 connecting a GCM control pivot 606 to a conjoining control link pivot 604, the conjoining link's angular attitude in turn controlled by an upper longitudinal control link 600 connecting a conjoining control link pivot 602 with an SSM control pivot 601.

The GCM 586 in this illustration preferably comprises an engineered elasticity forward portion that provides ATPM flexure with resilient urging by leaf spring action.

Figure 35:
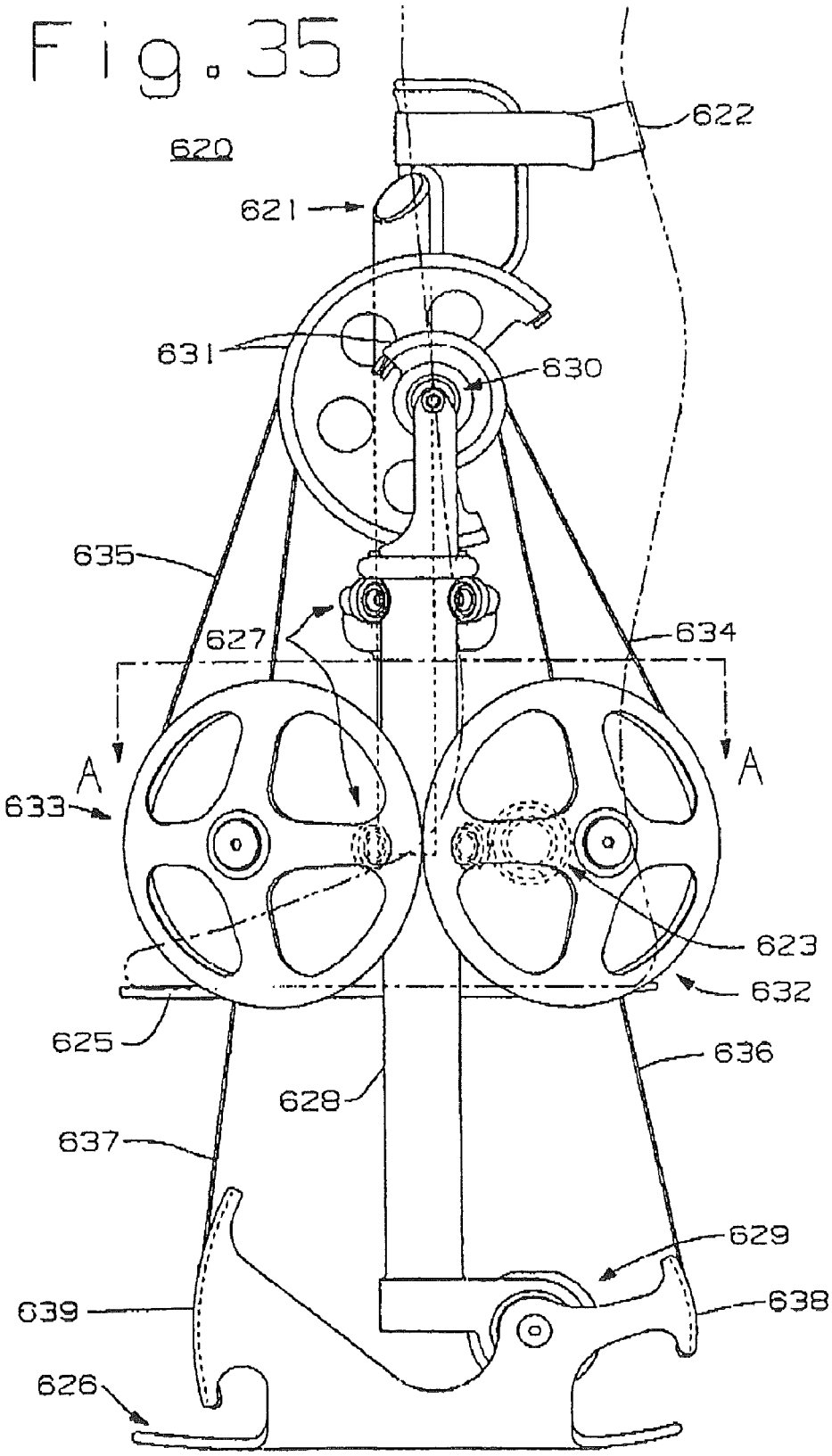
FIG. 35 is a schematic side view illustration of a preferred extended travel embodiment of the present invention having motion control between extensible ground contact member and shoe sole member by conjugate reel springs with rocker pulley apparatus.

FIG. 35 is a schematic illustration of a CR/RPM, the last of four preferred embodiments for the provision of inventive extended travel motion control, an LBMA-guided extension member-mounted GCM with CR/RPM motion transfer for resilient urging and pitching mode parallelism control: LBMA control of extension member motion is substantially the same as detailed in FIGS. 31-33 for the first two of four preferred embodiments. This fourth embodiment is preferred despite its greater packaging space claim, for its best-in-class linearity of spring rate, and its ability to potentially accommodate high magnitudes of extension travel, advantages that potentially offer the highest performance in terms of airtime and travel rate.

As in FIGS. 31-33, an SBM 621 is fixedly associated with a user's lower leg by a snugging strap 622 and an SSM 625 with a TAPA bearing 623 that locates the SBM 621's lower end, and a transverse axis pivot bearing 629 mounts the GCM 626 with pitching mode only degree of freedom to the lower end of the roller array 627-guided extension member 628 as has been detailed previously. The upper end of the extension member 628 mounts a substantially transverse RPM pivot axis bearing member 630 in fixed distance relationship to the TAPA bearing 623. An RPM 631, comprises cable payout radii of ratio substantially identical with the ratio of longitudinal distances between the TAPA and the cable payout grooves of the CRs, distances which are preferably mimicked by FOSCR details 638 and 639 of the GCM 626 for 1:1 ratio rotation between the GCM 626 and the SSM 625 which mounts the CRs 632 and 633.

The CRs 632 and 633, not detailed, each comprise the functionally parallel structures of; 1) a preferably ETS torsional urging apparatus fixedly associated with the SSM 625, and with respect to this fixedness resiliently urging rotation of the rim of; 2) a pulley-like structural support apparatus which permits rotation of its FOSCR rim while locating it in spatially stable fashion by a rotary bearing member assembly with substantially horizontal pivot axis orientation also of structural associativity with the SSM 625, such that the two CRs spatially follow pitching mode motion of the SSM while their rims rotate in mirrored conjugacy with resilient urging, in response to extension member travel. The configuration of the high windup ETS for reel spring resilient urging is preferably the intersection of prior art transition region torque transfer members with prior art uniform numerical stress cylindrical ETS elastomer end contours as illustrated in FIG. 18, albeit with substantially differing proportions arising from the very tall section required for the larger windup capability required of the reel spring ETS.

A reel spring cable 634 in non-slip associativity with a groove in the rim of CR 633 passes over the top of CR 633 to cross over to a similar groove in the rim of CR 632, the bottom of which reel spring cable 634 then passes under on its way to tangent payout in the direction of the small radius rearward facing groove of the RPM with which it is fixedly associated in non-slip fashion. A second reel spring cable 635 passes over the top of CR 632 to cross over to a similar groove in the rim of CR 633, the bottom of which reel spring cable 634 then passes under on its way to tangent payout in the direction of the large radius forward facing groove of the RPM with which it is fixedly associated in non-slip fashion. Both reel spring cable 634 and reel spring cable 635 are resiliently urged downwardly by the rotational resilient urging of CRs 632 and 633 which try to reel them in, in equal linear amounts at any given pitching mode attitude of the SSM 625. This resilient downward urging acts, through the RPM 631 and its pivot bearing 630, to force the GCM 626 downwardly away from the SSM 625 by means of the GCM 626's attachment, through transverse axis pivot bearing 629, to the extension member 628.

A GCM control link cable 636, extends between a FOSCR detail 638 of the GCM 626 and the small radius rearward facing groove of the RPM with which it is fixedly associated in non-slip fashion, and a GCM control link cable 637 extends between a FOSCR detail 639 of the GCM 626 and the large radius forward facing groove of the RPM with which it is fixedly associated in non-slip fashion. These GCM control link cables reflect to the GCM 626 the angular orientation of the SSM 625 as transmitted by the reel spring cables 634 and 635 to the RPM. The RPM is preferably of smaller proportions than those of the SSM 625 and the GCM 626: its angular travel will thus be greater than those of the SSM and the GCM.

Figure 35A:
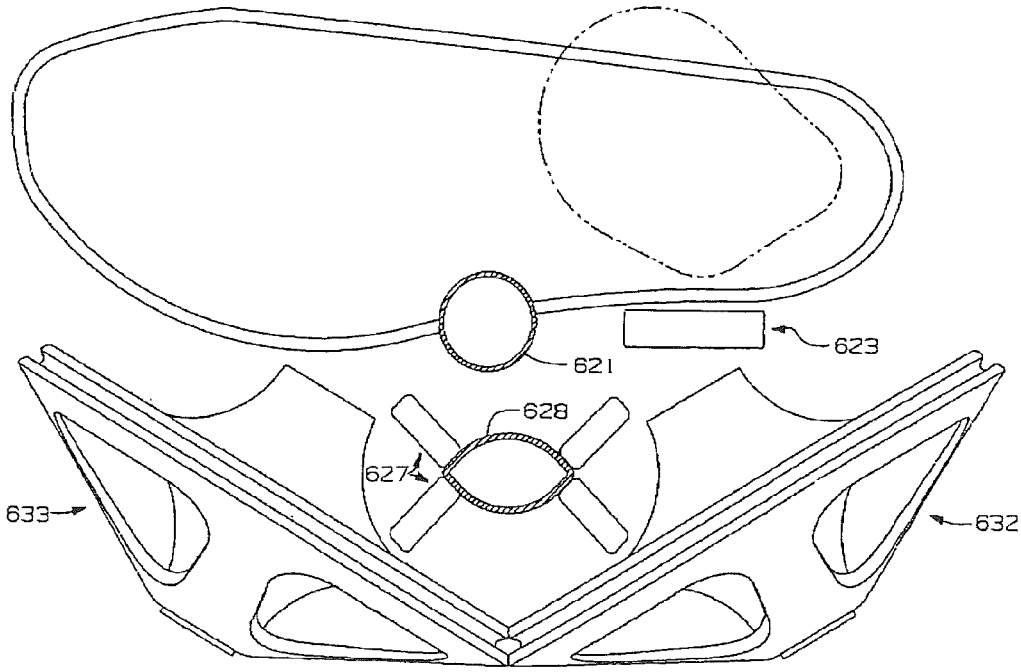
FIG. 35A is a schematic cross sectional top view illustration of the apparatus of FIG. 35.

FIG. 35A is a schematic top view illustration of the preferred relative locations of the principal components of the apparatus 620 of FIG. 35 with respect to a user's foot and ankle, the latter being illustrated in schematic cross-section below the level identified in FIG. 35 as section A-A. The TAPA bearing 632 is seen immediately adjacent the ankle joint and rearward of the SBM 621. The extension member 628 and a guide roller array 627 are far enough outside the SBM 621 to permit the RPM 631 to operate between the SBM 621 and the extension member 628. The CRs 632 and 633 are preferably mounted to the SSM 625 with skewed, in top view, pivot axes to facilitate their compact location adjacent the extension member with reel spring cable payout locations generally in-plane with the RPM 631.

Figure 36:
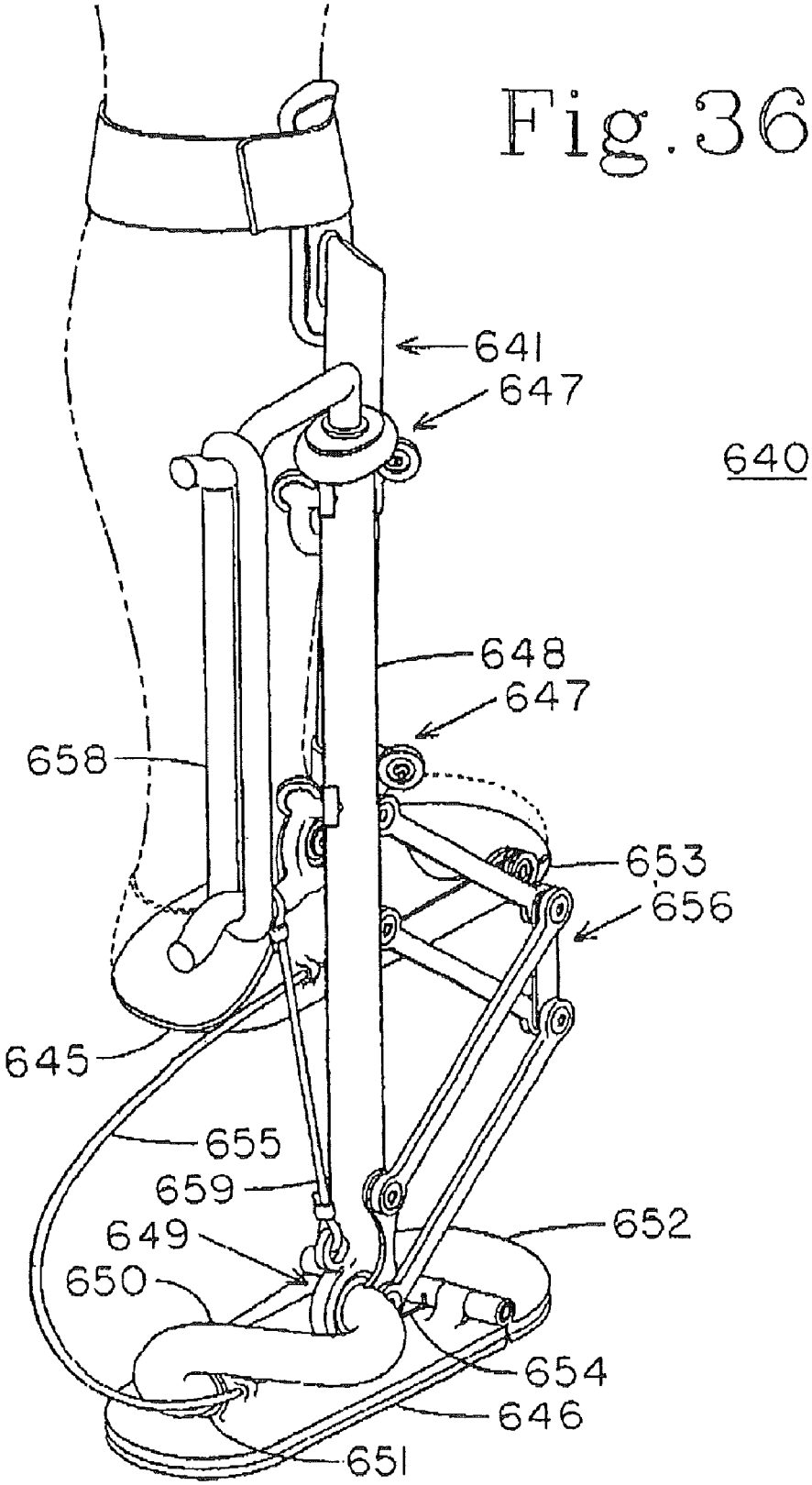
FIG. 36 is a schematic side view illustration of an extended travel embodiment of the present invention similar to FIG. 31 but additionally having roll mode pivoting of ground contact member and with articulating toe pressure member parallelism to angularly mobile toe support member in accordance with a preferred embodiment of the present invention.

FIG. 36 is a schematic illustration of an apparatus 640, which is comparable to apparatus 500 of FIG. 31, with addition of roll mode pivoting of the GCM 646 and cable-controlled parallelism between an ATPM 652 and an AMTSM 653 as have been described in detail in previous Figures. A mobile frame member 650 provides transfer, with axis alignment rigidity, of structural loads from a preferably ETS GCM pivot 651 and the TAPA 649. Preferred elastic urging from the dual CFBL 656 is supplemented by an elastomeric tensile member 658, and extension travel is limited with hysteretic resilience by a high damping elastic tensile member 659. The functionalities of previously introduced features such as the SBM 641, the extension member 648, the roller arrays 647, the SSM 645, the control cable 654 and its sheath 655 are substantially as previously detailed.

Figure 37:
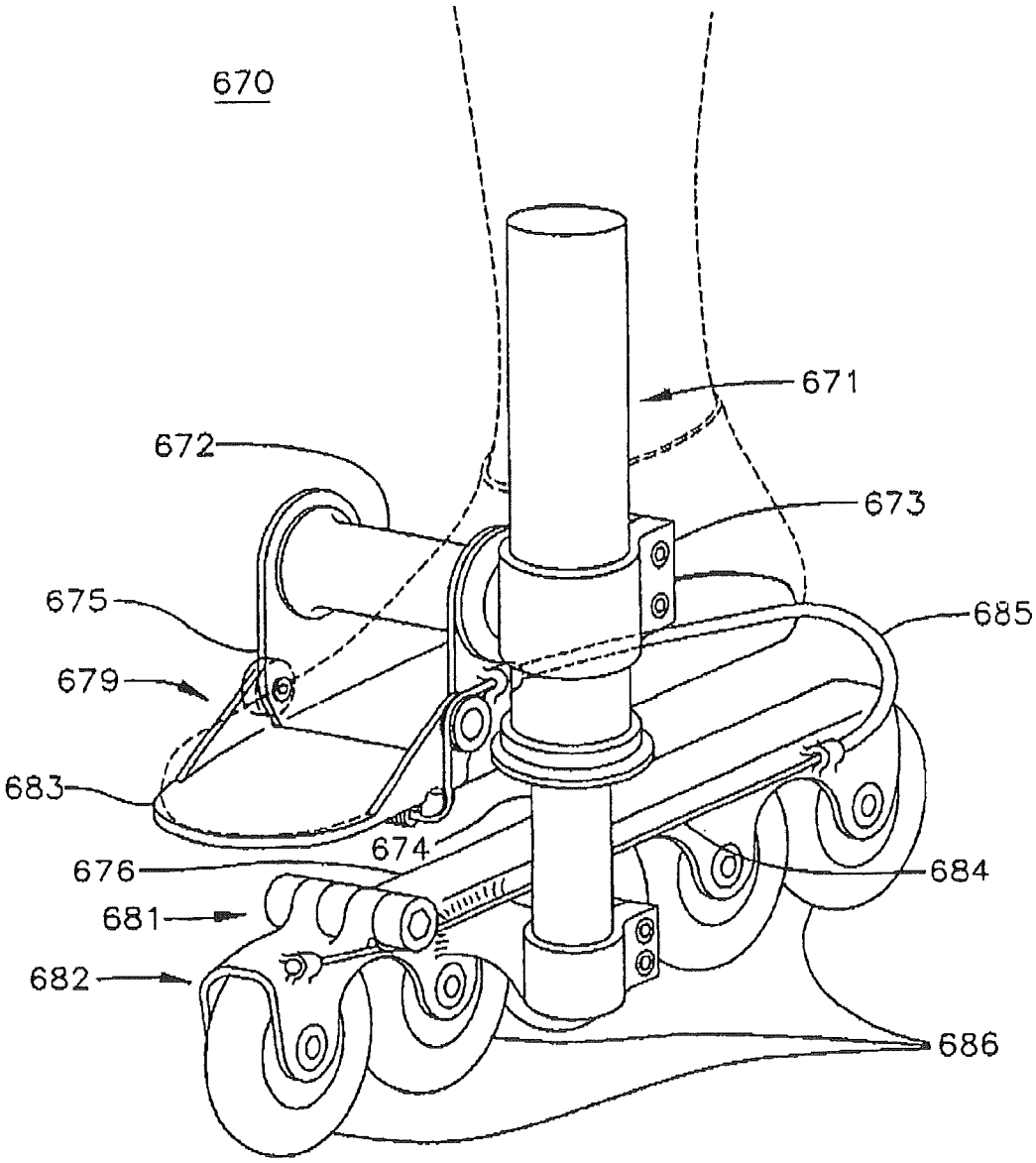
FIG. 37 is a schematic isometric illustration of a roller blade type ground contact member with articulating toe pressure member cable-controlled to angular congruency with angularly mobile toe support member in accordance with the present invention.

FIG. 37 is a schematic illustration of a Full Suspension Footwear rollerblade apparatus 670, substantially the same as the apparatus 440 of FIG. 28 with exception of the configuration of the GCM, which in this case does not utilize roll mode pivoting on a ground-level longitudinal axis because of its inherently pivotal relationship with the smooth hard "treading" surface for which it is best suited with the wheel sizes shown. The functionalities of previously introduced features such as the LBMA 671, the bridging tube 672, the mounting clamp 673, extension member 674, the SSM 675, the AMTSM 683 and its pivots 679, the control cable 684 and its sheath 685 are substantially as previously detailed.

The GCM 676 is in this rollerblade apparatus comprises at least two wheels 686 rotatingly associated with the frame of GCM 676 with transverse rotational axes. An optional wheeled ATPM 682, pivotingly associated with the GCM 676 by a pivot 681 is preferably constrained to substantially angular parallelism between a line tangent to the bottom of its at least one wheel and the bottom of the forwardmost wheel of the GCM 676, and the plane of an AMTSM by, in this example, a flexible sheath type control cable apparatus.

Alternative "all terrain" rollerblade embodiments of Full Suspension Footwear preferably utilize only two large diameter wheels of substantial tread area located in front of and behind the user's foot for minimization of nominal foot elevation above the treading surface. Such all terrain embodiments are preferably of SBM-stabilized extended travel architecture and travel direction, but both inventive preferred embodiments of travel magnitude and associated travel direction are herein disclosed in conjunction with wheeled GCMs.

GLOSSARY OF ABBREVIATIONS

GCM: ground contact member

SSM: shoe sole member shin: lower leg structures, also a descriptive substitute for a line between the knee and ankle join and thus the laterally nominal direction of force transfer, or load centerline TAPA: transverse ankle pivot axis SBM: shin brace member ATPM: articulating toe pressure member (preferred component of GCM)

AMTSM: angularly mobile toe support member (preferred component of SSM)

FBL: four-bar linkage

LBMA: linear bearing member assembly

CFBL: conjoined four-bar linkage

CCFBL: conjugate conjoined four-bar linkage

ETDDL: extension travel direction-defining link

FOSCR: features of substantially constant radii cables: linearly stiff flexible tensile members; ribbons AOLLs: angularly opposed longitudinal links CR/RPM: conjugate reel springs with rocker pulley member.

What is claimed is:

1. A footwear comprising:

a shoe sole member having a heel end and a toe end, said shoe sole member having a support surface;

a ground contact member spaced apart from said shoe sole member;

a motion control apparatus comprising a linear bearing member assembly having a first member coupled to said shoe sole member and a second member operably coupled to said ground contact member, wherein said second member is arranged to move linearly relative to said first member while a user is moving, wherein said movement of said second member is in a direction substantially normal to the shoe sole member, said second member being movable between a first position and a second position, and;

wherein said ground contact member is resiliently urged away from said shoe sole member in said direction.

2. The footwear of claim 1 further comprising a mobile frame member operably coupled between said ground contact member and said shoe sole member, wherein said second member is coupled to said mobile frame member.

3. The footwear of claim 2 wherein said ground contact member is pivotably coupled to said mobile frame member, said pivot having a substantially longitudinal axis adjacent a ground contact member lower surface.

4. The footwear of claim 3 further comprising at least one elastomeric torsion spring operably coupled between said mobile frame member and said ground contact member, said elastomeric torsion spring being arranged to bias said ground contact member first portion into a parallel configuration with said shoe sole member heel portion.

5. The footwear of claim 1 wherein said ground contact member includes a first portion and a second portion coupled by a pivot whereby said second portion is movable relative to said first portion.

6. The footwear of claim 5 further comprising:

a pivot operably coupling said shoe sole member toe end to said shoe sole member heel end; and, parallelism control structure whereby said shoe sole member toe end is constrained to maintaining substantial pitching mode parallelism with at least upward rotation of said ground contact member second portion, thus transferring upward ground contact member second portion motion into upward motion of a user's toes, and transferring user downward toe pressure into ground contact member second portion downward urging.

7. The footwear of claim 6 wherein said parallelism control structure for constraining said shoe sole member toe end to substantial pitching mode parallelism with at least upward rotation of said ground contact member second portion comprises a conjoined four-bar linkage apparatus comprising:

(a) first and second substantially longitudinal pivot links, said first and second substantially longitudinal pivot finks extending in substantially parallel array between (1) first and second pivot means, respectively, of a substantially vertical angularly mobile toe support member pivot link, said substantially vertical pivot link comprising, or fixedly associated with, said angularly mobile toe support member, and (2) two individual pivots, respectively, of a substantially vertical conjoining link;

(b) third and fourth substantially longitudinal pivot links, said third and fourth longitudinal pivot links extending in substantially parallel array in the opposite substantially longitudinal direction, between (1) two individual pivots, respectively, of said substantially vertical conjoining link and (2) first and second pivot pivots, respectively, of a substantially vertical articulating toe pressure member pivot link, said substantially vertical ground contact member second portion pivot link being in fixed pitching mode communication with said ground contact member second portion.

8. The footwear of claim 6 wherein said parallelism control structure for constraining said shoe sole member toe end to substantial pitching mode parallelism with at least upward rotation of said ground contact member second portion comprises a conjoined four-bar linkage apparatus having at least one elongation-resistant flexible tensile member.

9. The footwear of claim 6 wherein said parallelism control structure, for constraining said shoe sole member toe end to substantial pitching mode parallelism with at least upward rotation of said ground contact member second portion, comprises a conjoined four-bar linkage apparatus comprising:

(a) at least one elongation-resistant flexible tensile member, said it least one elongation-resistant flexible tensile member being in substantially non-slip communication with (b) a reverser pulley member, said reverser pulley member being in pitching mode communication with at least one of said ground contact member second portion and said shoe sole member toe end.

10. The footwear of claim 6 wherein said parallelism control structure, for constraining said shoe sole member toe end to substantial pitching mode parallelism with at least upward rotation of said ground contact member second portion, comprises concentric sheath type flexible control cable, said flexible control cable comprising an axially stiff flexible sheath radially outward of an axially stiff flexible tensile member.

11. The footwear of claim 5 further comprising a biasing member operably coupled to said ground contact member to bias said second portion in a direction parallel to said first portion.

12. The footwear of claim 11 wherein said biasing member is selected from a group consisting of a torsion spring, a leaf spring, and a structurally integral leaf spring arranged between said first portion and said second portion.

13. The footwear of claim 1 further comprising a linear bearing disposed between said first member and said second member.

14. The footwear of claim 1 wherein said shoe sole member comprises at least one longitudinal air channel between a first inlet opening and a second discharge opening, said air channel comprising a perforated upper surface in fluid communication with said support surface.

15. The footwear of claim 1, further comprising a resilient mesh curtain disposed about and between a peripheral region of said shoe sole member and said ground contact member.

16. The footwear of claim 1 further comprising:

(a) a transverse ankle pivot axis bearing member assembly having a substantially transverse pivot axis, and having at least a first element in fixed communication with said shoe sole member, and (b) a shin brace member having an upper end and a lower end, said upper end comprising means for coupling with a user's lower leg and said lower end being coupled with at least a second element of said transverse ankle pivot axis bearing member assembly.

* * * * *